US005354376A

United States Patent [19]

Aidun

[11] Patent Number: 5,354,376

[45] Date of Patent: Oct. 11, 1994

[54] FLOTATION COATING DEVICE FOR TRAVELING WEBS

[75] Inventor: Cyrus K. Aidun, Marietta, Ga.

[73] Assignee: Institute of Paper Science and Technology, Atlanta, Ga.

[21] Appl. No.: 137,957

[22] Filed: Oct. 15, 1993

Related U.S. Application Data

[63] Continuation-in-part of Ser. No. 881,512, May 12, 1992, which is a continuation-in-part of Ser. No. 849,530, Mar. 11, 1992, abandoned.

[51] Int. Cl.[5] ..... B05C 5/00

[52] U.S. Cl. ..... 118/410; 118/419; 118/411

[58] Field of Search ..... 427/434.3, 434.5, 439, 427/595, 598; 118/411, 410, 412, 419

[56] References Cited

U.S. PATENT DOCUMENTS

| | | | |
|---|---|---|---|
| 3,083,685 | 4/1963 | Colgan | 118/410 |
| 3,113,884 | 12/1963 | Kohler | 117/37 |
| 3,418,970 | 12/1968 | Phelps et al. | 118/410 |
| 3,690,917 | 9/1972 | Hershoff et al. | 117/34 |
| 4,102,299 | 7/1978 | Wallsten | 118/50 |
| 4,250,211 | 2/1981 | Damrau et al. | 427/356 |
| 4,369,731 | 1/1983 | Damrau | 118/410 |
| 4,387,663 | 6/1983 | Alheid | 118/413 |
| 4,452,833 | 6/1984 | Holt | 427/356 |
| 4,643,127 | 2/1987 | Wanke | 118/413 |
| 4,688,516 | 8/1987 | Sommer | 118/410 |
| 4,834,018 | 5/1989 | Sollinger et al. | 118/410 |
| 4,836,134 | 6/1989 | Knop | 118/413 |
| 4,839,201 | 6/1989 | Rantanen et al. | 427/355 |
| 4,858,553 | 8/1989 | Westergard et al. | 118/126 |
| 4,873,939 | 10/1989 | Eskelinen | 118/410 |
| 4,920,913 | 5/1990 | Knop et al. | 118/410 |
| 4,945,855 | 8/1990 | Eklund et al. | 118/407 |
| 5,173,120 | 12/1992 | Suzumura et al. | 118/410 |

OTHER PUBLICATIONS

Rudolf Beisswanger and Dr. Ing. Hans-Peter Sollinger, "Coating Paper and Board, Practical Experience with the SDTA and LDTA," from *TAPPI Seminar Notes,* 1986 Blade Coating, pp. 137-142.

E. W. Wight, "Modern Coating Application and Blade Metering Systems," from *TAPPI Seminar Notes,* 1986 Blade Coating, pp. 105-108.

Herbert Sommer, "Applicating Systems for Coating ULWC and MFP Papers," from *TAPPI Proceedings,* 1988 Coating Conference, pp. 131-137.

(List continued on next page.)

*Primary Examiner*—W. Gary Jones
*Assistant Examiner*—Brenda Lamb
*Attorney, Agent, or Firm*—Fitch, Even, Tabin & Flannery

[57] ABSTRACT

A coating applicator for application of coating material to the surface of a web or a flexible substrate. The coating device contains a walled application chamber where a flowing stream of the coating liquid first comes into contact with the substrate. The coating liquid enters a channel of the application chamber at the upstream side and wets the substrate as it flows in the same direction as the substrate. A doctor element is positioned at the downstream side of the channel where the excess coating in the channel follows the contour of the boundary formed by the doctor element and leaves the channel. One of the applicator walls is designed to be a floating or moving wall or belt. The floating applicator wall and geometry of the streamlined boundaries of the coating device eliminates the formation of recirculating eddies or vortices. The elimination of vortices eliminates flow instability due to centrifugal forces and removes harmful pressure fluctuations which could result in coat-weight nonuniformities.

18 Claims, 44 Drawing Sheets

OTHER PUBLICATIONS

F. R. Pranckh and L. E. Scriven, "Elastohydrodynamics of Blade Coating," *AIChE Journal,* vol. 36, No. 4, pp. 587–597, Apr. 1990, (best copy).

N. G. Triantafillopoulos and C. K. Aidun, "Relationship between flow instability in short-dwell ponds and cross directional coat weight nonuniformities,"reprinted from *Tappi Journal,* vol. 73, No. 6, pp. 127–136, Jun. 1990.

Cyrus K. Aidun, "Principles of Hydrodynamic Instability: Application on Coating Systems; Part 1. Background," reprinted from *Tappi Journal,* vol. 74, No. 2, pp. 213–219, Feb. 1991.

Cyrus K. Aidun, "Principles of Hydrodynamic Instability: Application on Coating Systems; Part 2. Examples of flow instability," reprinted from *Tappi Journal,* vol. 74, No. 3, pp. 213–220, Mar. 1991.

Cyrus K. Aidun, "Principles of Hydrodynamic Instability: Application on Coating Systems; Part 3. A generalized view of instability and bifurcation," reprinted from *Tappi Journal,* vol. 74, No. 4, pp. 209–213, Apr. 1991.

C. K. Aidun, N. G. Triantafillopoulos and J. D. Benson "Global stability of a lid-driven cavity with throughflow: Flow visualization studies," *Phys. Fluids A* vol. 3, No. 9, American Institute of Physics, pp. 2081–2091, Sep. 1991.

J. D. Benson and C. K. Aidun, "Transition to unsteady nonperiodic state in a through-flow lid-driven cavity", *Phys. Fluids A,* (Brief Communications) vol. 4, No. 10, American Institute of Physics, pp. 2316–2319, Oct. 1992.

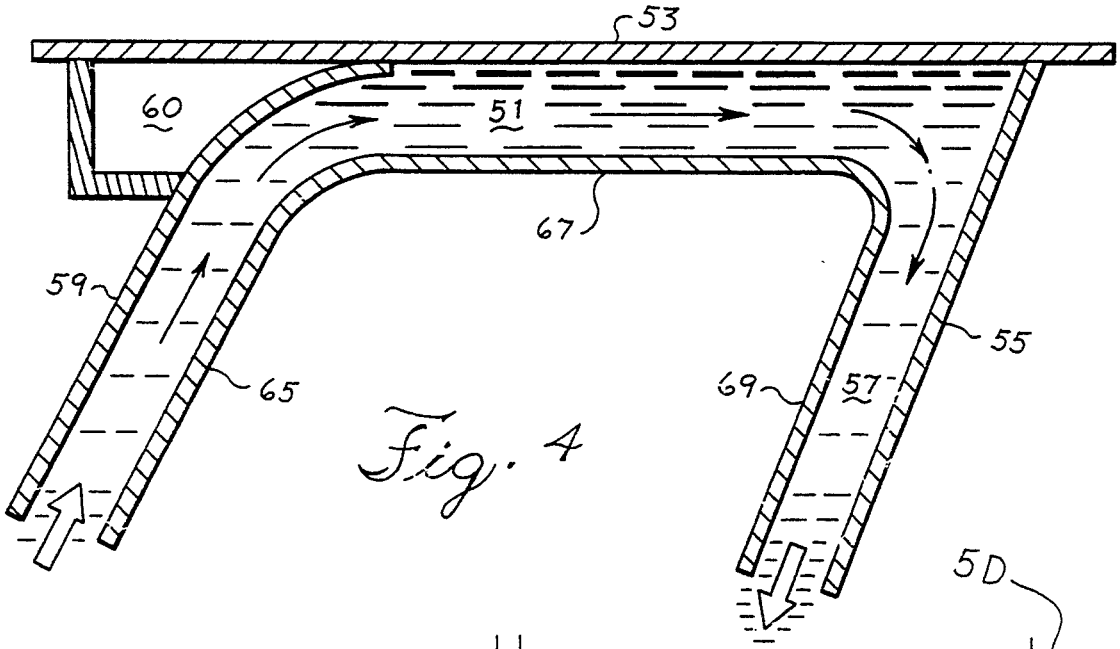
Fig. 4
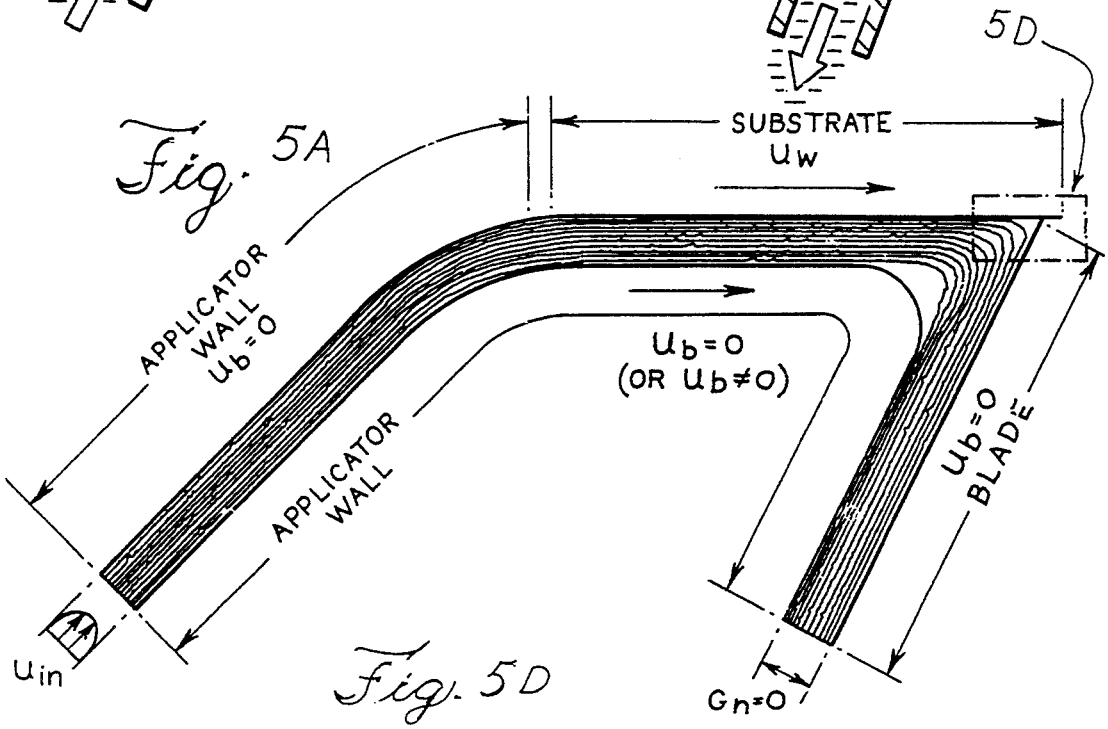
Fig. 5A
Fig. 5D
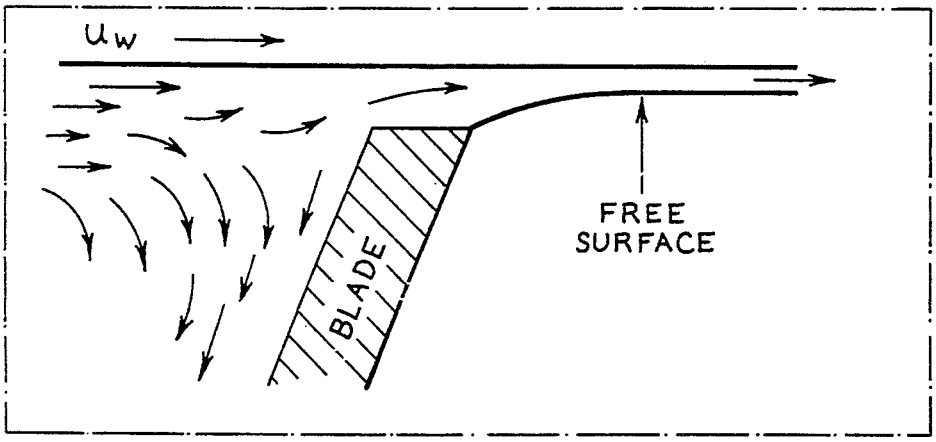

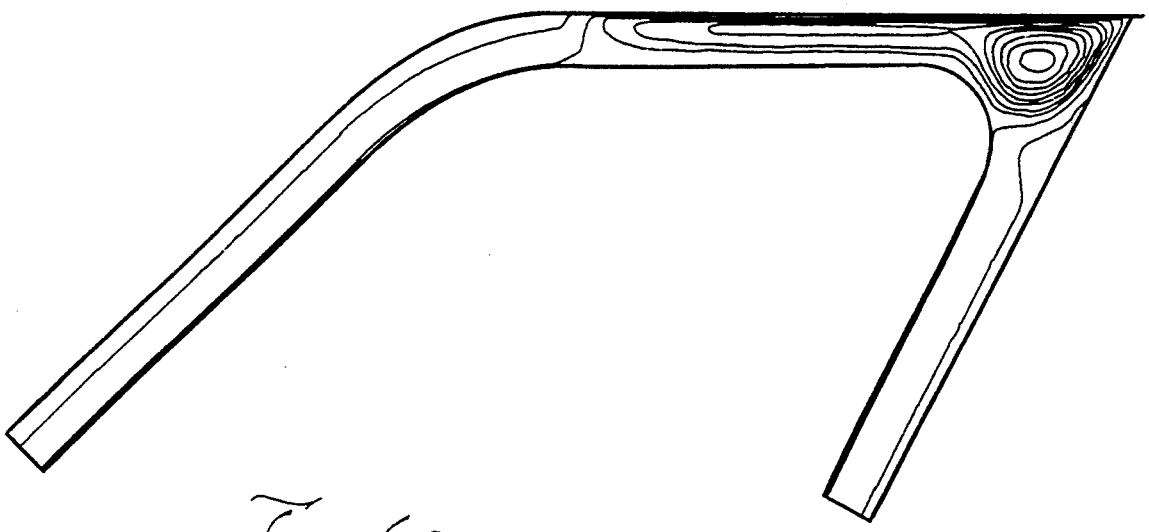
Fig. 6G
Fig. 7A
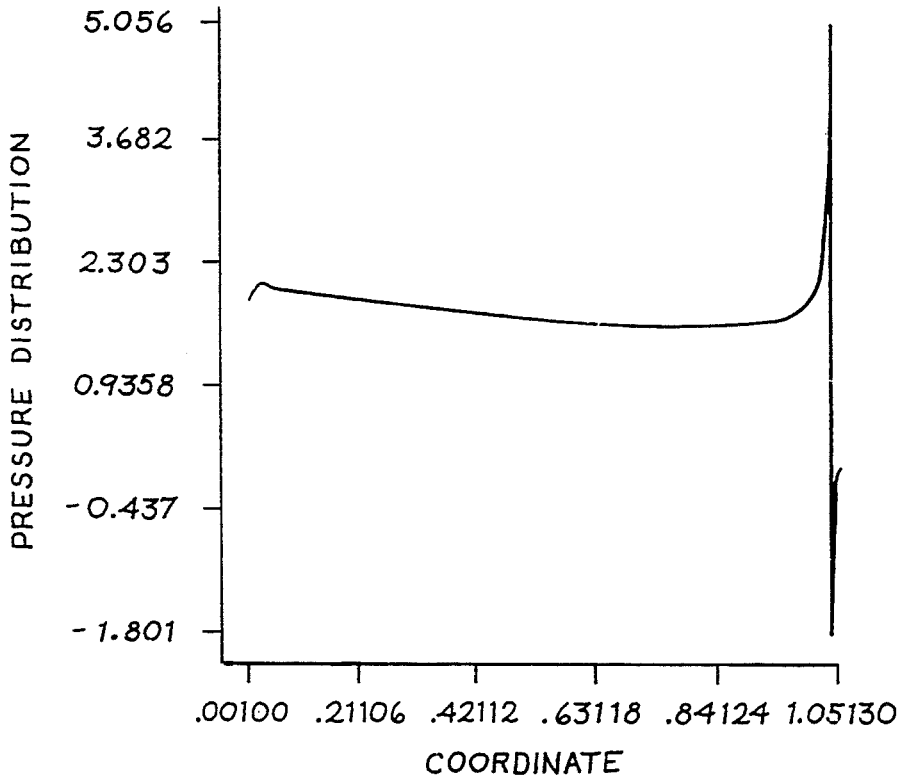

11.27
8.098
4.928
1.758
-1.412
-4.582
PRESSURE DISTRIBUTION
.00000 .21006 .42012 .63018 .84024 1.05030
COORDINATE 21.61
15.46
9.306
3.156
-2.994
-9.144
PRESSURE DISTRIBUTION
.00000 .21066 .42132 .63198 .84264 1.0533
COORDINATE 43.56
31.24
18.92
6.597
-5.726
-18.05
PRESSURE DISTRIBUTION
.00000 .21066 .42132 .63198 .84264 1.05330
COORDINATE 9.57
6.96
4.35
1.739
-0.87
-3.48
PRESSURE DISTRIBUTION
.00000 .21066 .42132 .63198 .84264 1.05330
COORDINATE 15.90
11.72
7.531
3.346
-0.839
-5.025
PRESSURE DISTRIBUTION
.00000
.21066
.42132
.63198
.84264
1.0533
COORDINATE 23.42
17.45
11.47
5.50
-0.474
-6.448
PRESSURE DISTRIBUTION
.00100
.21166
.42232
.63298
.84364
1.05430
COORDINATE 338.9
265.4
191.9
118.5
44.99
-28.47
PRESSURE DISTRIBUTION
.00000 .21246 .42492 .63738 .84984 1.06230
COORDINATE 388.0
304.8
221.6
138.5
55.34
-27.82
PRESSURE DISTRIBUTION
.00100 .21346 .42592 .63838 .85084 1.06330
COORDINATE 439.6
346.3
252.9
159.6
66.28
-27.04
PRESSURE DISTRIBUTION
.00000 .21246 .42492 .63738 .84984 1.06230
COORDINATE 492.7
388.8
284.9
181.0
77.16
-26.74
PRESSURE DISTRIBUTION
.00100 .21346 .42592 .63838 .85084 1.06330
COORDINATE 12.02
9.257
6.491
3.725
0.959
-1.806
PRESSURE DISTRIBUTION
.00100 .21546 .42992 .64438 .85884 1.07330
COORDINATE 26.94
19.70
12.45
5.198
-2.051
-9.299
PRESSURE DISTRIBUTION
.00100 .21396 .42692 .63988 .85284 1.06580
COORDINATE 48.10
35.53
22.35
10.38
-2.193
-14.77
PRESSURE DISTRIBUTION
.00000 .21296 .42592 .63888 .85184 1.06480
COORDINATE 75.06
56.34
37.62
18.90
0.179
-18.54
PRESSURE DISTRIBUTION
.00100 .21396 .42692 .63988 .85284 1.06580
COORDINATE

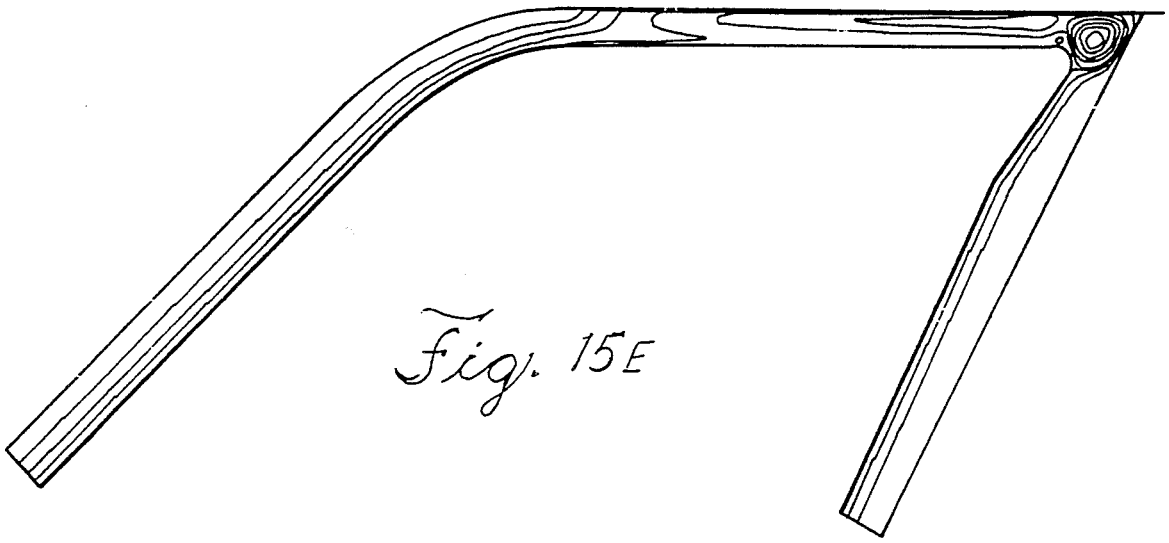
Fig. 15E
Fig. 16A
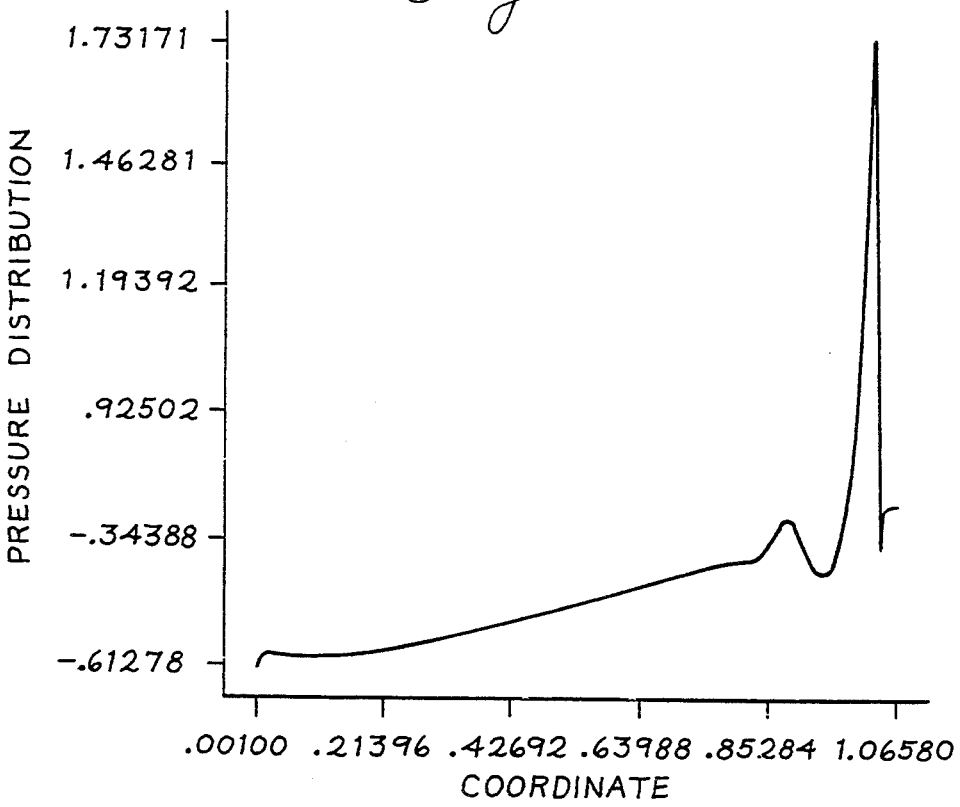

4.65
3.36
2.075
0.789
-1.118
-1.783
PRESSURE DISTRIBUTION
.00000 .21296 .42592 .63888 .85184 1.06480
COORDINATE 45.73
32.71
19.70
6.676
-6.34
-19.36
PRESSURE DISTRIBUTION
.00000 .21296 .42592 .63888 .85184 1.06480
COORDINATE 45.09
31.92
18.75
5.584
-7.586
-20.76
PRESSURE DISTRIBUTION
.00000 .21296 .42592 .63888 .85184 1.06480
COORDINATE 44.49
31.17
17.86
4.538
-8.778
-22.09
PRESSURE DISTRIBUTION
.00000 .21296 .42592 .63888 .85184 1.06480
COORDINATE

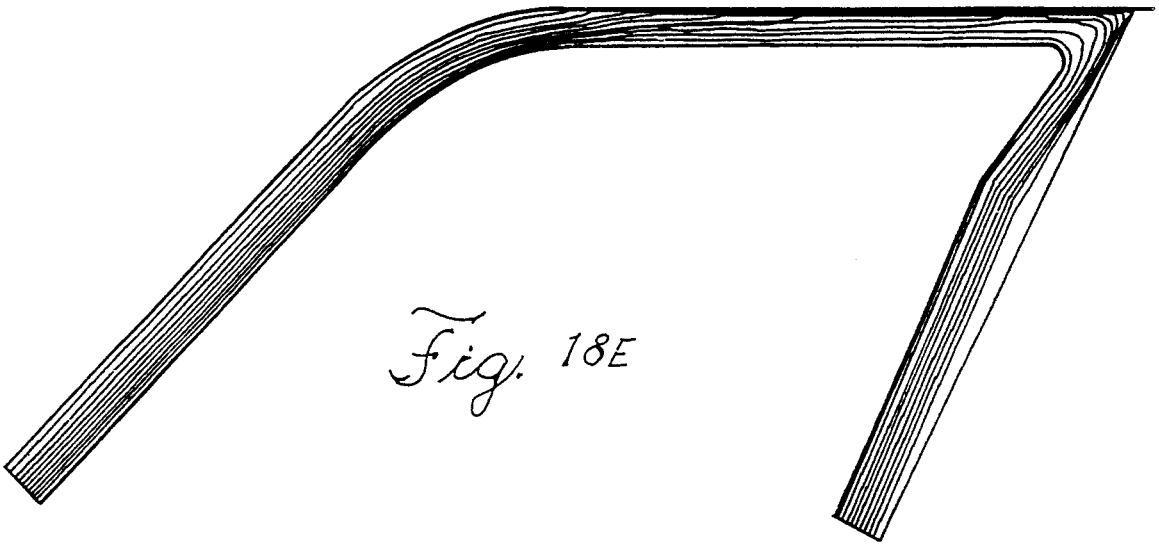
Fig. 18E
Fig. 19A
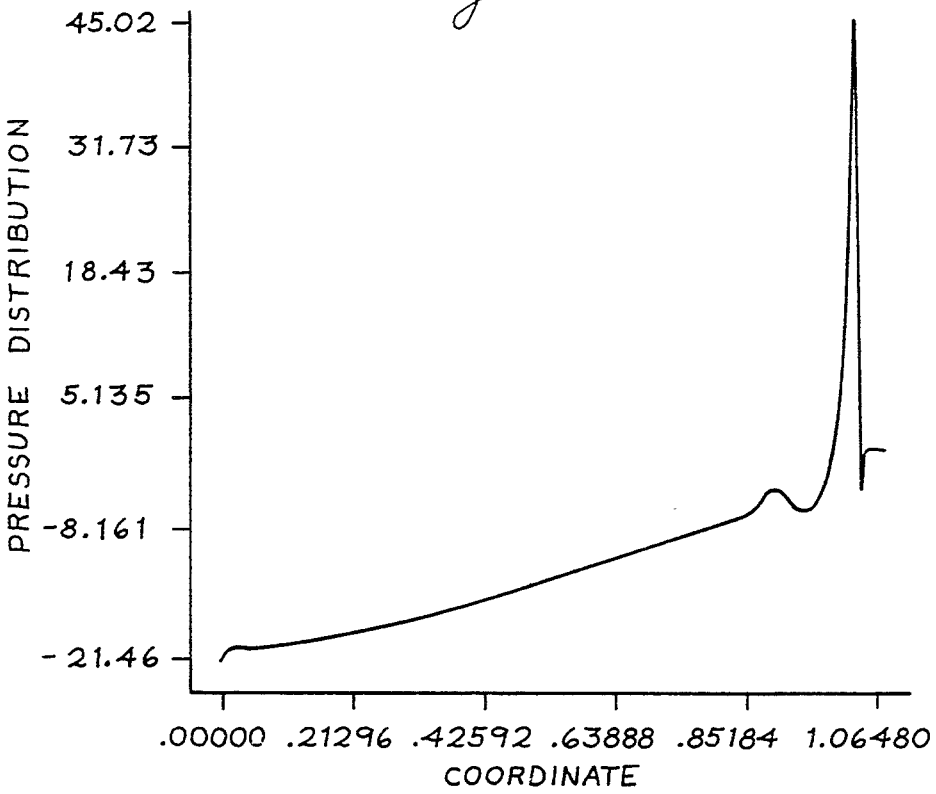

47.04
33.81
20.58
7.344
-5.891
-19.12
PRESSURE DISTRIBUTION
.00000 .21296 .42592 .63888 .85184 1.06480
COORDINATE 49.995
36.76
23.54
10.32
-2.911
-16.14
PRESSURE DISTRIBUTION
.00000 .21296 .42592 .63888 .85184 1.06480
COORDINATE 483.8
344.9
205.9
67.03
-71.90
-210.83
PRESSURE DISTRIBUTION
.00000 .21296 .42592 .63888 .85184 1.06480
COORDINATE 536.88
396.3
255.8
115.2
-25.37
-165.9
PRESSURE DISTRIBUTION
.00000 .21296 .42592 .63888 .85184 1.06480
COORDINATE 75.76
56.05
36.34
16.62
-3.090
-22.80
PRESSURE DISTRIBUTION
.00000 .21296 .42592 .63888 .85184 1.06480
COORDINATE 809.8
602.9
396.1
189.1
-17.64
-224.5
PRESSURE DISTRIBUTION
.00000 .21296 .42592 .63888 .85184 1.06480
COORDINATE

FLOTATION COATING DEVICE FOR TRAVELING WEBS

CROSS-REFERENCE TO RELATED APPLICATION

This application is a continuation-in-part of application Ser. No. 881,512, filed May 12, 1992, which is a continuation-in-part of application Ser. No. 849,530 filed Mar. 11, 1992, now abandoned.

FIELD OF THE INVENTION

The present invention relates generally to a coating device for uniform coating of a traveling web of material. More particularly, the present invention relates to a short-dwell coater which eliminates the captive pond associated with short dwell coaters and provides the coating material in the form of a flowing stream of coating material which flows in the same direction as the web movement.

BACKGROUND OF THE INVENTION

One of the most significant changes in light weight coated (LWC) paper production is the use of the short-dwell coater. The short-dwell coater has enabled the paper maker to improve productivity while maintaining coated paper quality. The term "short-dwell" refers to the relatively short period of time that the coating is in contact with a web of paper material before the excess is metered off by a trailing doctor blade. As shown in FIG. 1, prior art short-dwell coaters consist of a captive pond 21 just prior to the doctor blade 23. The pond is approximately 5 cm in length and is slightly pressurized to promote adhesion of the coating to the paper web 25. The excess coating supplied to the sheet creates a backflow of coating 27. This coating backflow excludes to some extent the boundary layer of air entering with the sheet and eliminates skip coating. The excess coating is channeled over an overflow baffle 29 and collected in a return pan before returning to tanks to be screened.

While short-dwell coaters are extensively used in coating paper webs, such coaters suffer from a major problem. The flow in the coating chamber of the pond upstream of the doctor blade contains recirculating eddies or vortices which can result in coat-weight nonuniformities and wet streaks or striations in several ways. For example, these eddies can become unstable due to centrifugal forces and result in the generation of unsteady flow and rapidly fluctuating vortices, which deteriorate the coating uniformity and its quality. Also, the vortices tend to entrap small air bubbles which result in the buildup of relatively large air inclusions in the coating liquid which tend to accumulate in the core region of the eddies. Vortex fluctuations tend to force these air inclusions into the blade gap. This adversely affects the coating quality. Usually, the presence of air inclusions results in regions of lower coat weight which are 2–4 cm wide and about 10–100 cm long, known in the industry as "wet streaks". These problems are discussed in an article "*Principles of Hydrodynamic Instability: Application in Coating Systems*", C. K. Aidun, Tappi Journal, Vol. 74, No. 3, March, 1991.

It would be desirable to provide a coating device which has the coating advantages of a short-dwell coater, but which did not have the problems associated with recirculating eddies or vortices and the entrapment of air pockets or air bubbles in the core of the vortices.

Accordingly, it is a principal object of the present invention to provide a vortex free short-dwell coating device.

These and other objects will become more apparent from the following description and the appended claims.

BRIEF DESCRIPTION OF THE DRAWINGS

FIG. 4 is a schematic cross-section of a further embodiment of the short-dwell coating device;

FIGS. 5A, 5B, 5C and 5D are sketches of an embodiment of a blade coating apparatus having a moving applicator wall in accordance with the present invention;

FIGS. 6A–6G illustrate flow characteristics for cases B1 to B7 of Table 2;

FIGS. 7A–7G illustrate pressure distribution along the substrate for cases B1 to B7 of Table 2;

FIGS. 15A–15E illustrate flow characteristics for cases NB31 to NB35 of Table 5.

FIGS. 16A–16E illustrate pressure distribution along the substrate for cases NB31 to NB35 of Table 5.

FIGS. 18A–18E illustrate flow characteristics for cases NB51 to NB55 of Table 6.

FIGS. 19A–19E illustrate pressure distribution along the substrate for cases NB51 to NB55 of Table 6;

SUMMARY OF THE INVENTION

The present invention is directed to a coating device for application of coating material to the surface of a web or a flexible substrate. The coating device contains a pressurized channel where a flowing stream of the coating liquid first comes into contact with the substrate. The coating liquid enters the channel at the upstream side and wets the substrate as it flows in the same direction as the substrate. A doctor element is positioned at the downstream side of the channel where the excess coating in the channel follows the contour of the boundary formed by the doctor element and leaves the channel. The geometry of the streamlined boundaries of the coating device eliminate the formation of recirculating eddies or vortices. The elimination of vortices eliminates flow instability due to centrifugal forces and removes harmful pressure fluctuations which could result in coat-weight nonuniformities. The elimination of recirculating eddies or vortices also removes the possibility of entrapping air pockets or air bubbles in the core of the vortices which could reach the blade gap and could result in coat-weight nonuniformities and wet streaks.

The present invention is further directed toward the study of flow patterns in blade coating to develop high-speed coaters. The walls of the applicator are considered rigid, i.e. they do not deform under the effect of hydrodynamic pressure and shear stress exerted by the flow on the boundaries. One of the applicator walls is designed to be a floating or moving wall or belt. The effect of the floating applicator wall is that recirculating eddies and vortices are reduced.

DETAILED DESCRIPTION OF THE PREFERRED EMBODIMENT

Figure 1:
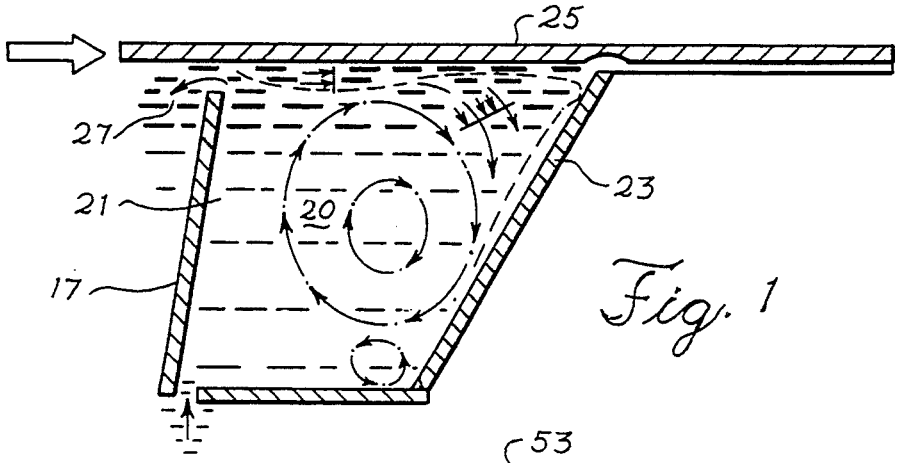
FIG. 1 is a schematic cross-sectional view of a prior art short-dwell coating device.
Figure 2:
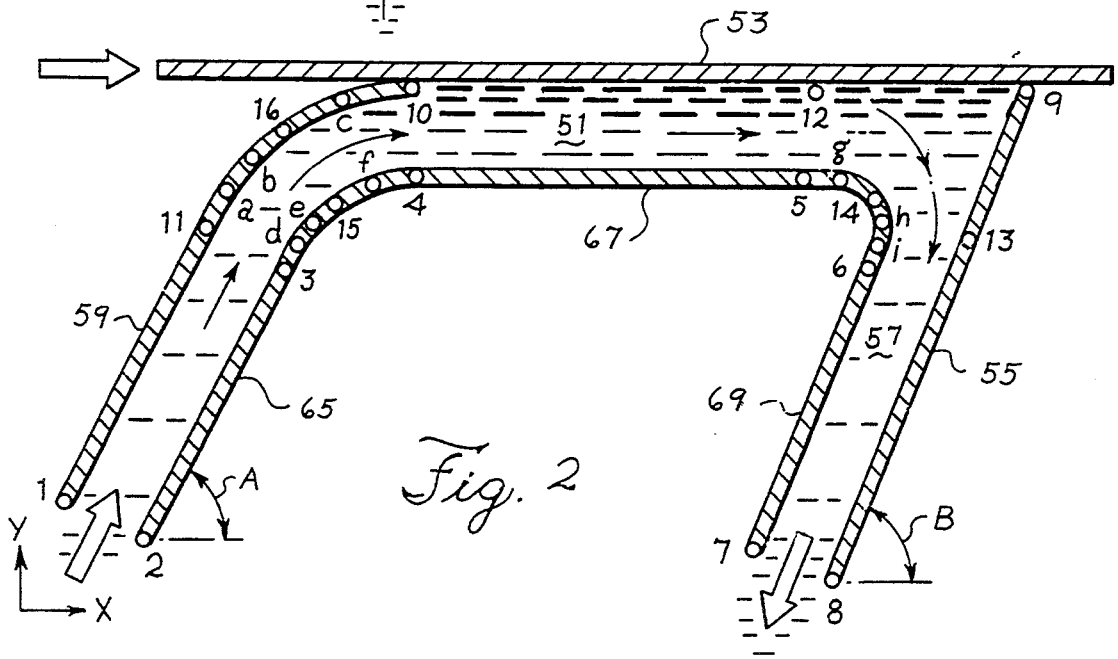
FIG. 2 is a schematic cross-sectional view of an embodiment of a short-dwell coating device.

As shown in FIG. 2, the short-dwell coating device of the present invention consists of a continuous channel of coating material which passes through a coating chamber 51 which is in contact with a web 53 of material which is to be coated. The coating device comprises straight and curvilinear wall sections. For purposes of orientation and discussion, the coating chamber has an upstream side and a downstream side with respect to movement of the web with the upstream side being to the left of FIG. 1. The use of the terms "horizontal" and "vertical" are with respect to a horizontal orientation of the web. The web, however, is usually supported on a counter roll and has a slight curvature in the region of the coating chamber.

The coating device includes a doctor element 55 which is spaced from the web for defining the thickness of the coating on the web. The doctor element 55 extends across the web transversely to the direction of the web motion. The doctor element also forms a downstream boundary wall of the coating chamber 51 and extends downwardly for a further distance to define the downstream wall of an exit plenum 57.

An upstream boundary wall 59 defines the upstream side of the coating chamber 51. The upstream boundary wall 59 extends downwardly for a further distance to define the upstream side of an entrance plenum 61. The upstream boundary wall 59 terminates at its uppermost end in contact with the web 53. As shown in FIG. 2, the terminal end of the upstream boundary wall 59 preferably has a curvilinear shape so that the terminus of the upstream boundary wall 59 is substantially tangential to the web 53. The upstream boundary wall 59 also extends across the web transversely to the direction of the web motion.

A continuous interior wall which also extends across the web transversely to the direction of web motion, has discrete sections, which in combination with the upstream boundary wall 59, the web 53 and the doctor element 55, define the entrance plenum 61, the coating chamber 51 and the exit plenum 57, respectively. The first section 65 of the interior wall defines the downstream side of the entrance plenum 61. The first interior wall section 65 is preferably substantially parallel to the upstream boundary wall 59. The first interior wall section 65 preferably undergoes a curvilinear transition to a second interior wall section 67. The second interior wall section 67 defines the bottom wall of the coating chamber 51. The second interior wall section 67 proceeds to a third interior wall section 69, preferably through a curvilinear transition section. The third interior wall section 69 defines the upstream side of the exit plenum 57. Both the second interior wall section 67 and the third interior wall section 69 are preferably substantially parallel to the web and the doctor element 55, respectively.

The upstream boundary wall 59 preferably terminates in a curvilinear section which is substantially parallel to the curvilinear transition section between first interior wall section 65 and second interior wall section 67. The terminal end of the upstream boundary wall 59 is also preferably biased against the web 53 to prevent any coating material from being forced between the terminal end of the upstream boundary wall and the web 53 and to prevent air from entering into the coating material. The biasing may be accomplished through the use of any suitable means, such as by use of a spring or a flexible material.

As shown in FIG. 4, a vacuum box 60 can be provided to further ensure that no air will become entrained in the coating material. When a vacuum is established in vacuum box 60, the air pressure near the wetting line is reduced, thereby increasing the biasing effect on the boundary wall 59 and preventing any air inclusion at high speeds. The vacuum box 60 is defined by the web 53, the upstream boundary wall and by walls 62 and 64 which extend across the web transversely to the direction of web motion. The outward ends of the vacuum box are capped and one of these ends is fitted to a vacuum source (not shown).

The walls forming the entrance plenum 61 may be vertical at a right angle to web 53. The entrance plenum walls, however, are preferably upwardly inclined in a direction toward the downstream side. The angle A of inclination of the entrance plenum is preferably in the range of from about 10° to about 90°, most preferably about 45°. The walls forming the exit plenum 57 may also be vertical, but are preferably inclined downwardly in a direction toward or away from the upstream side of the exit plenum. The angle B of inclination of the exit plenum is preferably in the range of from about 20° to about 175°, most preferably about 63°.

As an example of construction of the coating device of the present invention, various spatial nodes have been designated in the various walls of the coating device with the numbers 1 through 16. These nodes are identified in the table below with spatial displacements from node 1 in terms of X and Y coordinates. Curve points a through i have also been designated with X and Y coordinates.

TABLE 1

| Node # | X(mm) | Y(mm) | Curve Points | X(mm) | Y(mm) |
|---|---|---|---|---|---|
| 1 | 0 | 0 | a | 32 | 32 |
| 2 | 3.536 | −3.536 | b | 35 | 34 |
| 3 | 34 | 27 | c | 45 | 39 |
| 4 | 52 | 35 | d | 36 | 29 |
| 5 | 85 | 35 | e | 40 | 31.5 |
| 6 | 91 | 25 | f | 47 | 34 |
| 7 | 76.555 | −4.7 | g | 88 | 34 |
| 8 | 81 | −7 | h | 91 | 30 |
| 9 | 105 | 40 | i | 91.5 | 27 |
| 10 | 52 | 40 | | | |

TABLE 1-continued

| Node # | X(mm) | Y(mm) | Curve Points | X(mm) | Y(mm) |
|---|---|---|---|---|---|
| 11 | 30 | 30 | | | |
| 12 | 85 | 40 | | | |
| 13 | 98 | 26 | | | |
| 14 | 90 | 32 | | | |
| 15 | 43 | 33 | | | |
| 16 | 40 | 37 | | | |

Figure 3:
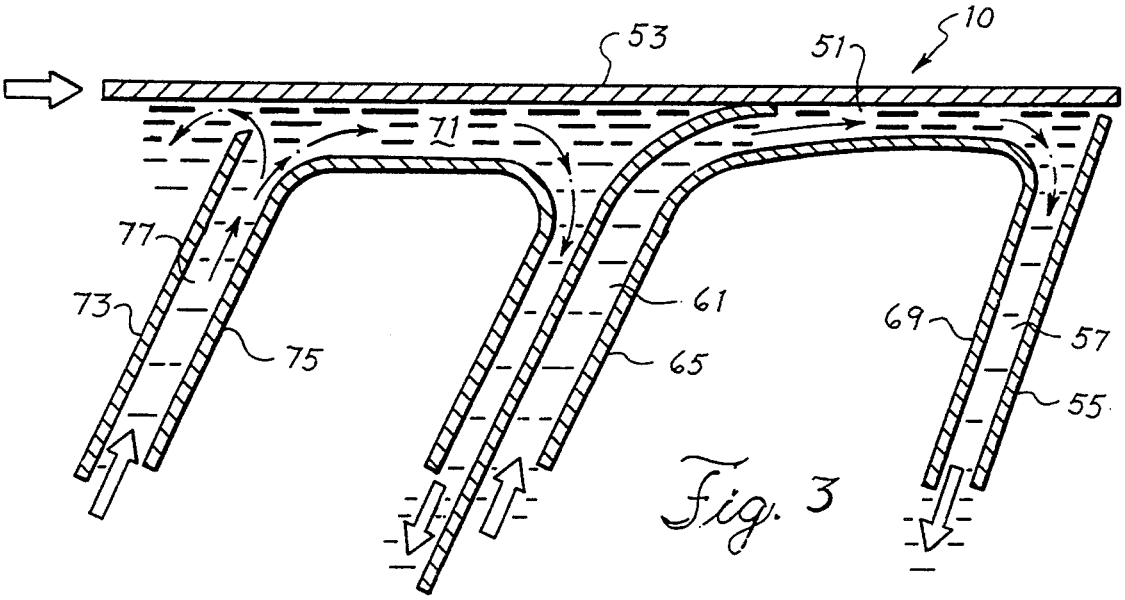
FIG. 3 is a schematic cross-sectional view of another embodiment of the short-dwell coating device.

In another embodiment of the invention, as shown in FIG. 3, a pre-coating chamber 71 is provided on the upstream side of the short-dwell coating device of the invention. The downstream boundary wall of the pre-coating chamber is formed from the upstream boundary wall 59 of the coating device 10. A downstream wall 73 is spaced from web 53 by a distance of from about 1 to about 5 mm to provide an overflow baffle for coating material to prevent entrance of air in the manner used by prior art short-dwell coaters. The continuous interior wall 75 is used to define an entrance plenum 77, the pre-coating chamber 71 and an exit plenum 79 in the same fashion and with the same parameters as previously described for the coating device.

The embodiment of the present invention utilizing a floating applicator wall and analysis thereof is set forth in detail in the discussion that follows.

The basic geometrical configuration a blade coating apparatus is shown in FIGS. 5A–5D. The apparatus illustrated has stationary walls with the exception of the substrate which moves with a given speed. The coating fluid is pumped into a channel that leads the fluid flow to the moving web. The fluid flow considered is a steady, viscous free surface flow that is governed by the equations of momentum and mass conservation. Near the web the liquid accelerates through viscous drag while near the stationary wall it decelerates with a commensurate amount.

Figure 5B:
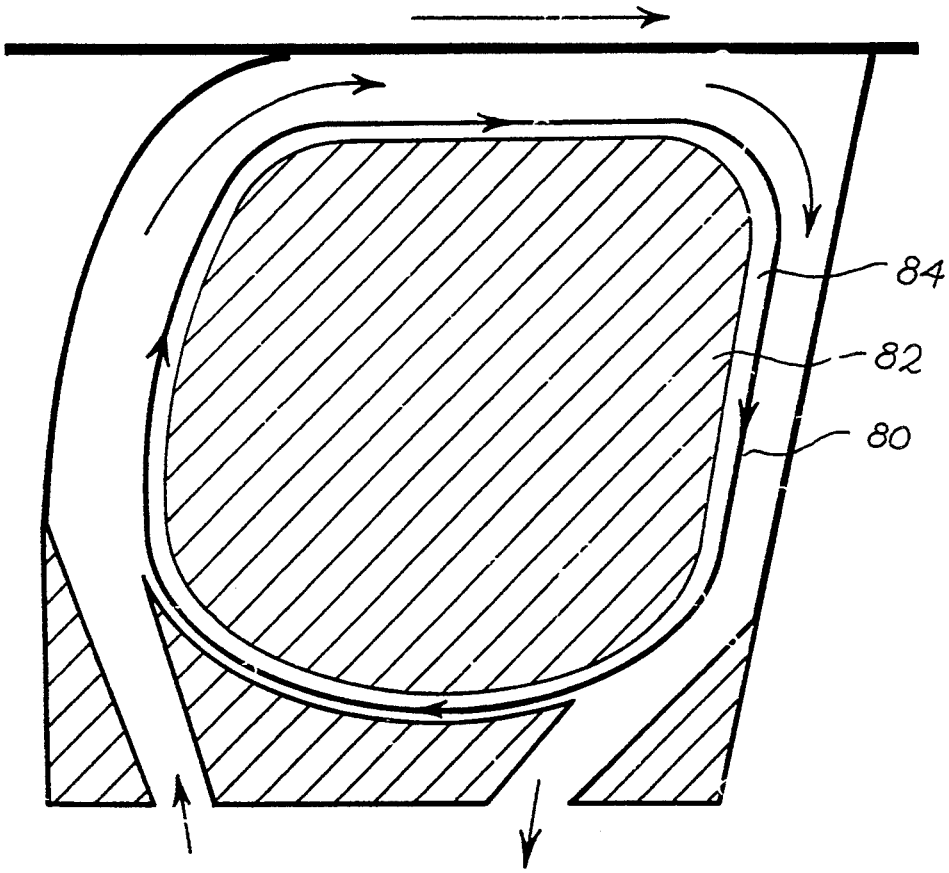
Figure 5C:
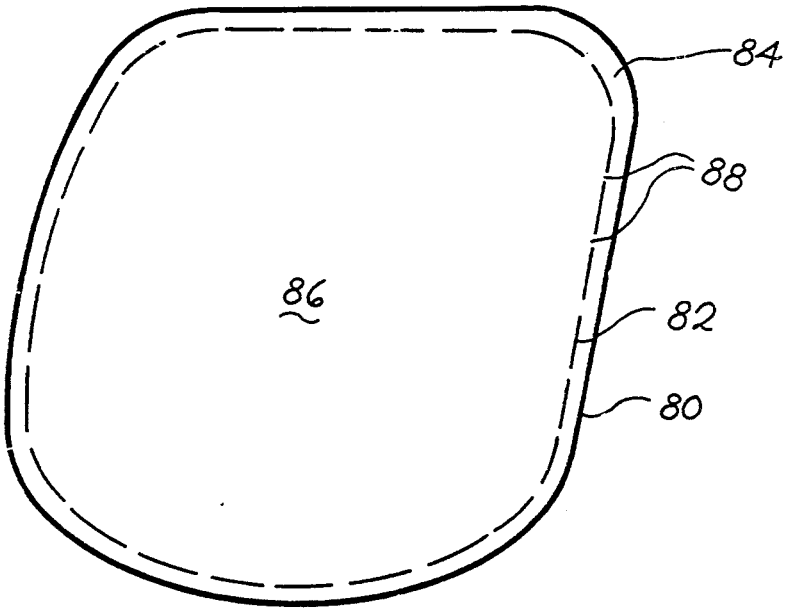
Figure 6A:
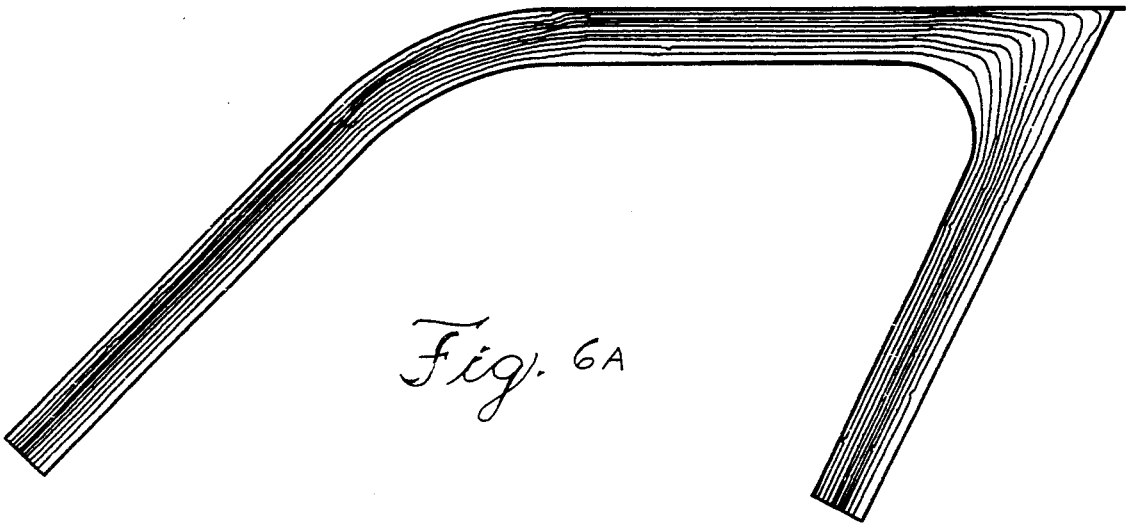
Figure 6B:
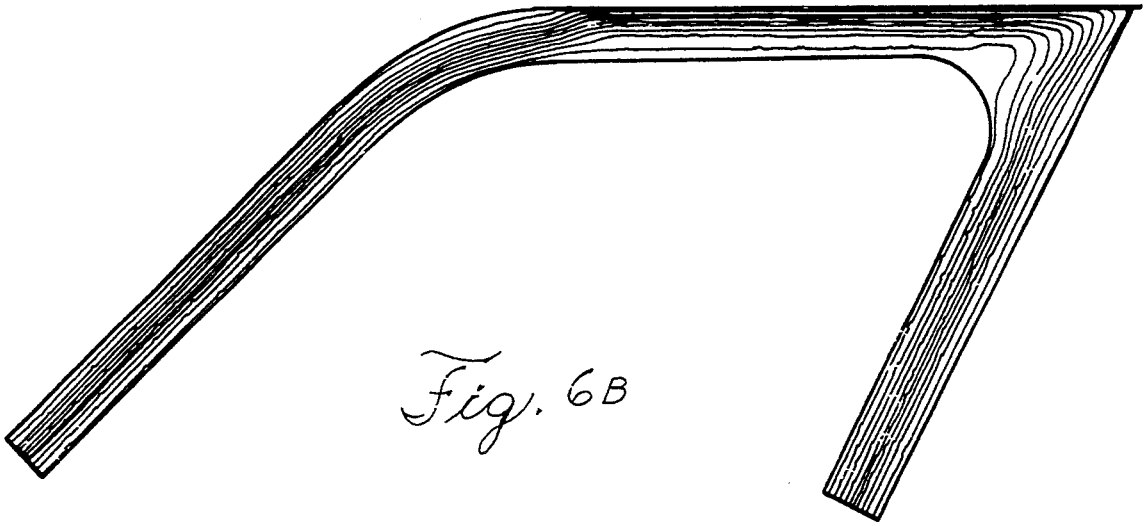
Figure 6C:
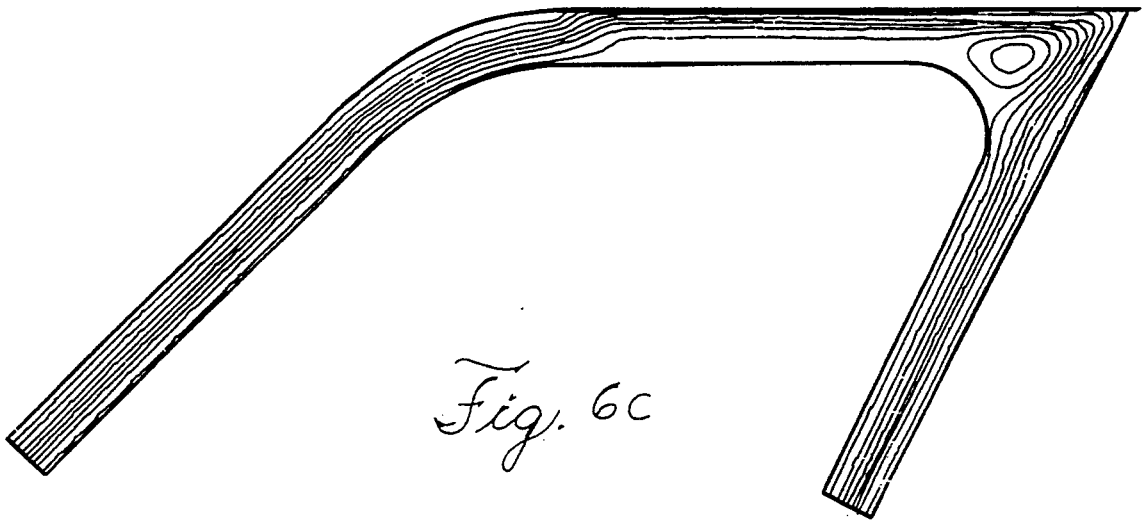
Figure 6D:
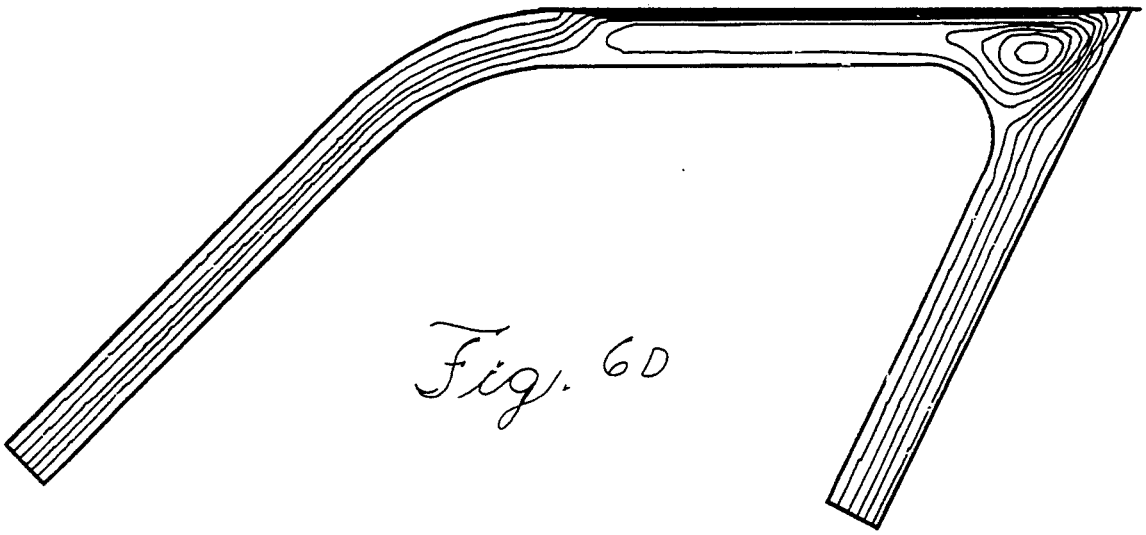
Figure 6E:
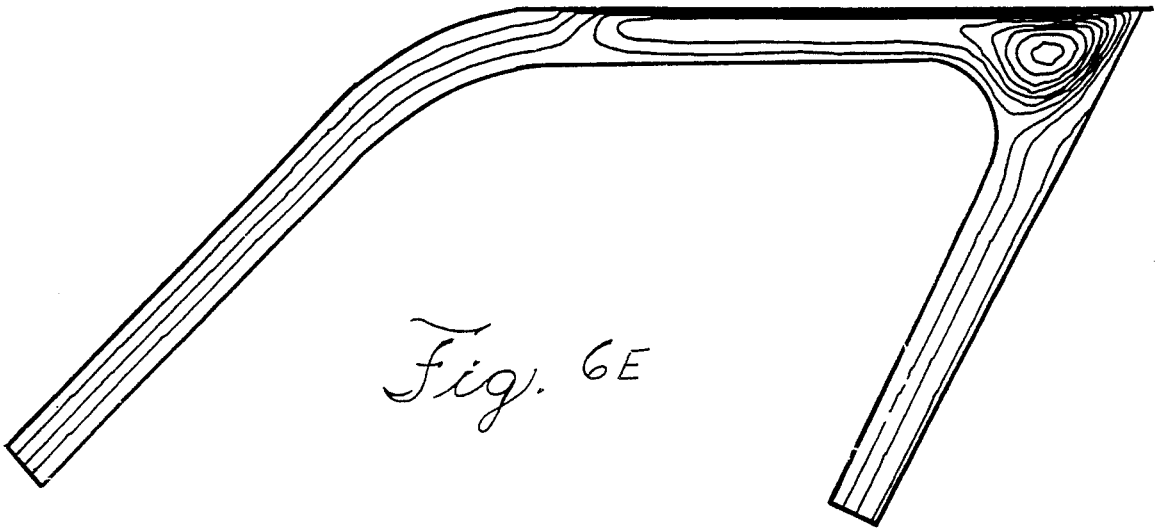
Figure 6F:
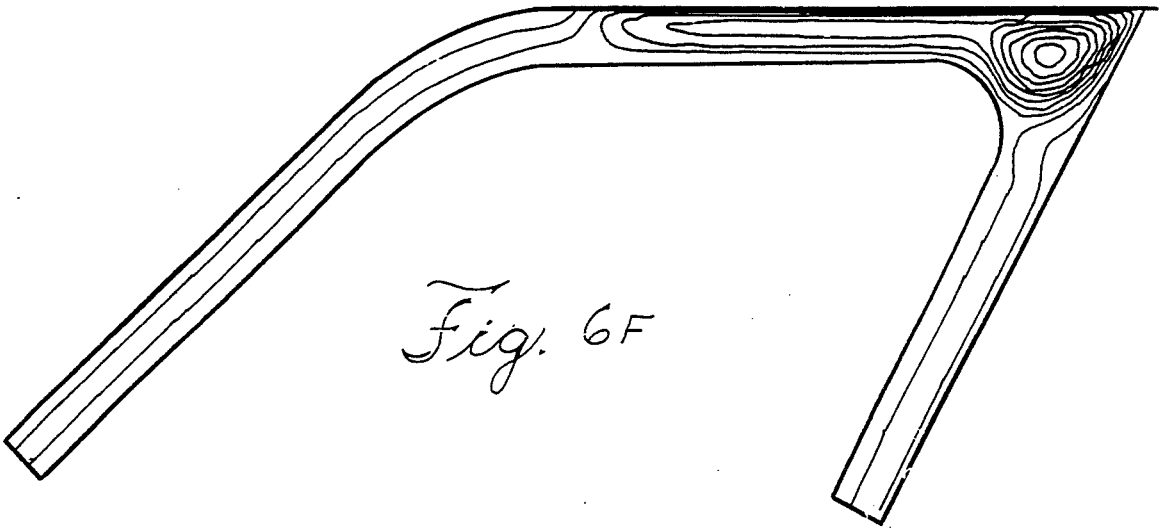
Figure 7B:
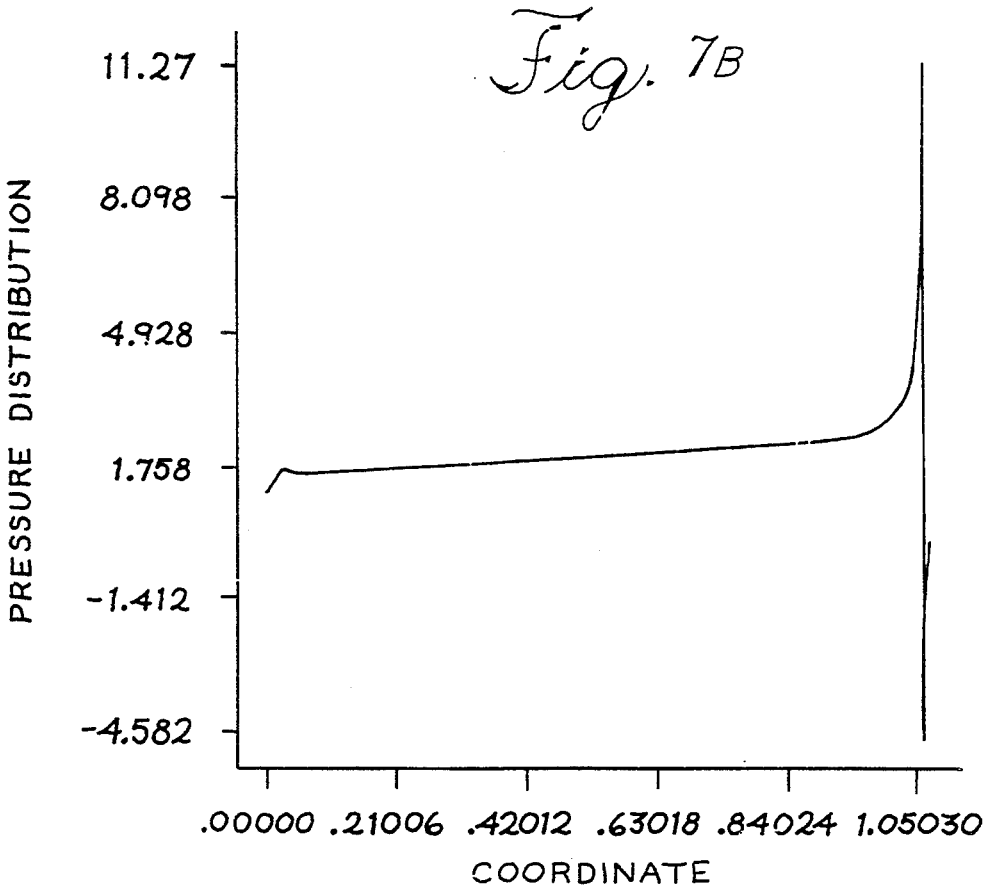
Figure 7C:
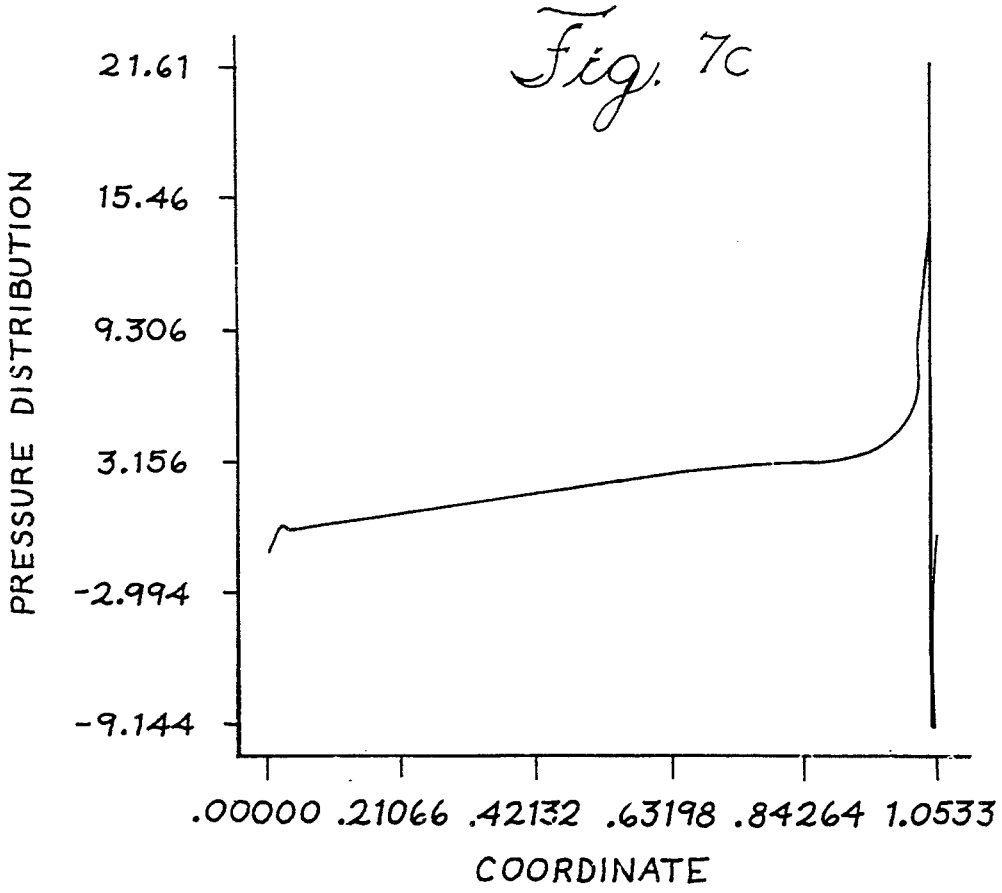
Figure 7D:
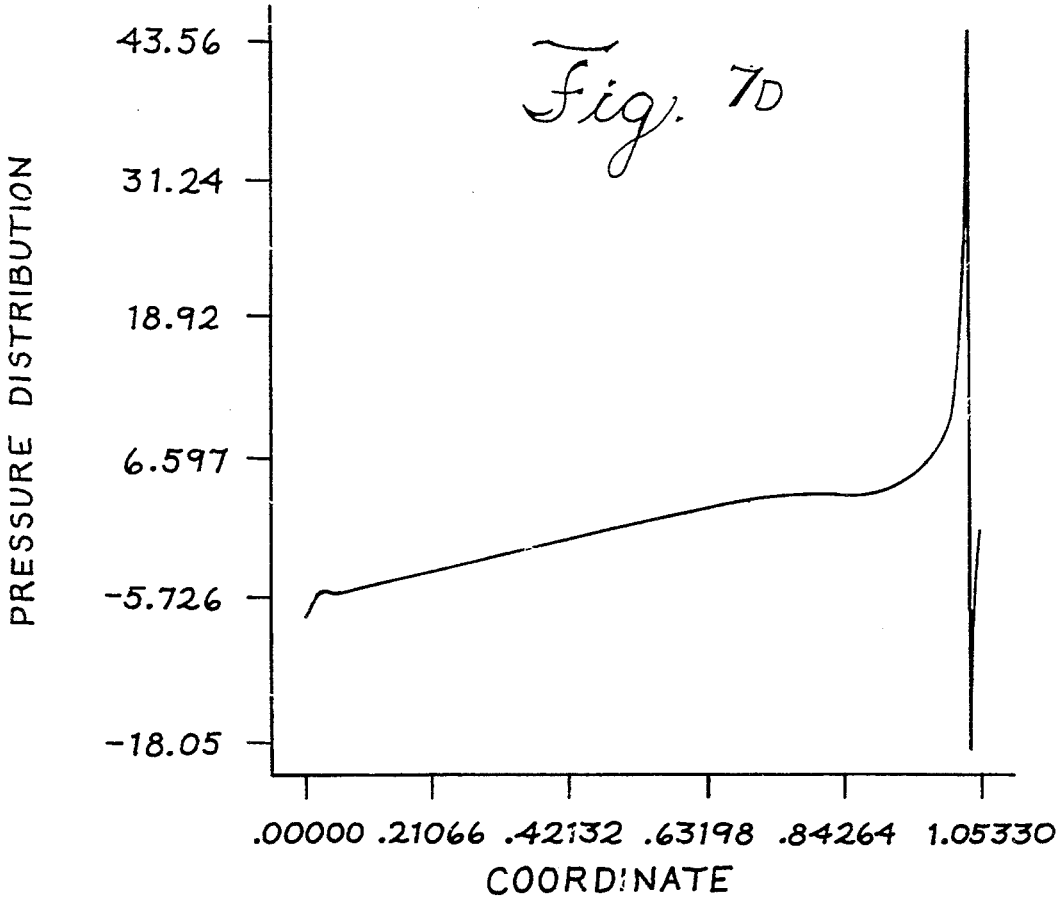
Figure 7E:
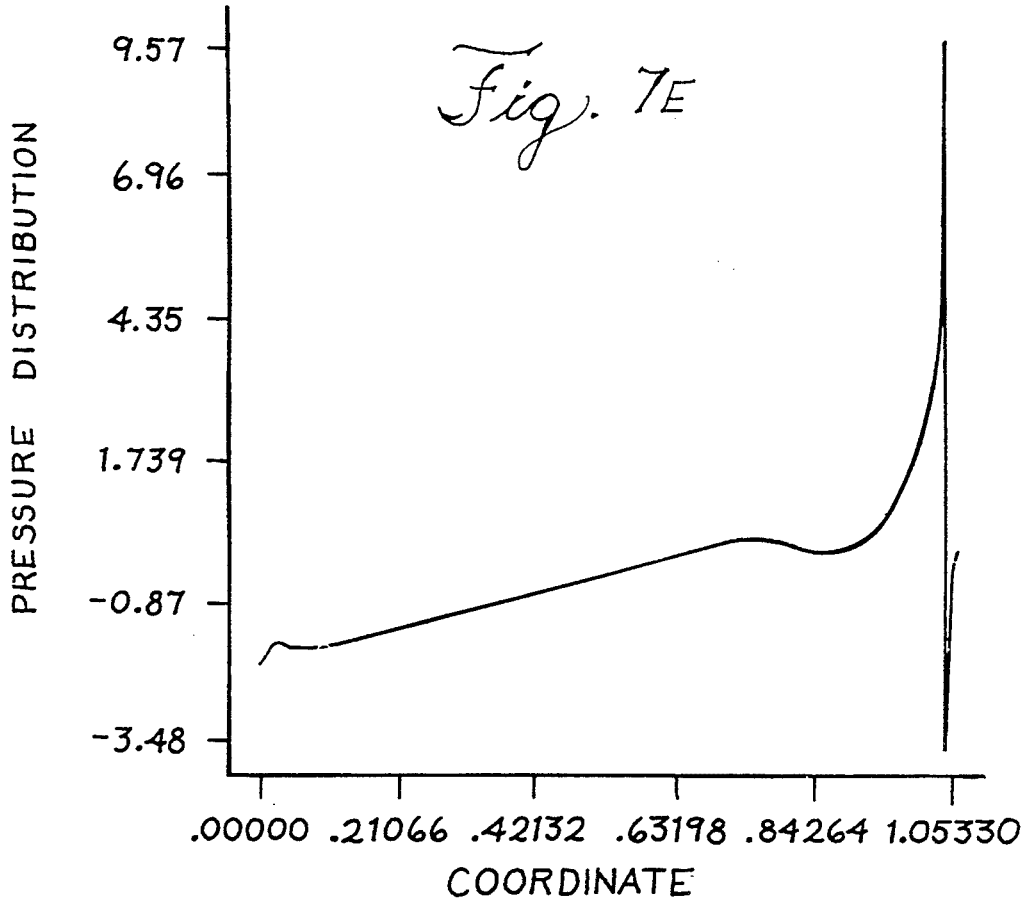
Figure 7F:
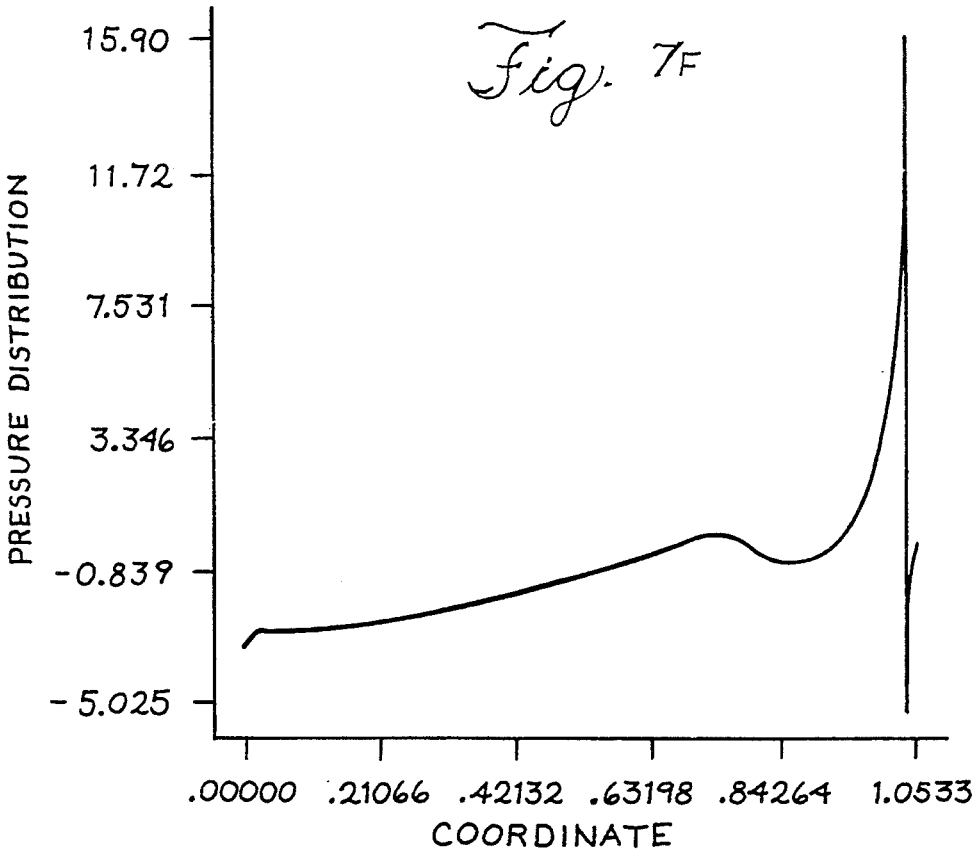
Figure 7G:
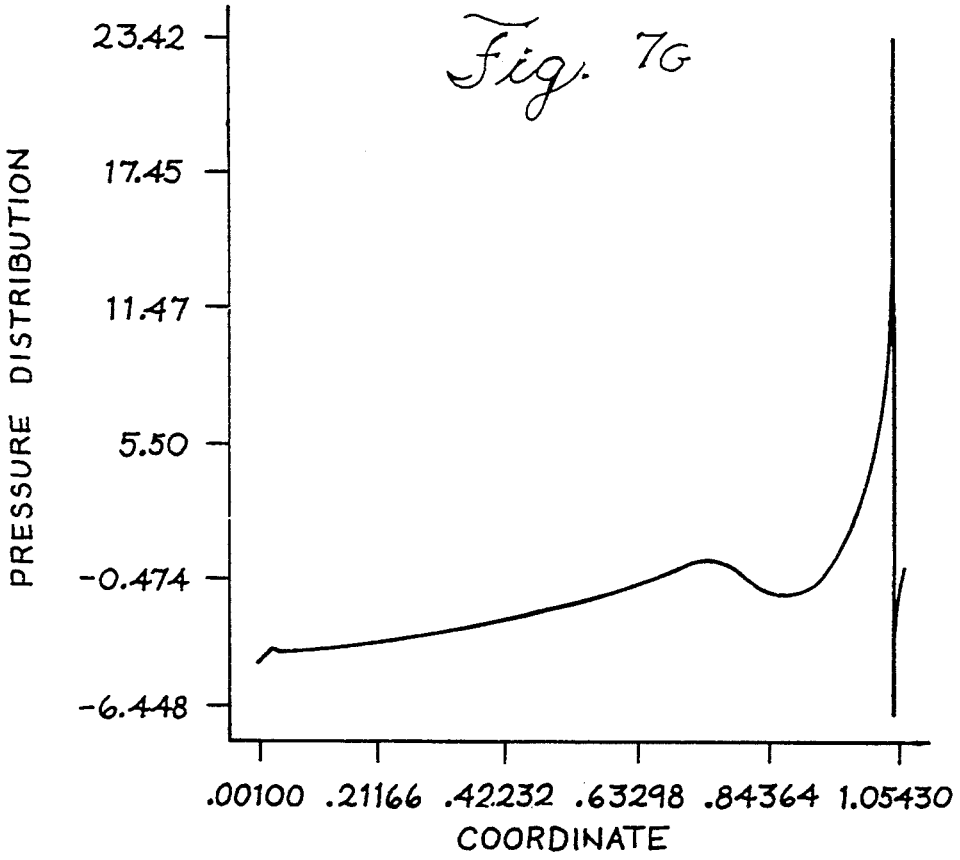
Figure 8A:
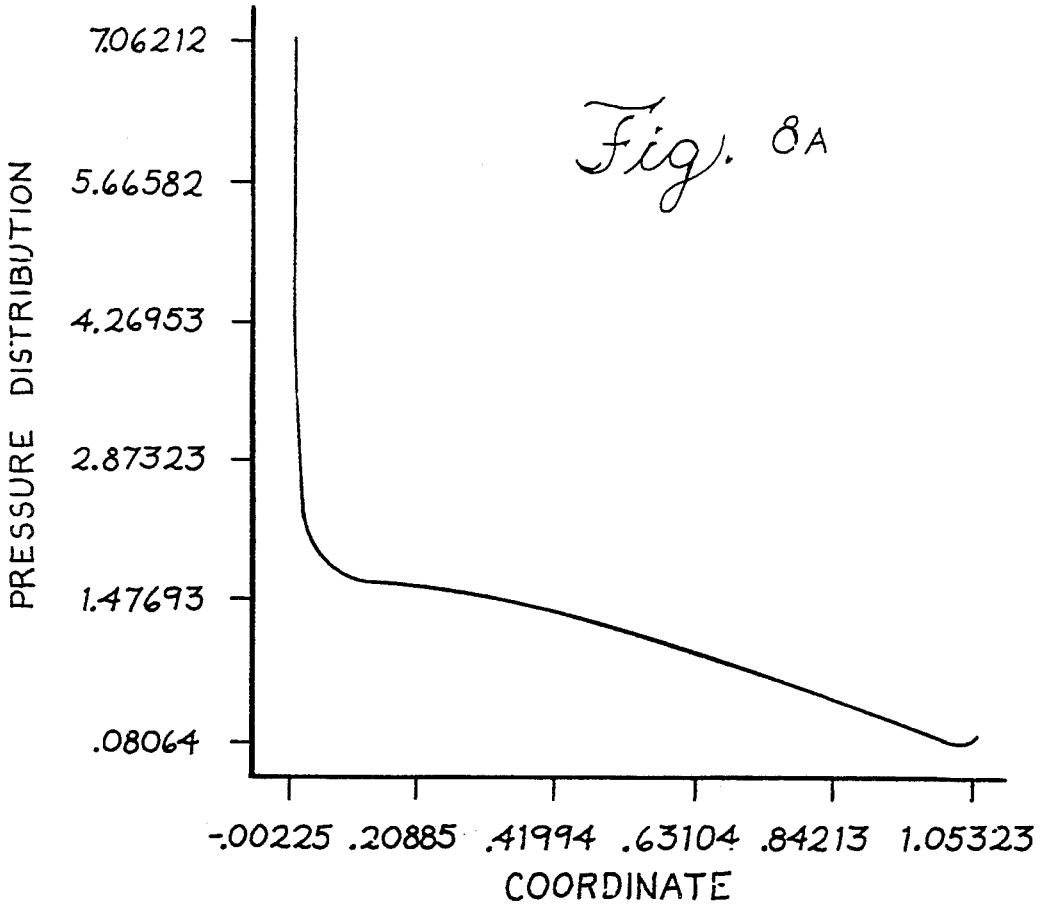
FIGS. 8A–8G illustrate pressure distribution along the blade for cases B1 to B7 of Table 2.
Figure 8B:
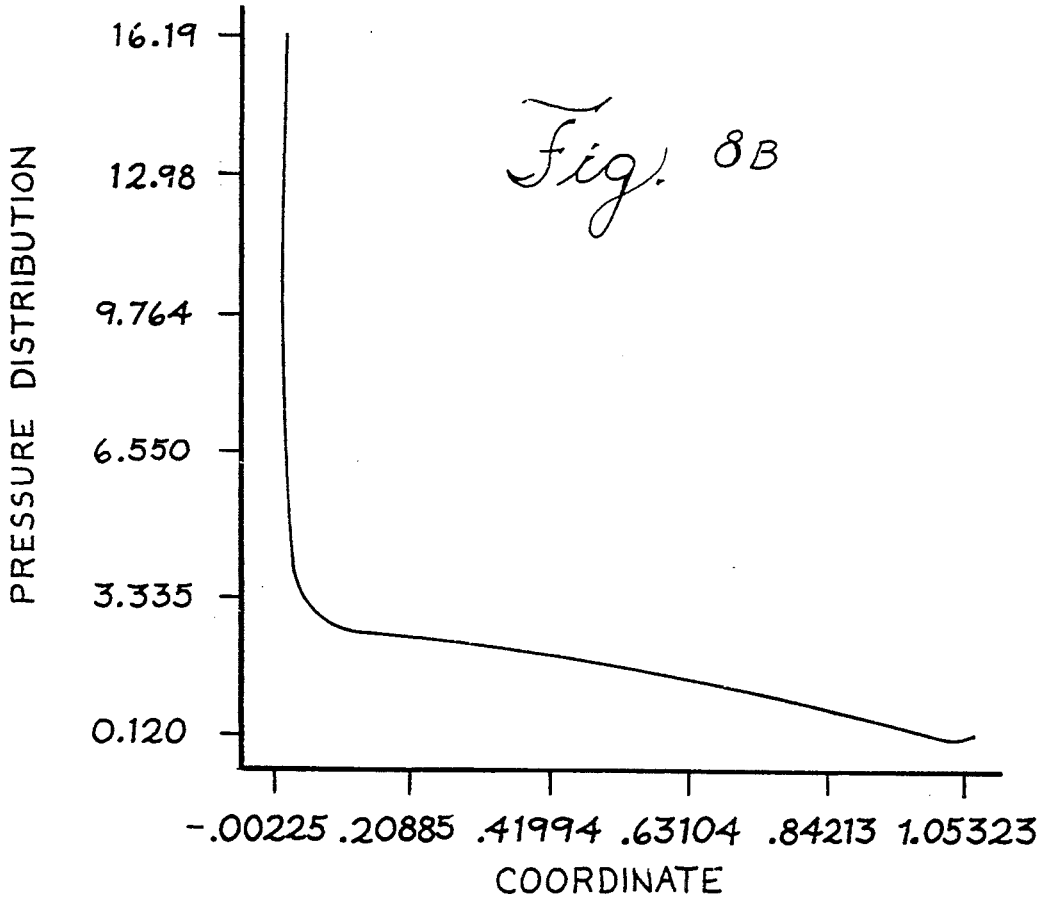
Figure 8C:
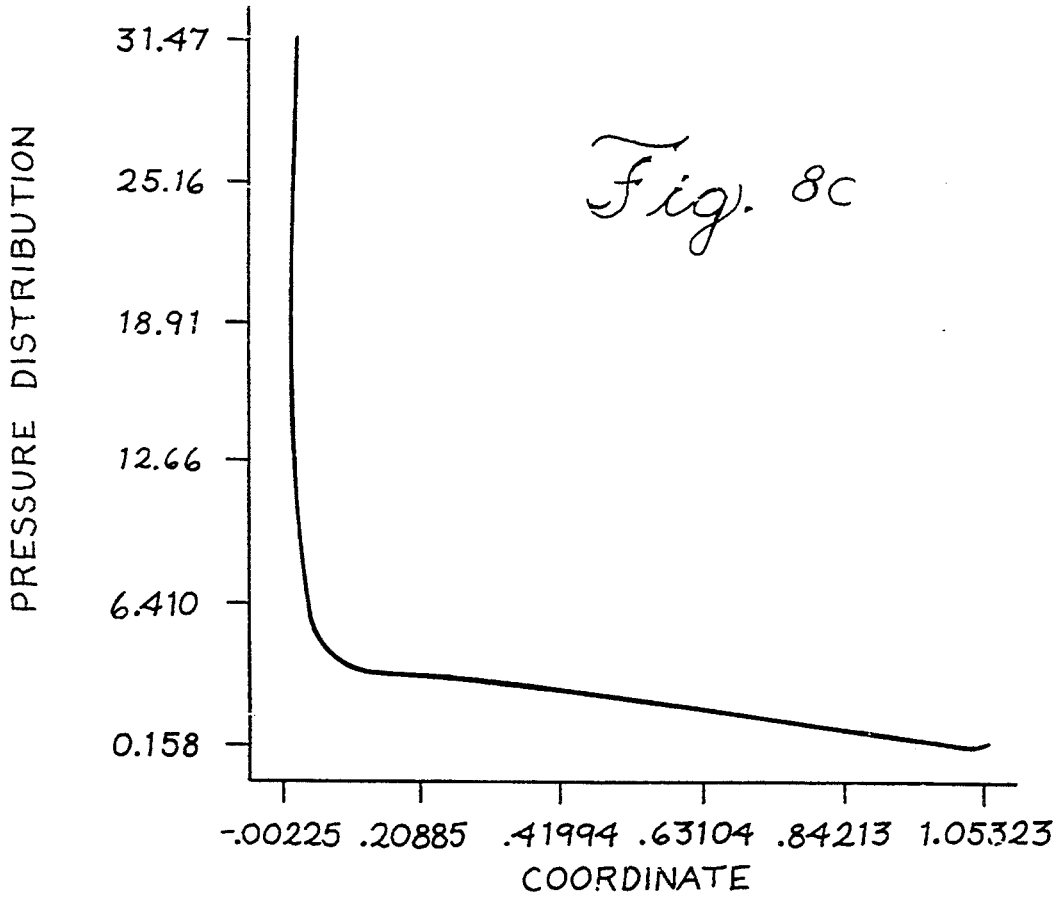
Figure 8D:
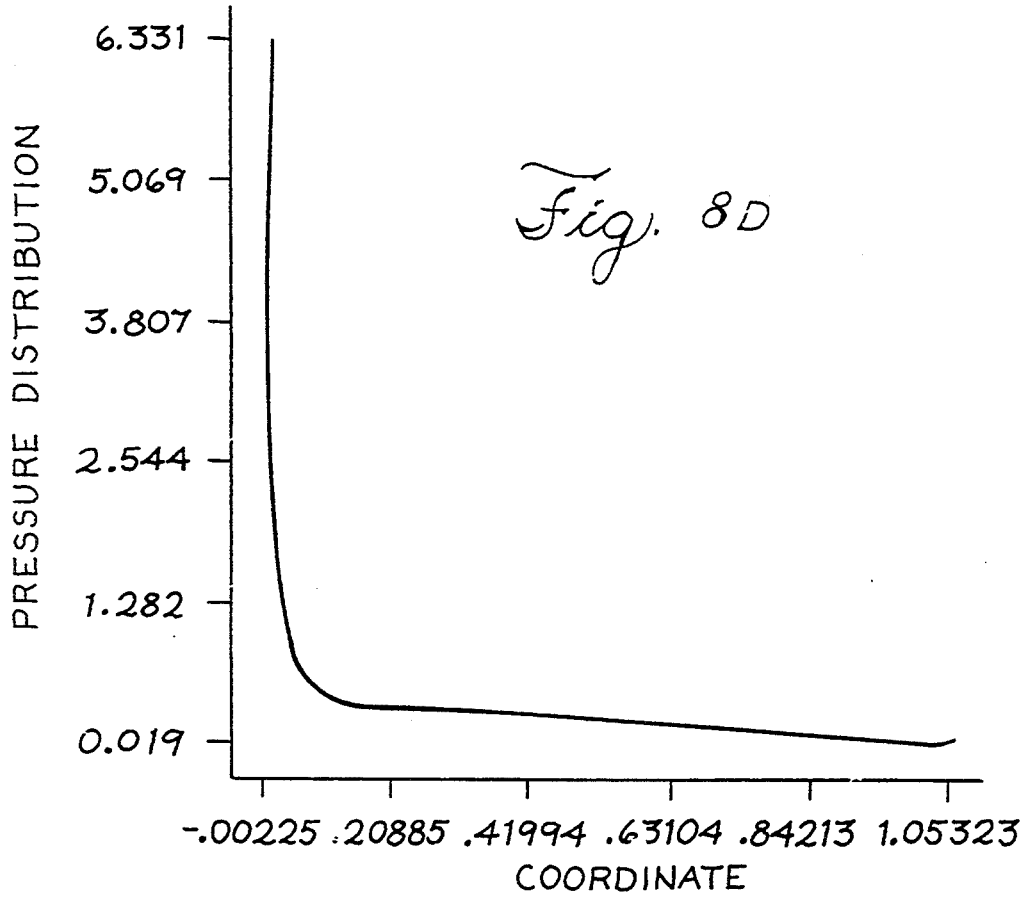
Figure 8E:
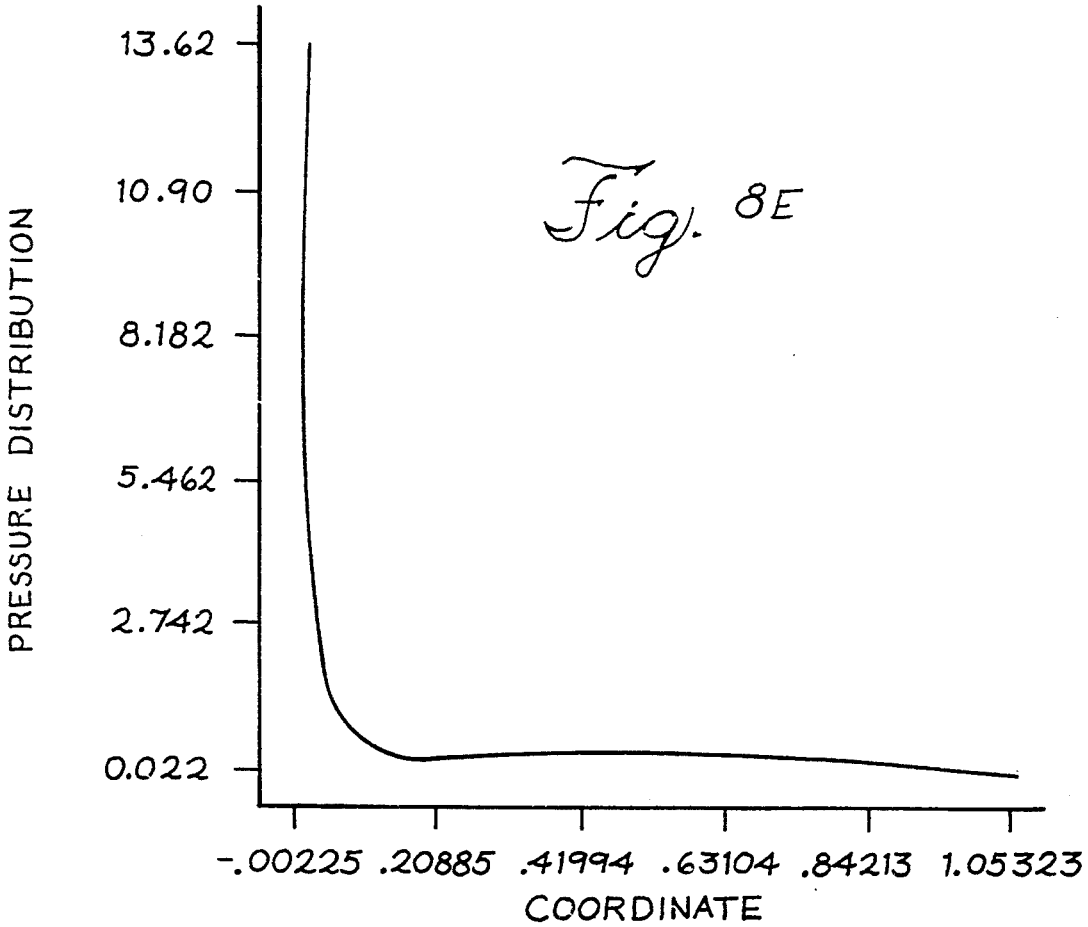
Figure 8F:
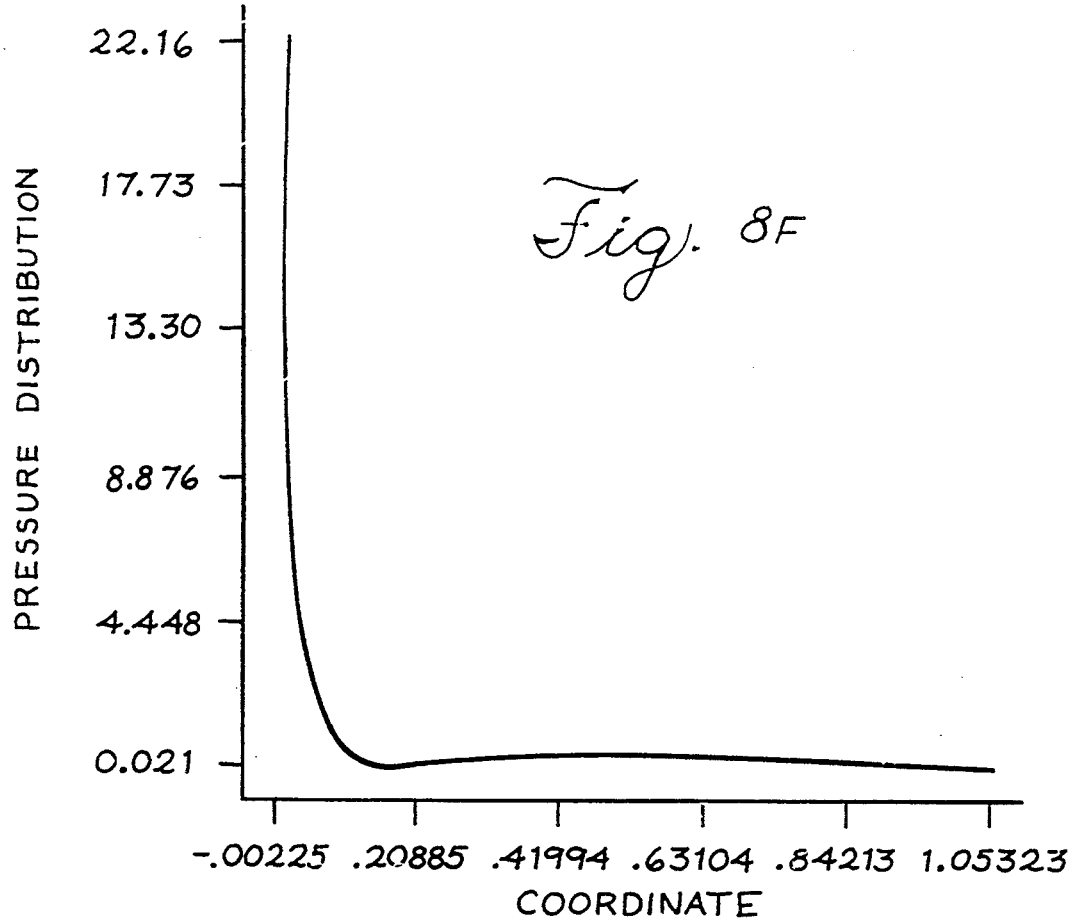
Figure 8G:
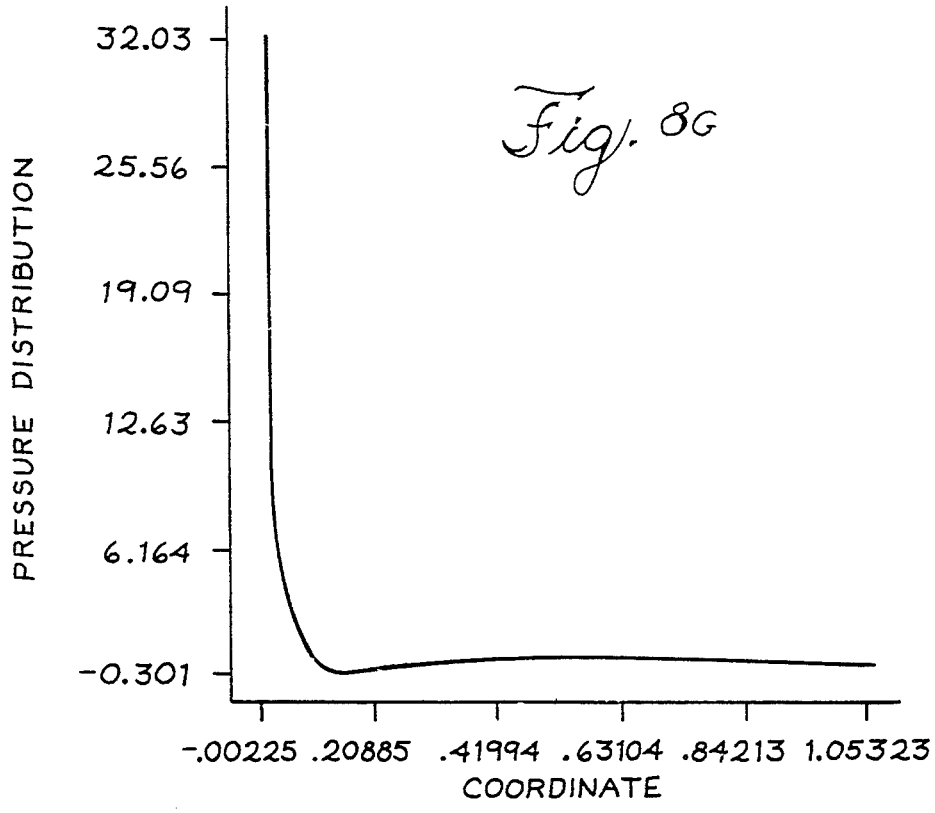
Figure 9A:
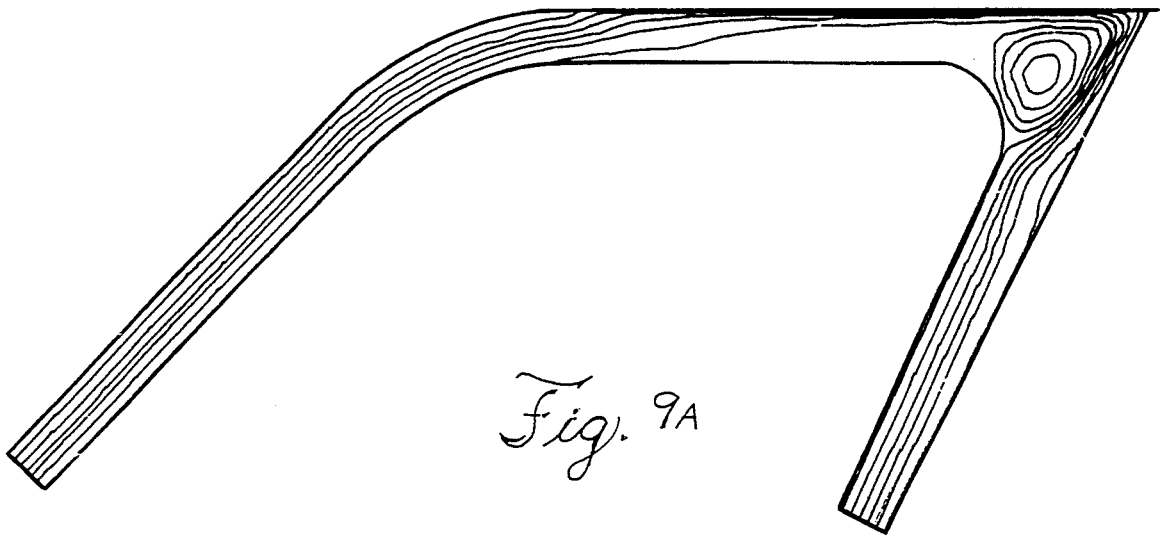
FIGS. 9A–9E illustrate flow characteristics for cases C11 to C15 of Table 3.
Figure 9B:
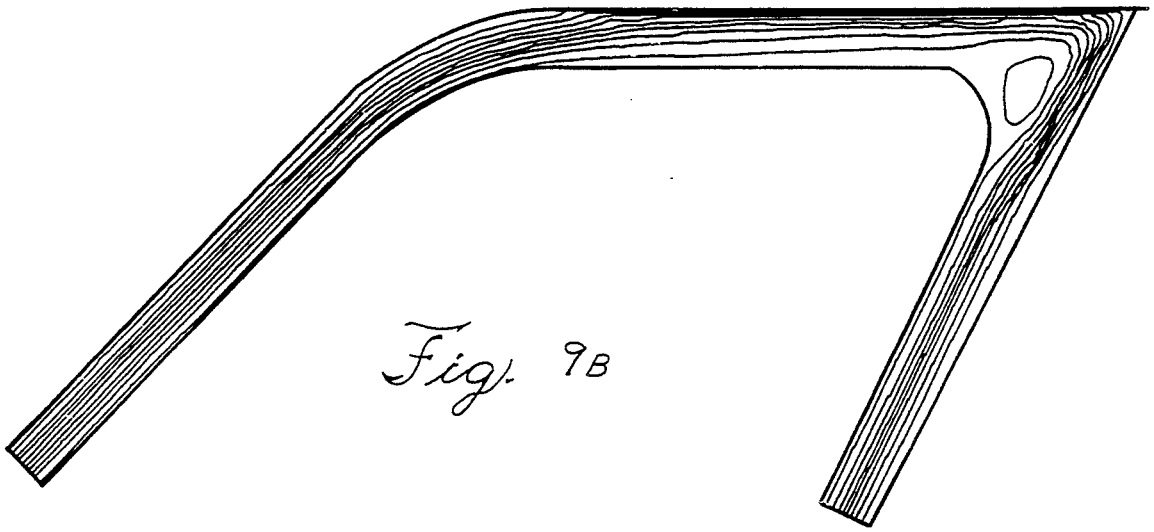
Figure 9C:
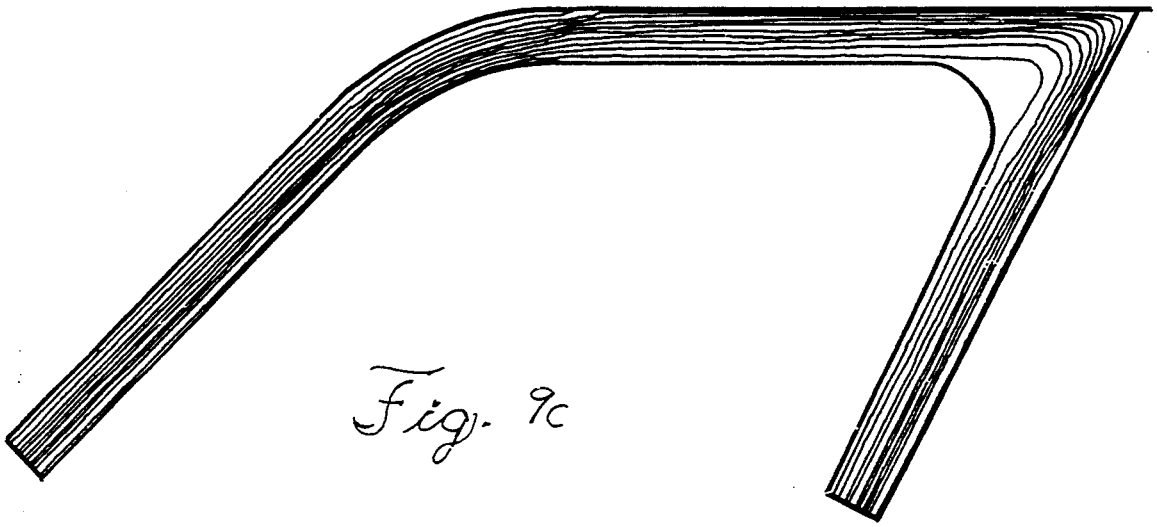
Figure 9D:
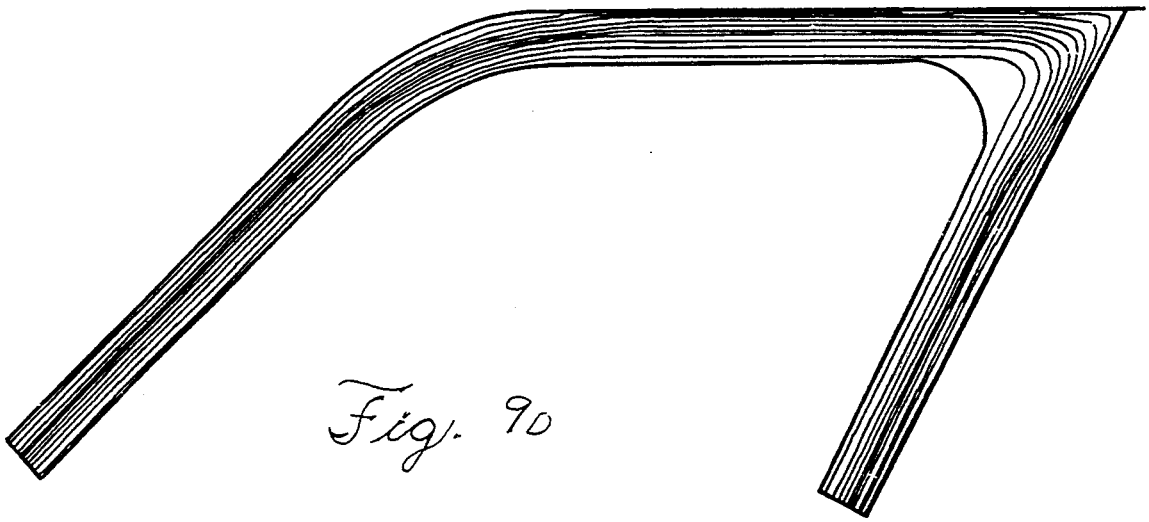
Figure 9E:
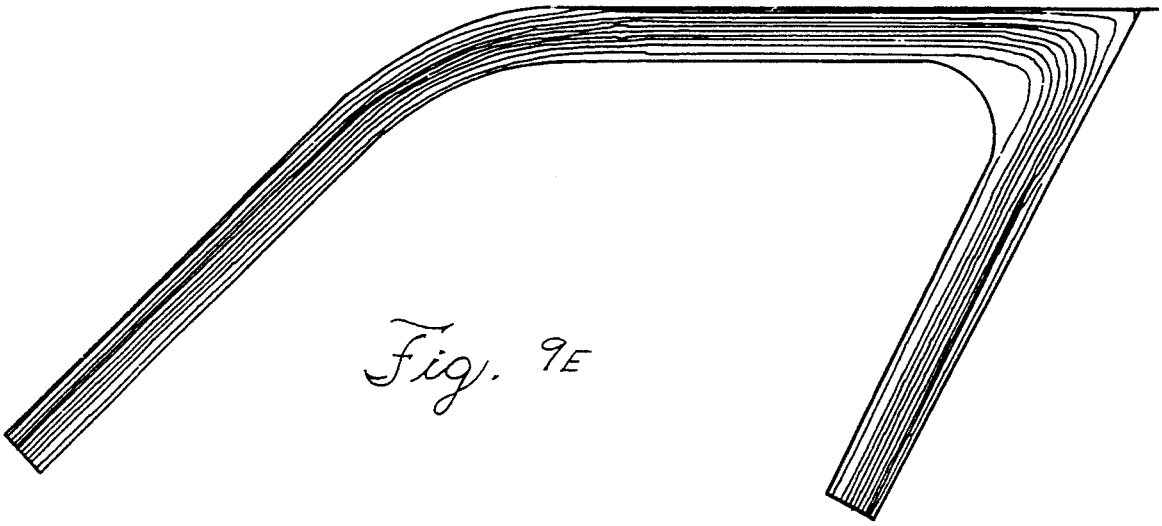
Figure 10A:
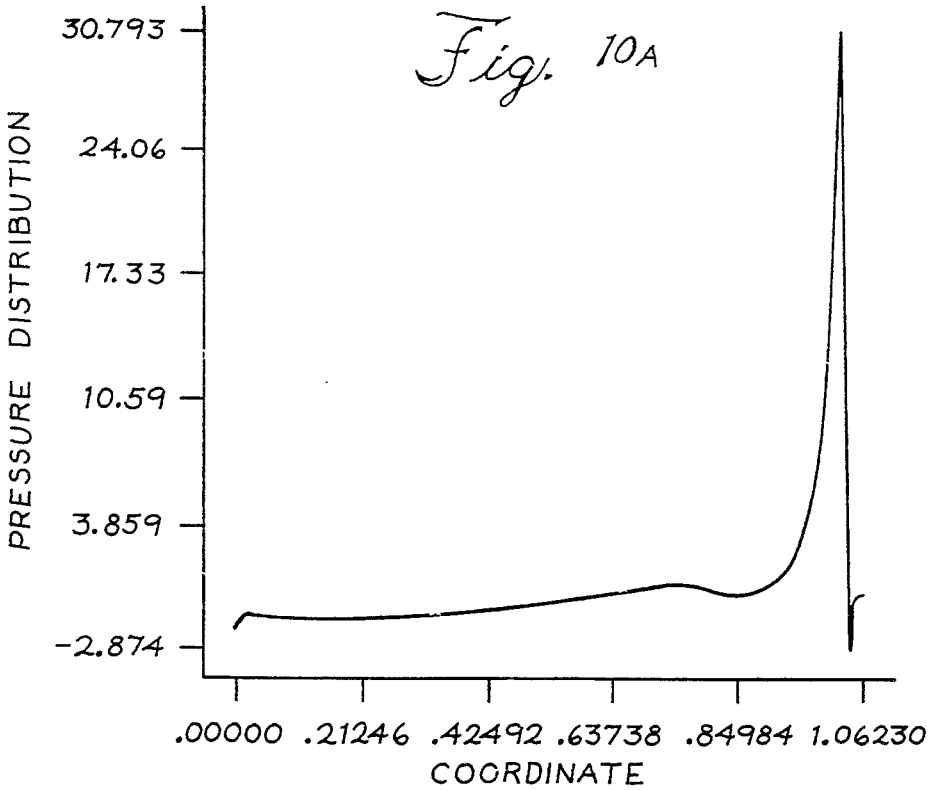
FIGS. 10A–10E illustrate pressure distribution along the substrate for cases C11 to C15 of Table 3.
Figure 10B:
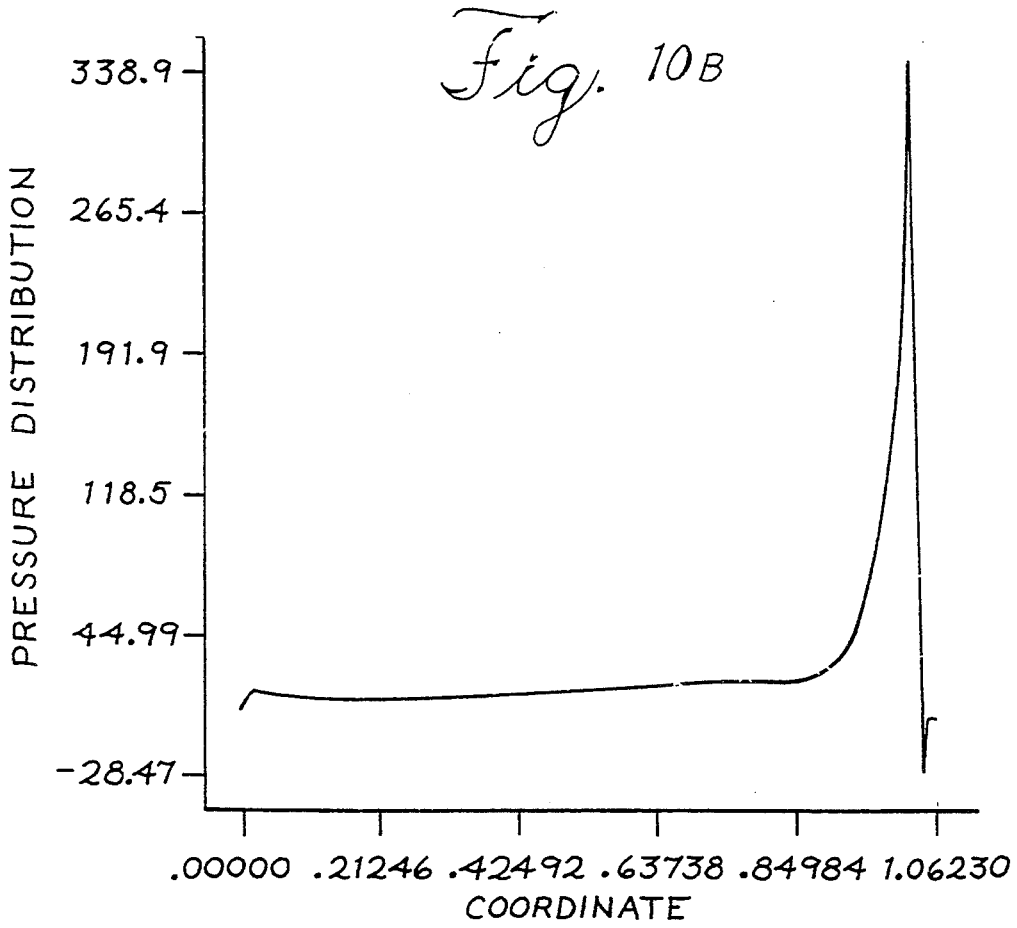
Figure 10C:
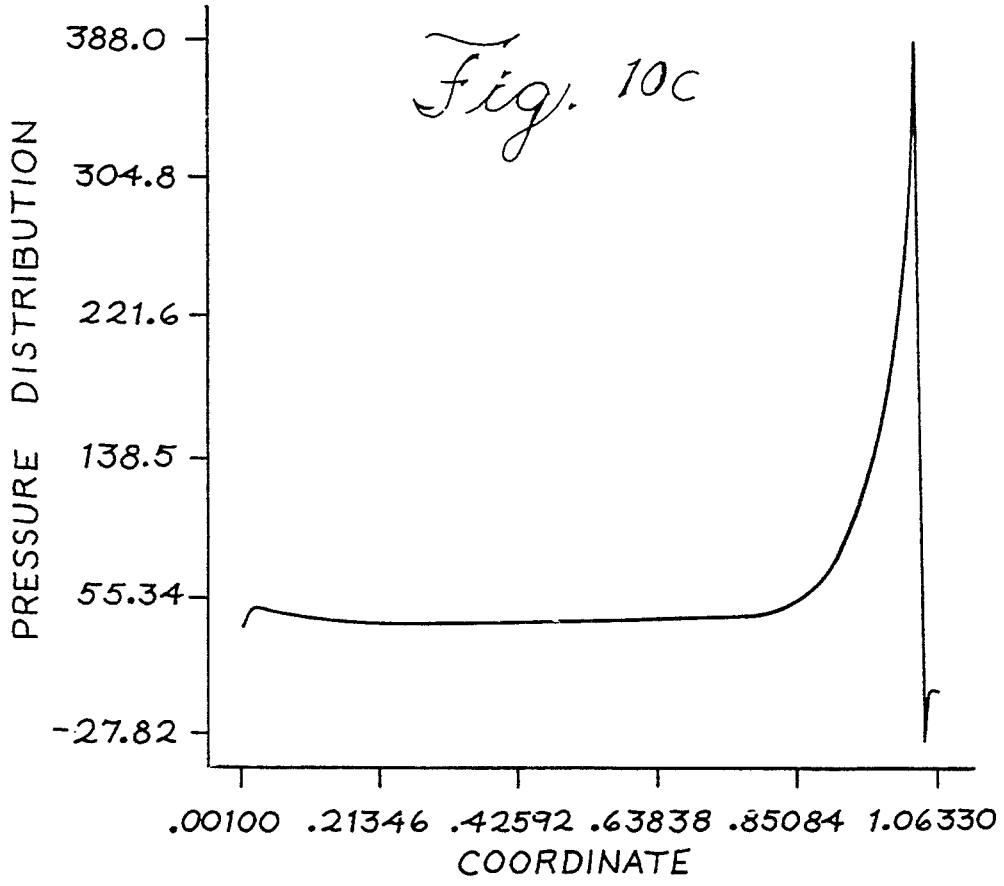
Figure 10D:
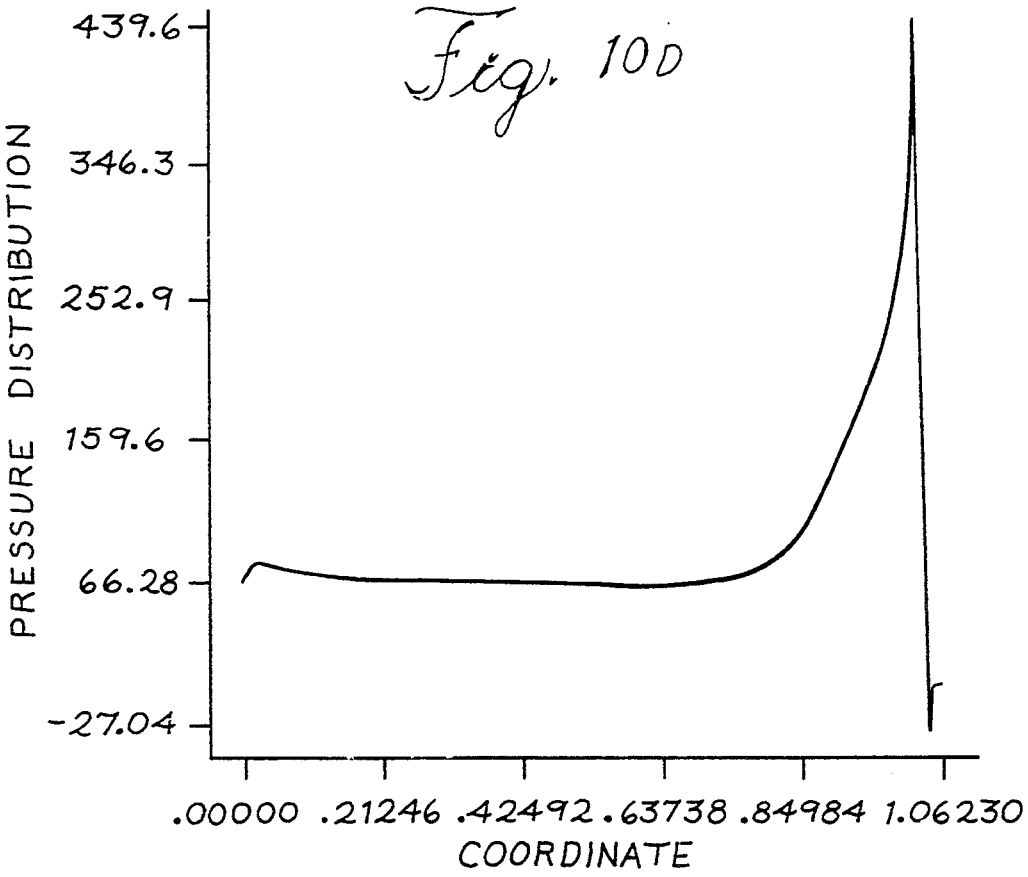
Figure 10E:
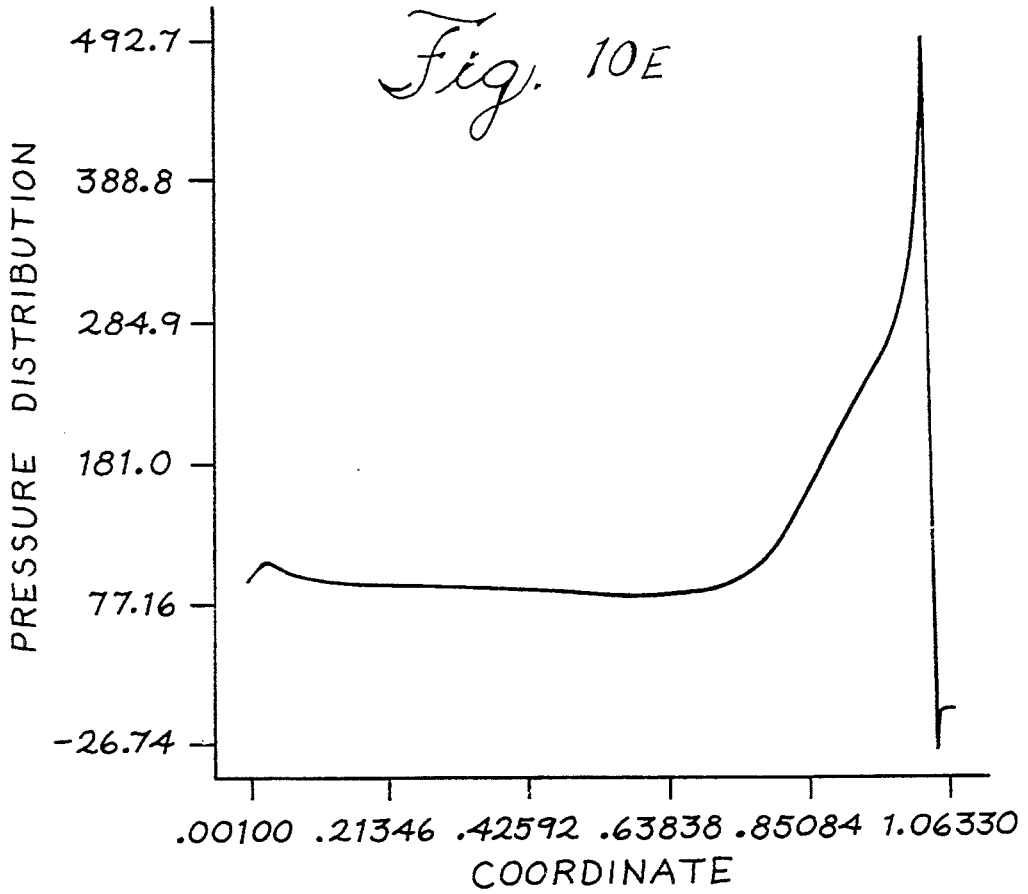
Figure 11A:
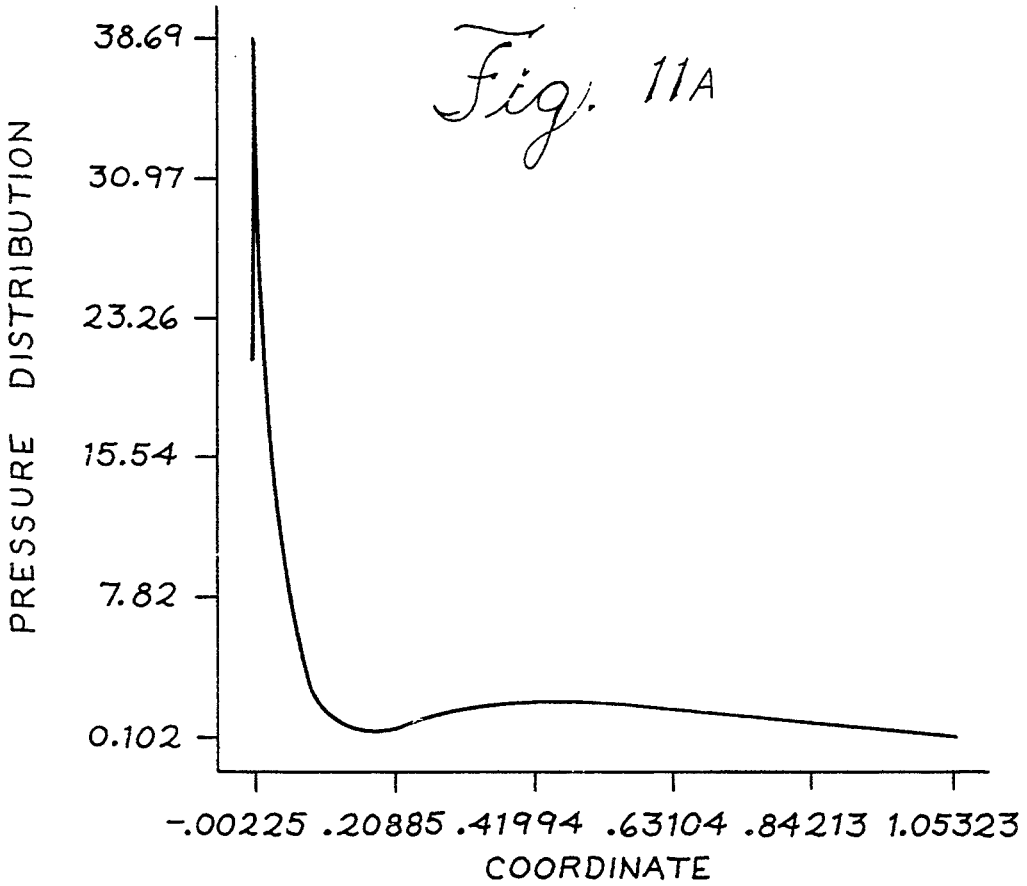
FIGS. 11A–11E illustrate pressure distribution along the blade for cases C11 to C15 of Table 3.
Figure 11B:
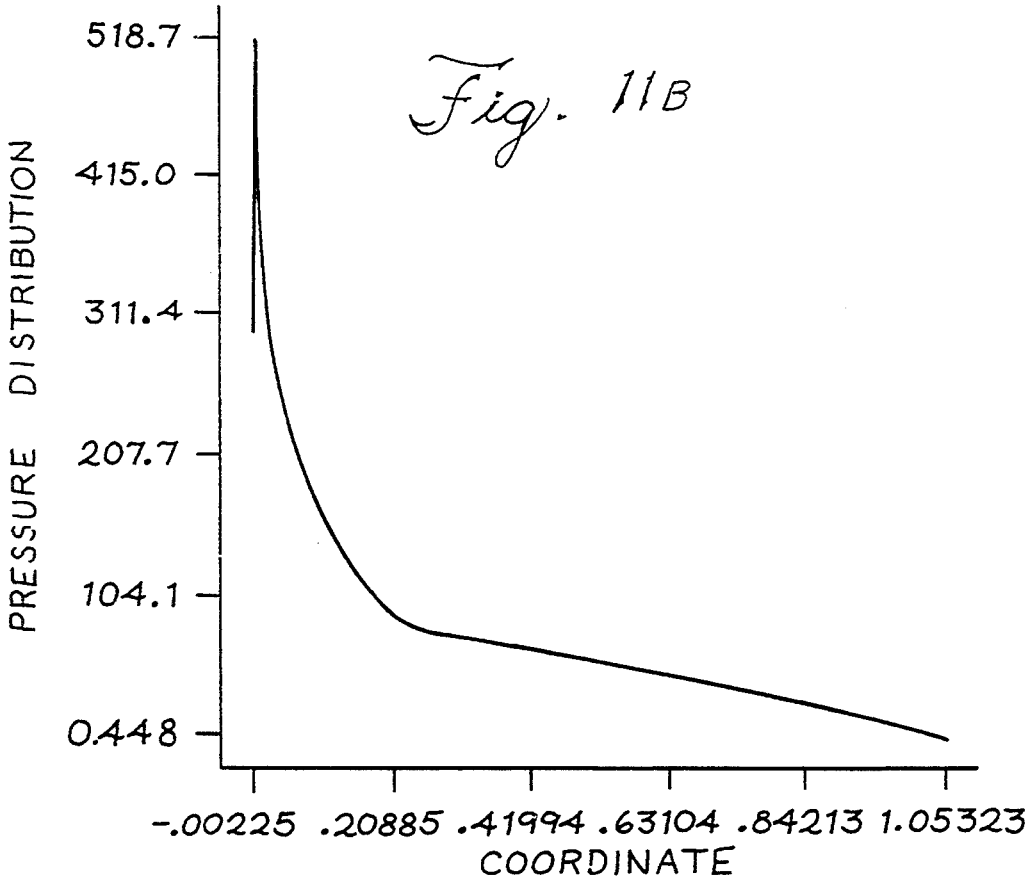
Figure 11C:
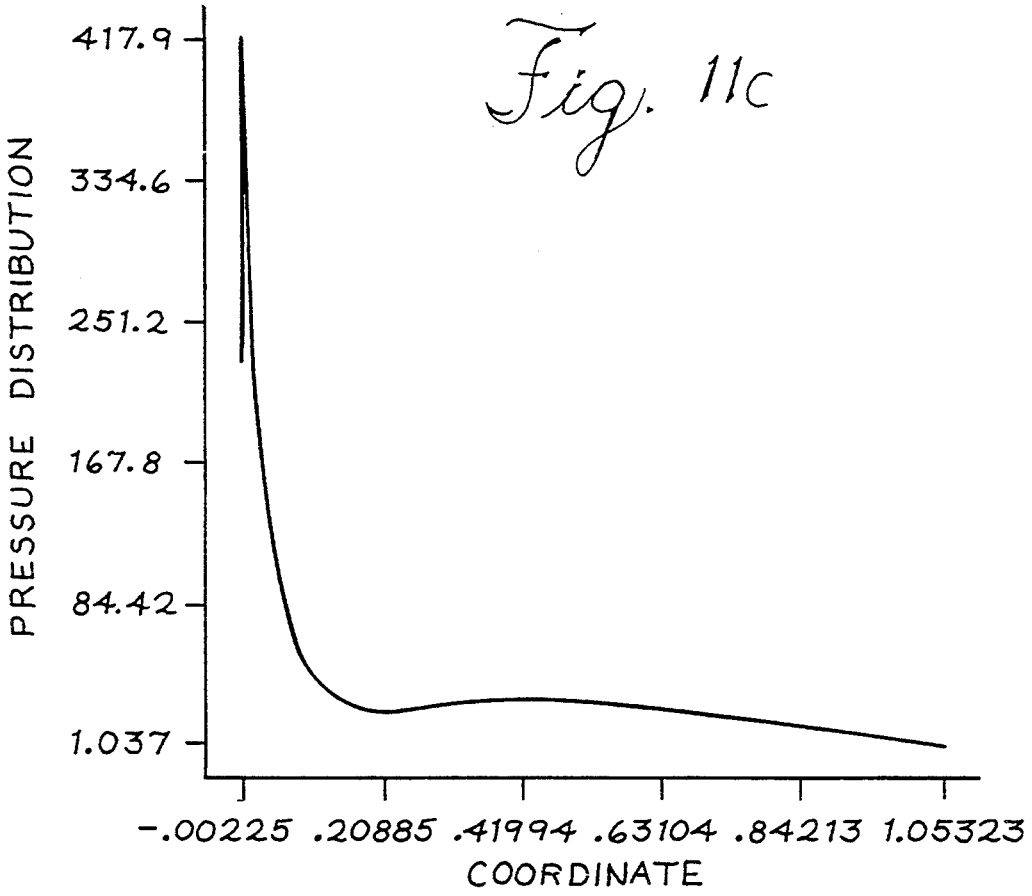
Figure 11D:
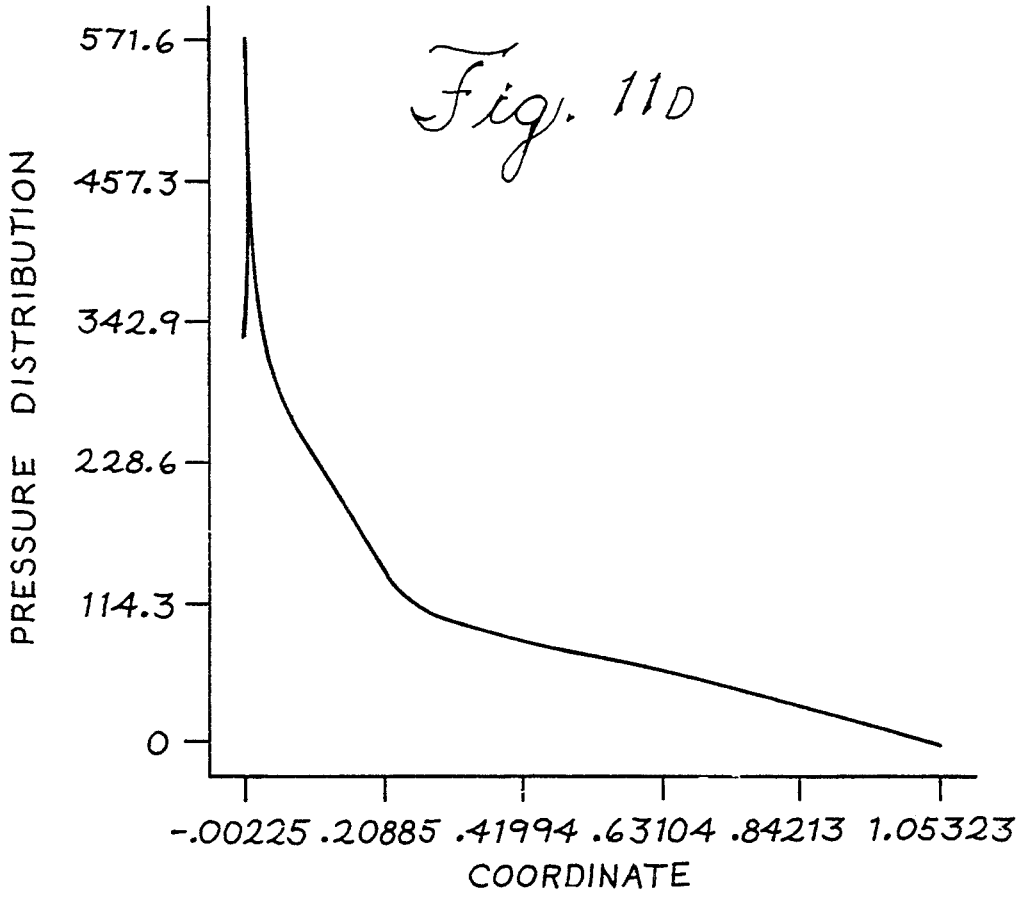
Figure 11E:
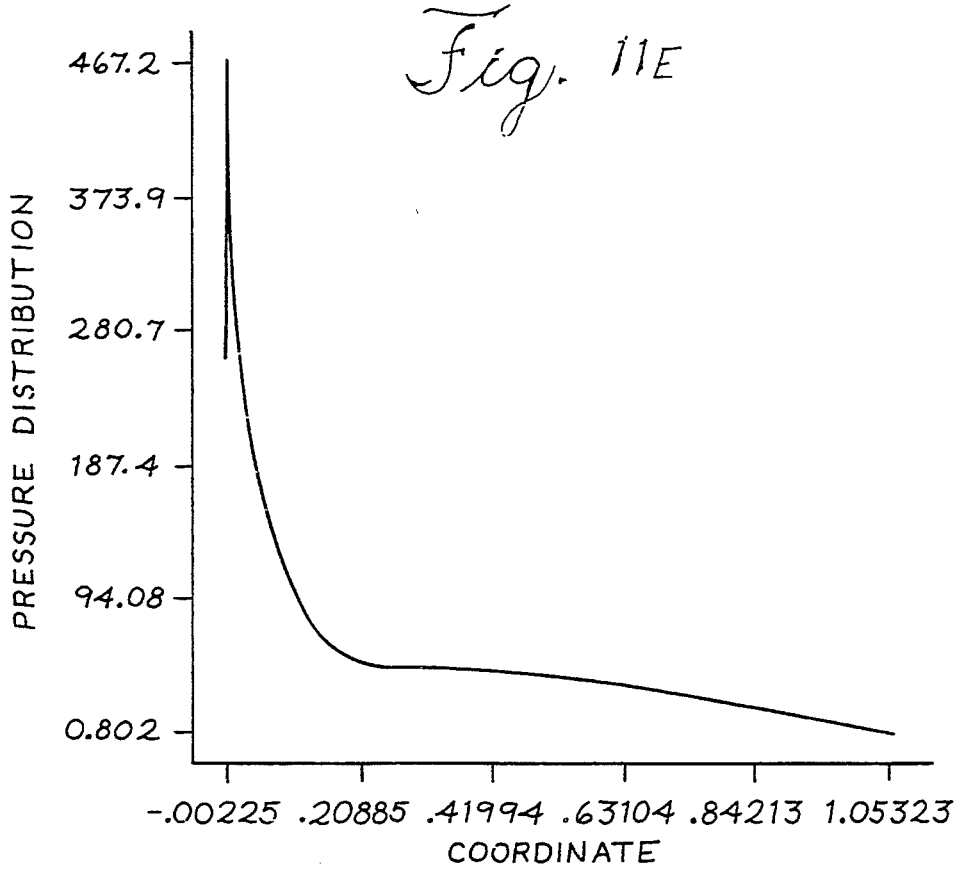
Figure 12A:
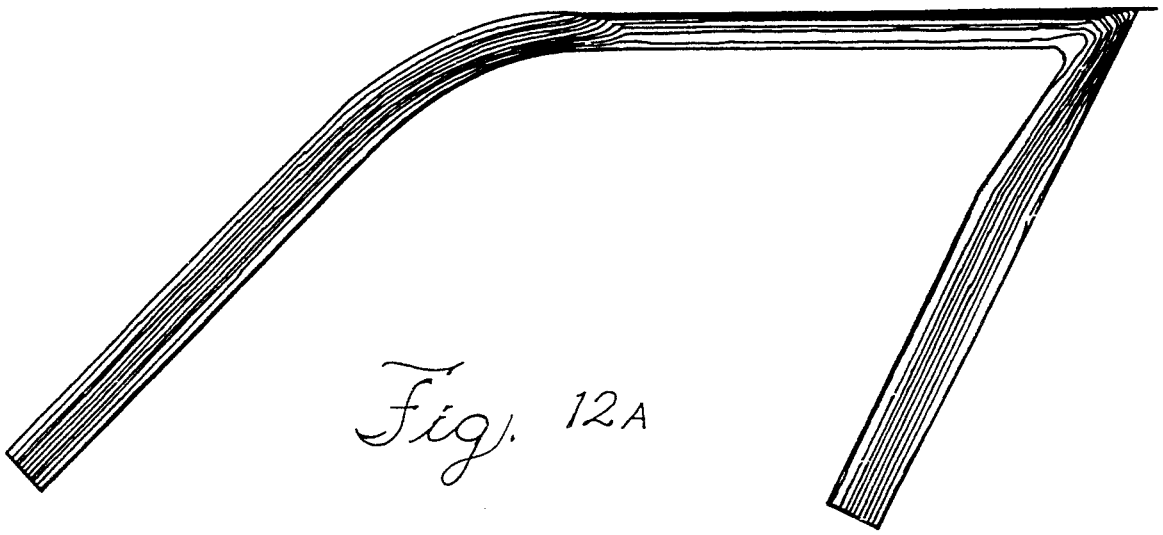
FIGS. 12A–12D illustrate flow characteristics for cases N1 to N4 of Table 4.
Figure 12B:
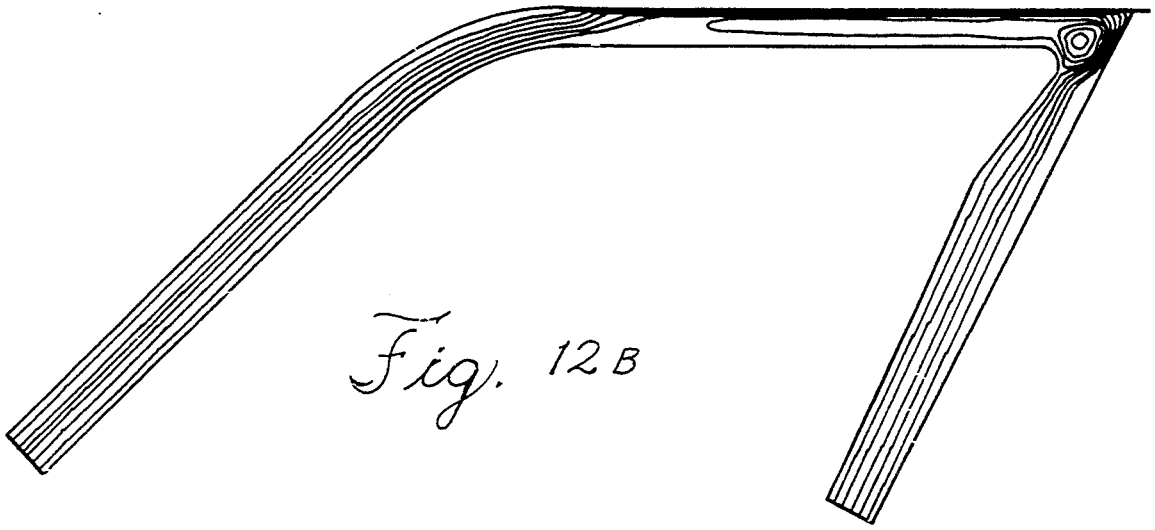
Figure 12C:
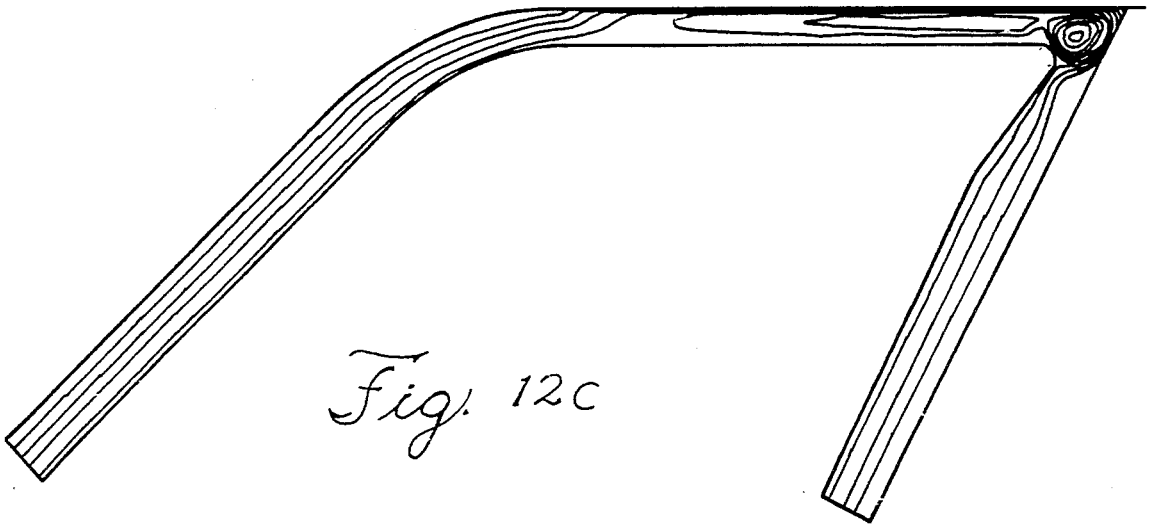
Figure 12D:
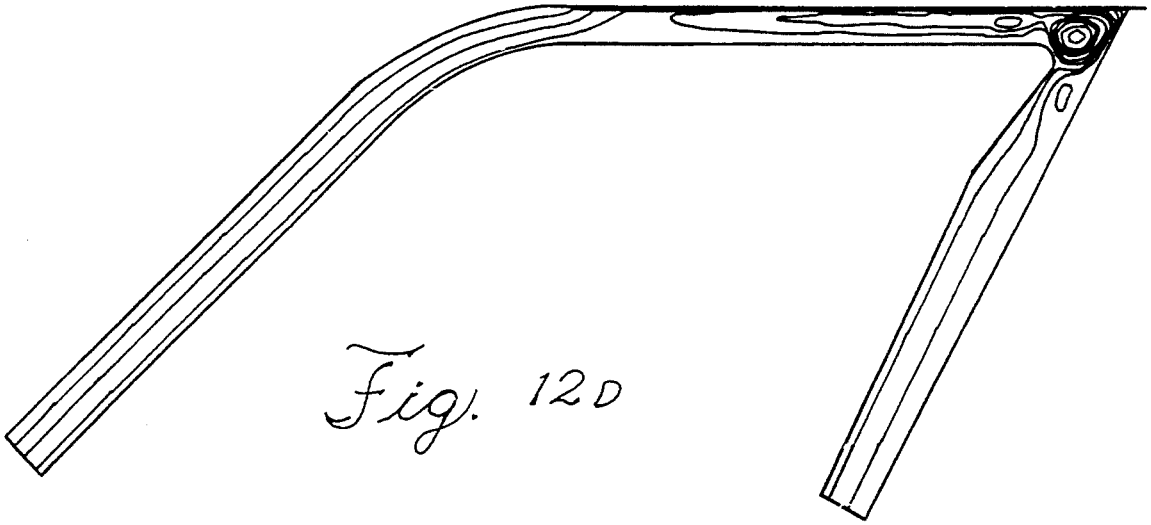
Figure 13A:
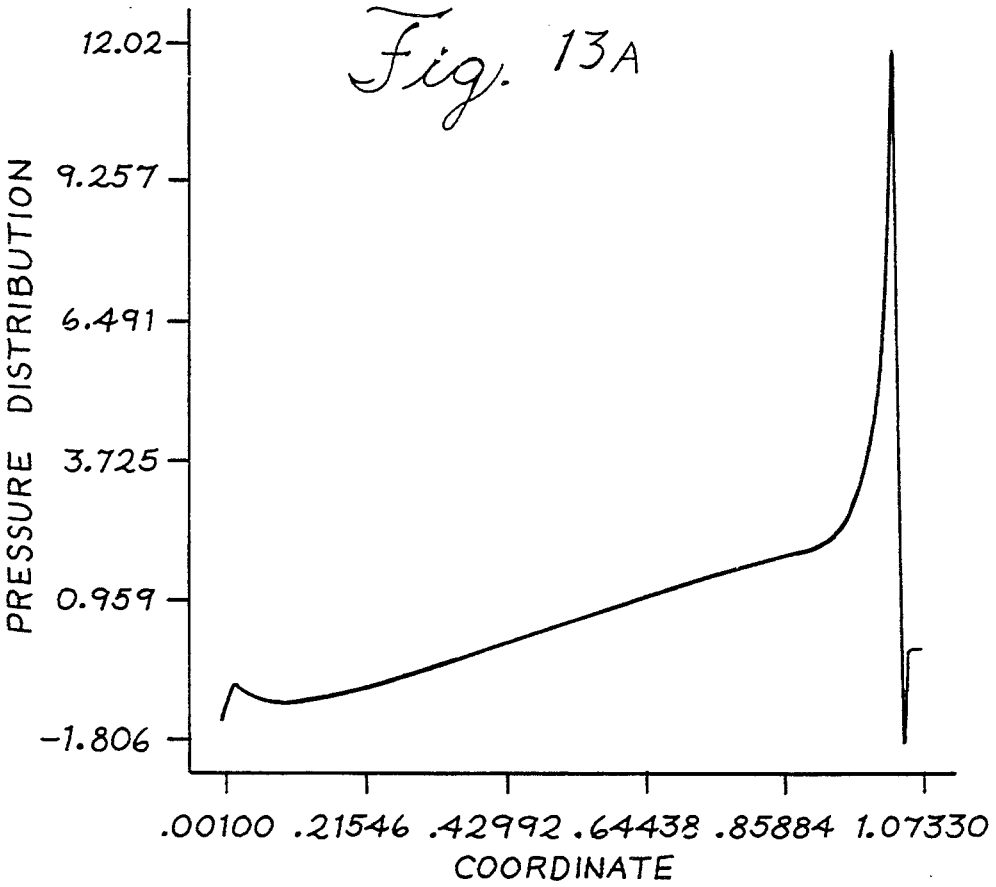
FIGS. 13A–13D illustrate pressure distribution along the substrate for cases N1 to N4 of Table 4.
Figure 13B:
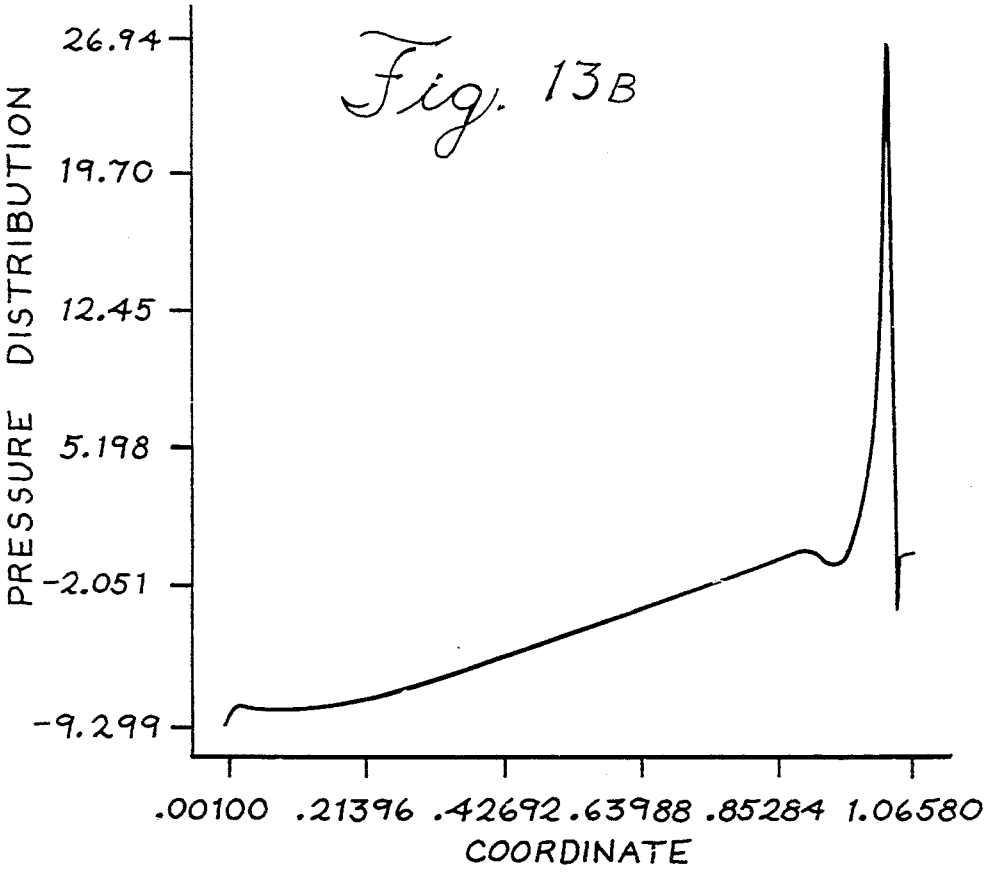
Figure 13C:
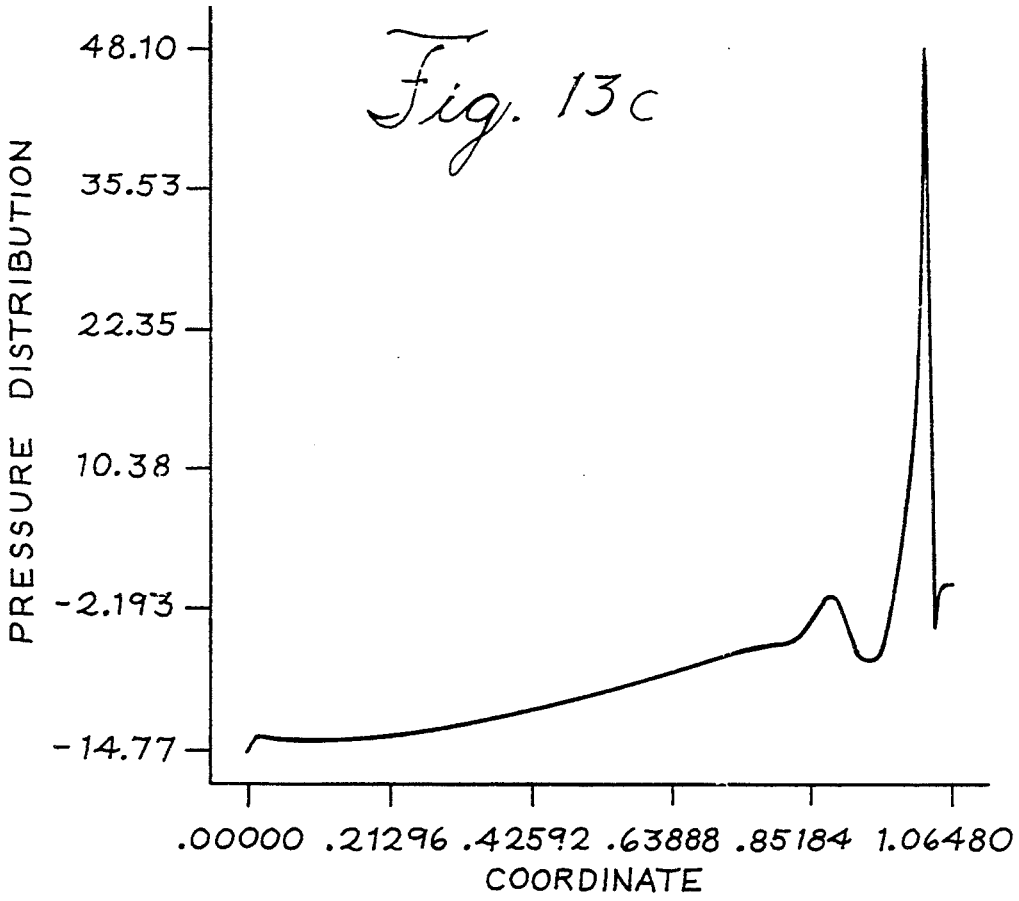
Figure 13D:
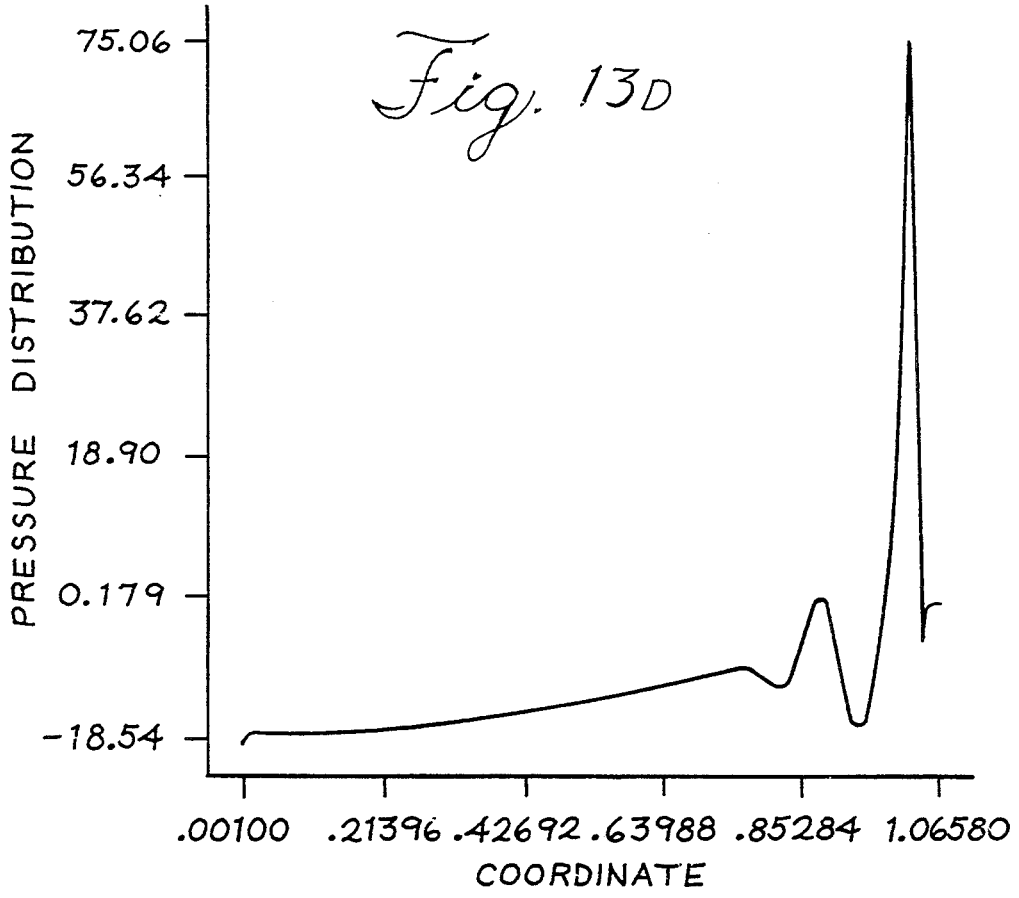
Figure 14A:
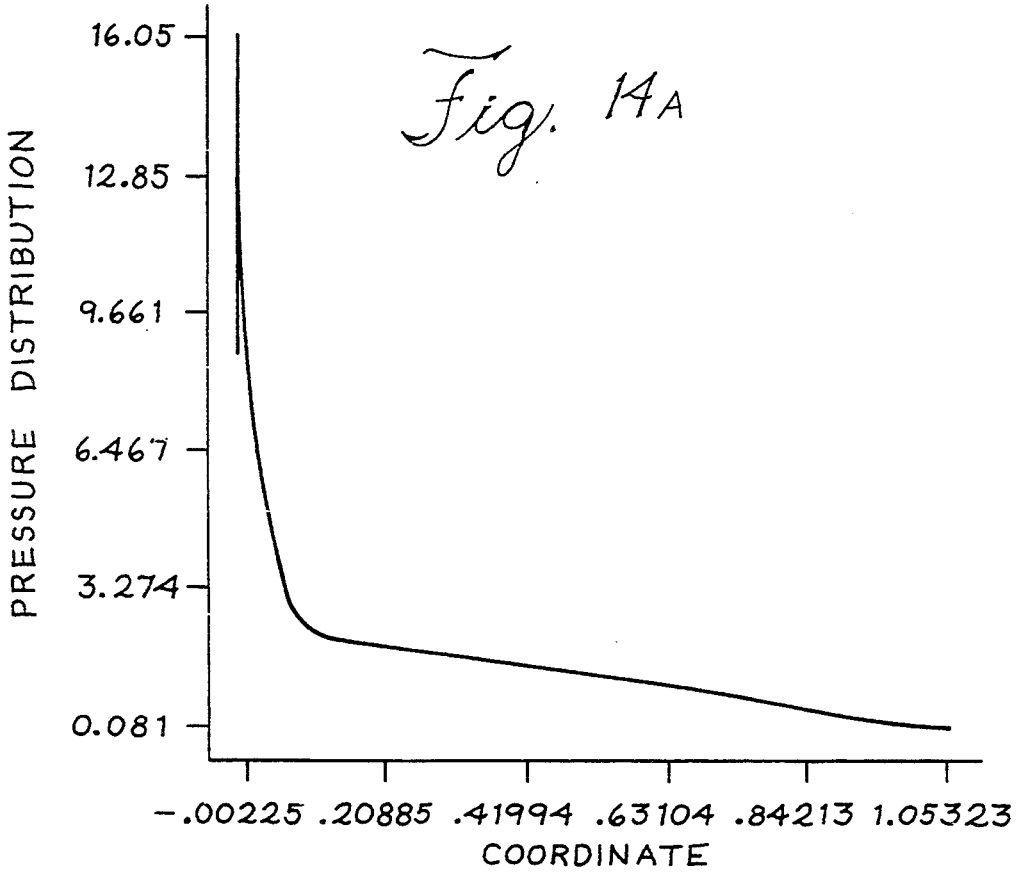
FIGS. 14A–14D illustrate pressure distribution along the blade for cases N1 to N4 of Table 4.
Figure 14B:
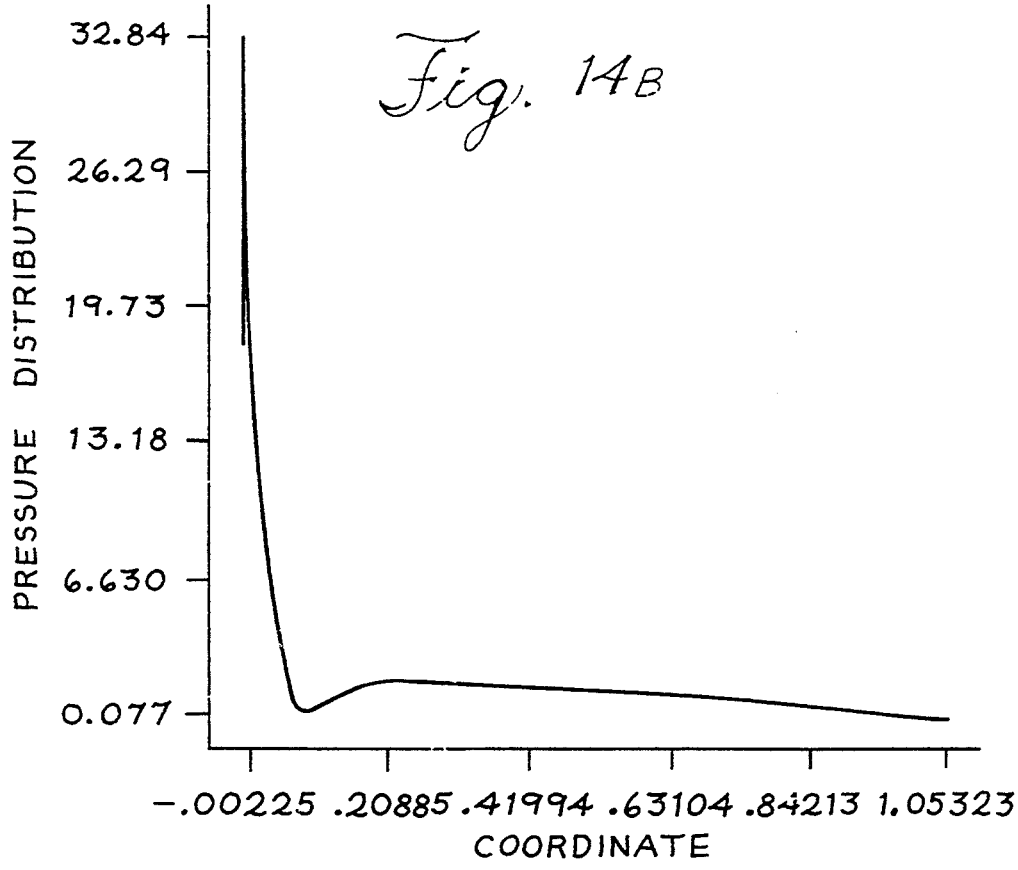
Figure 14C:
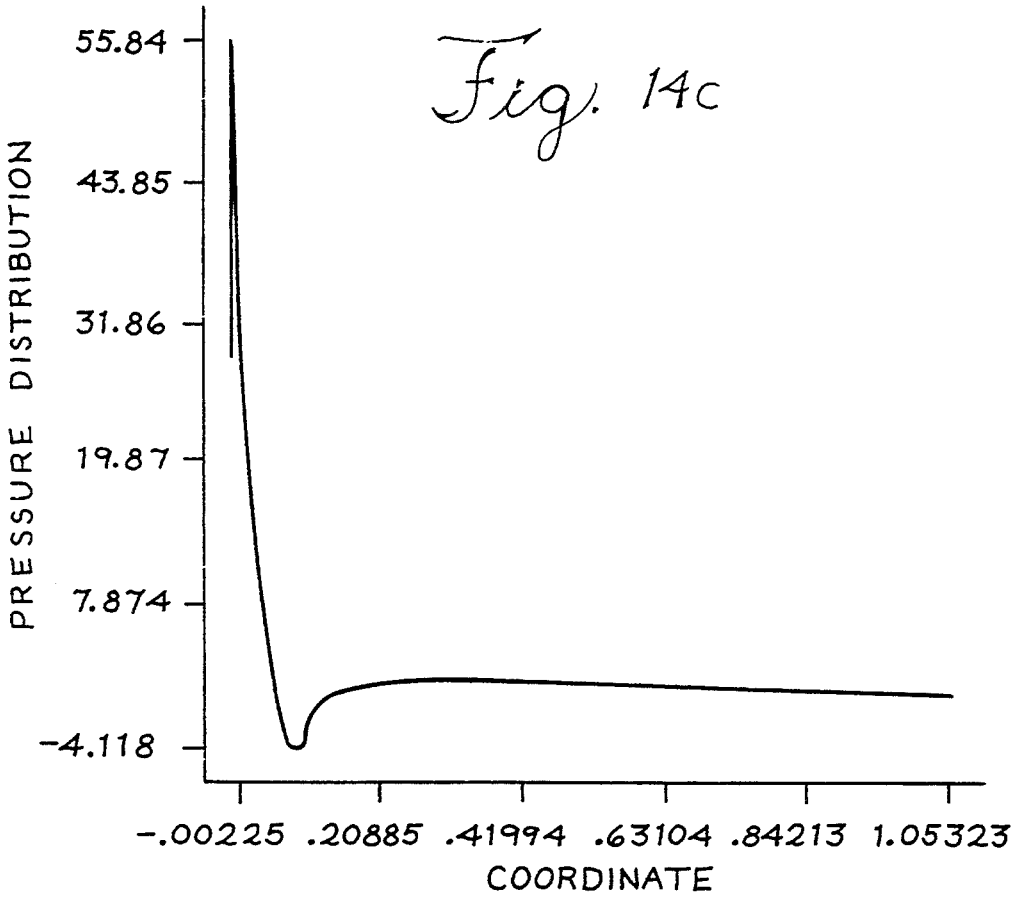
Figure 14D:
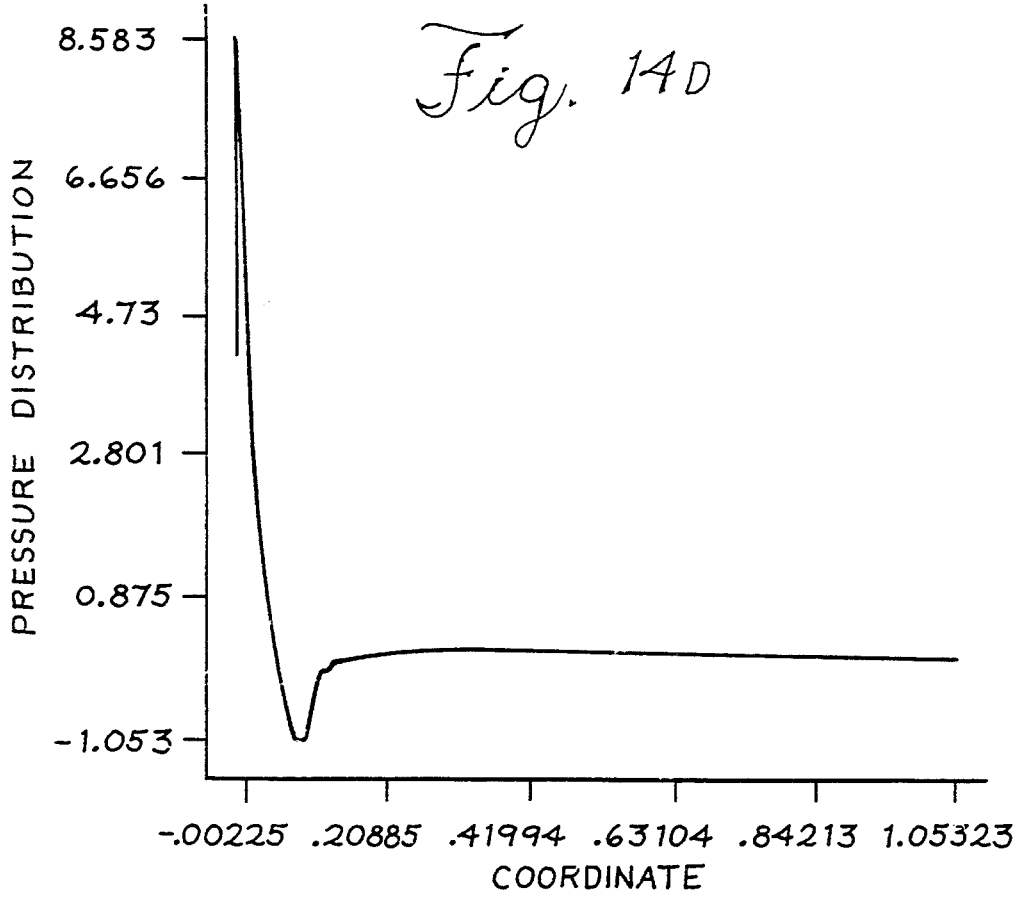
Figure 15A:
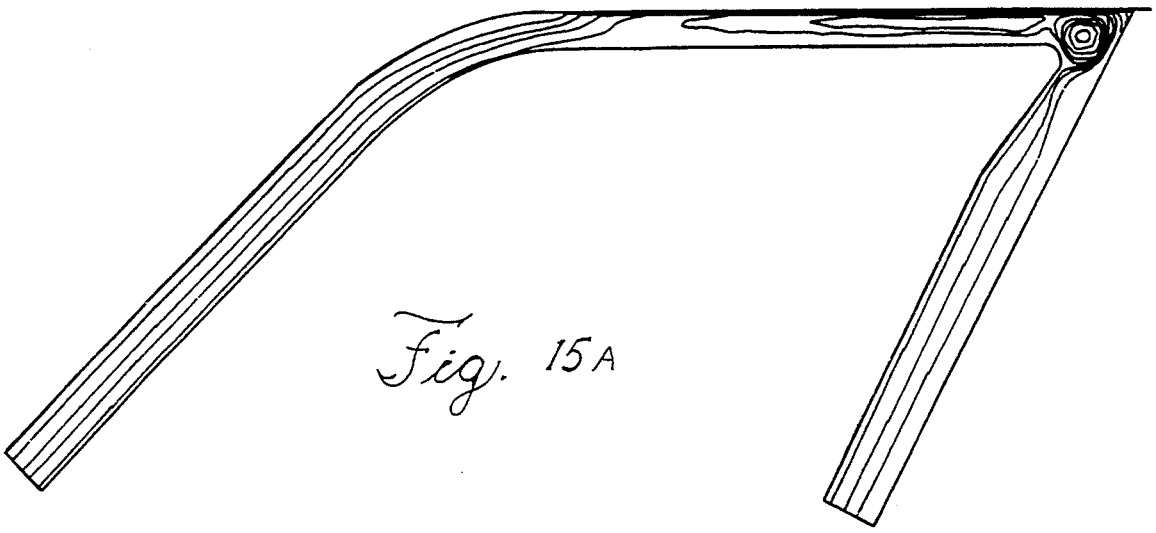
Figure 15B:
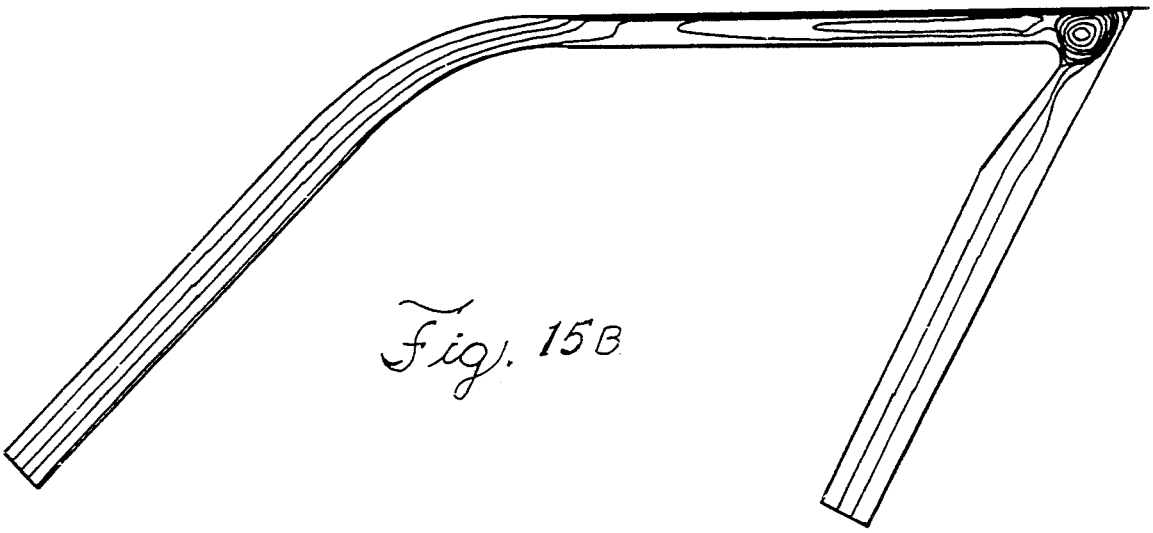
Figure 15C:
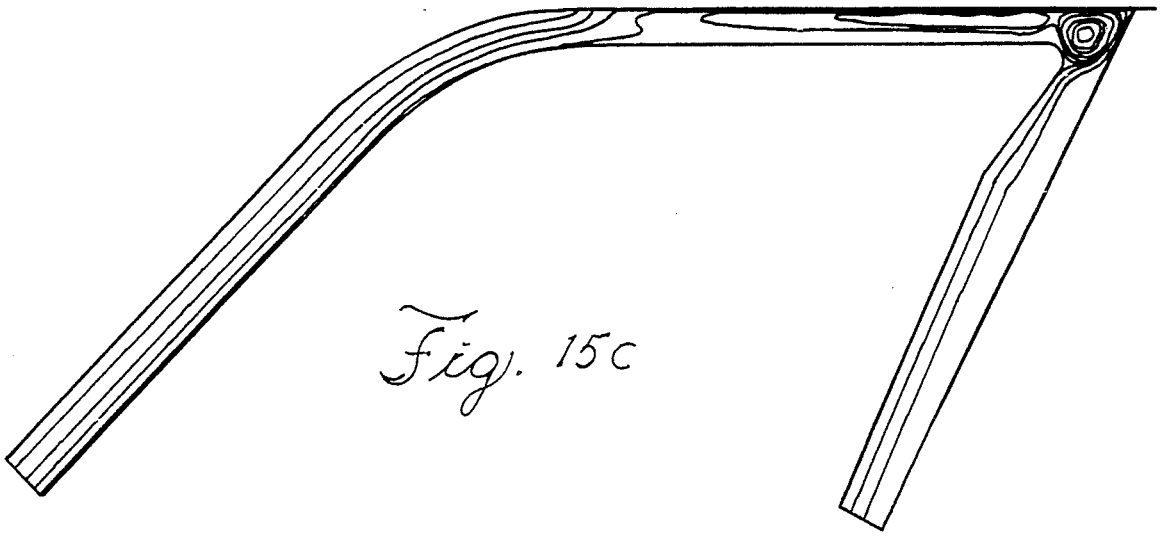
Figure 15D:
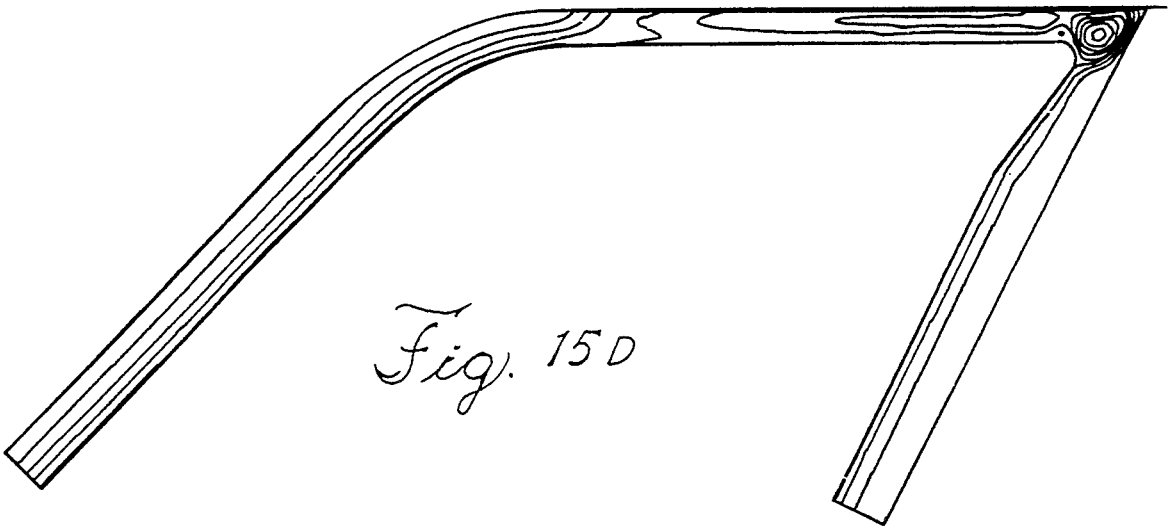
Figure 16B:
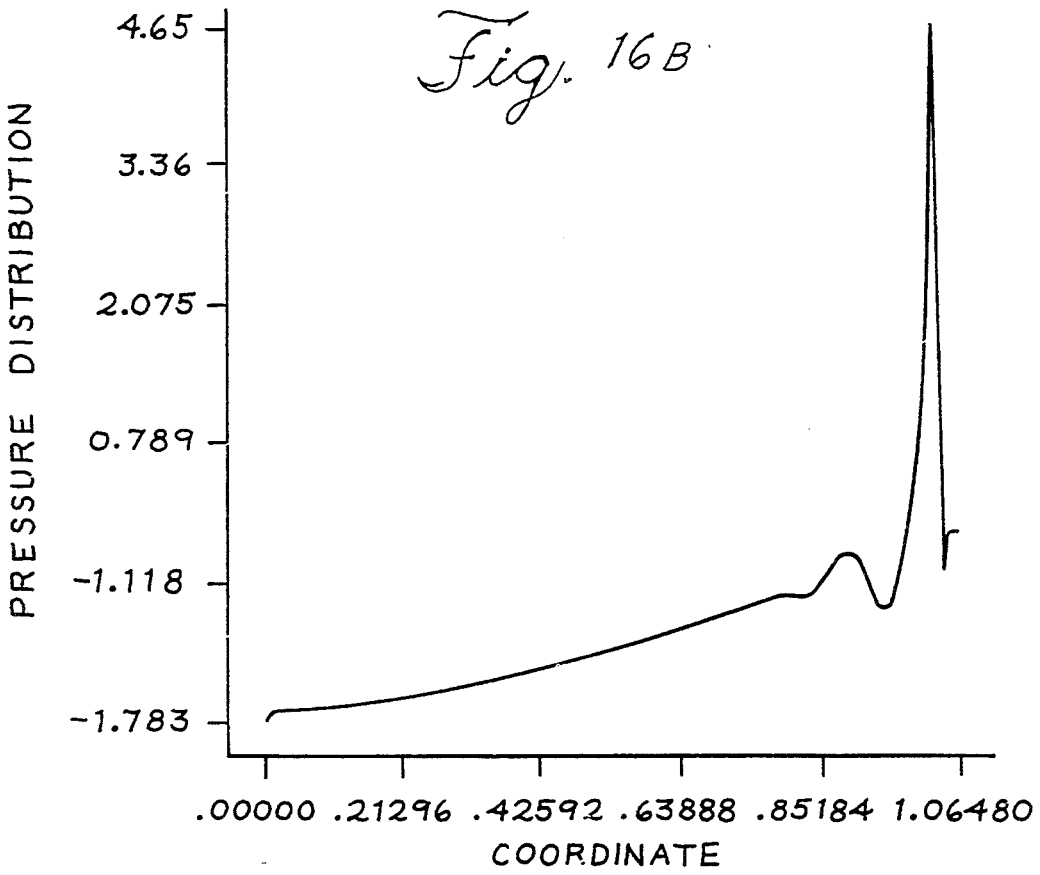
Figure 16C:
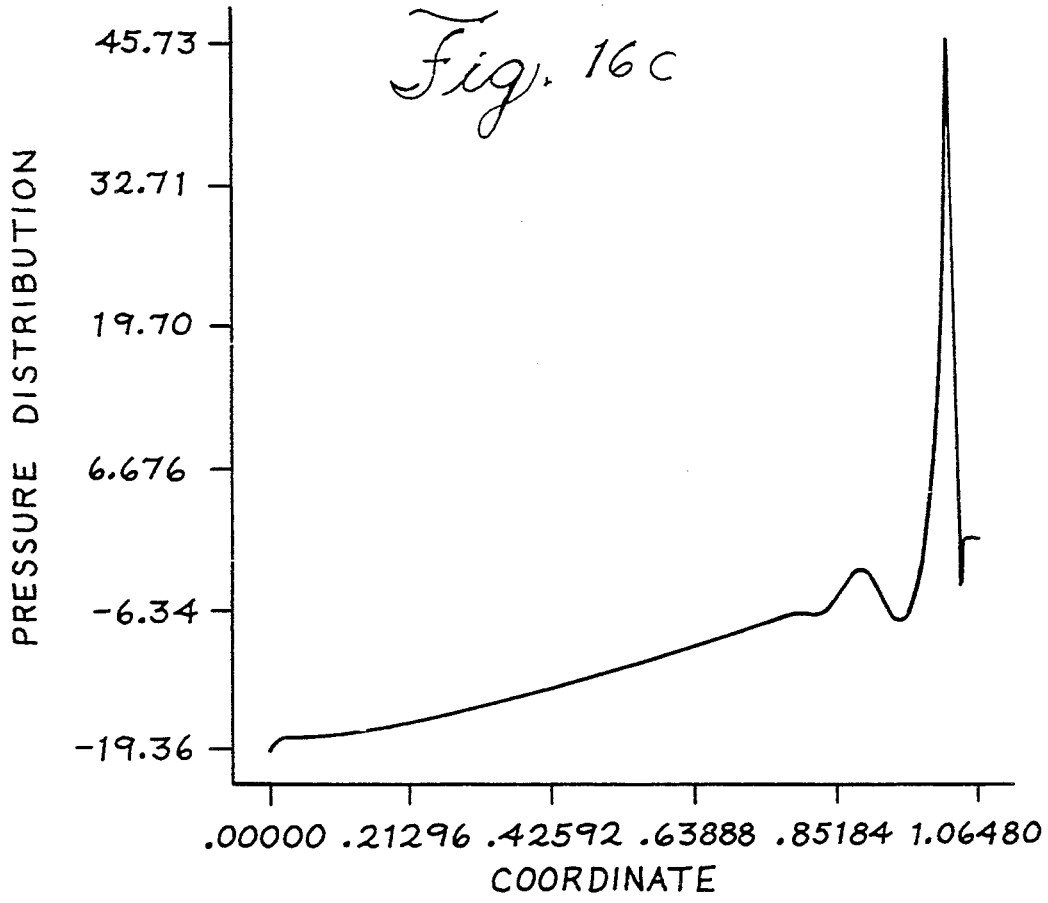
Figure 16D:
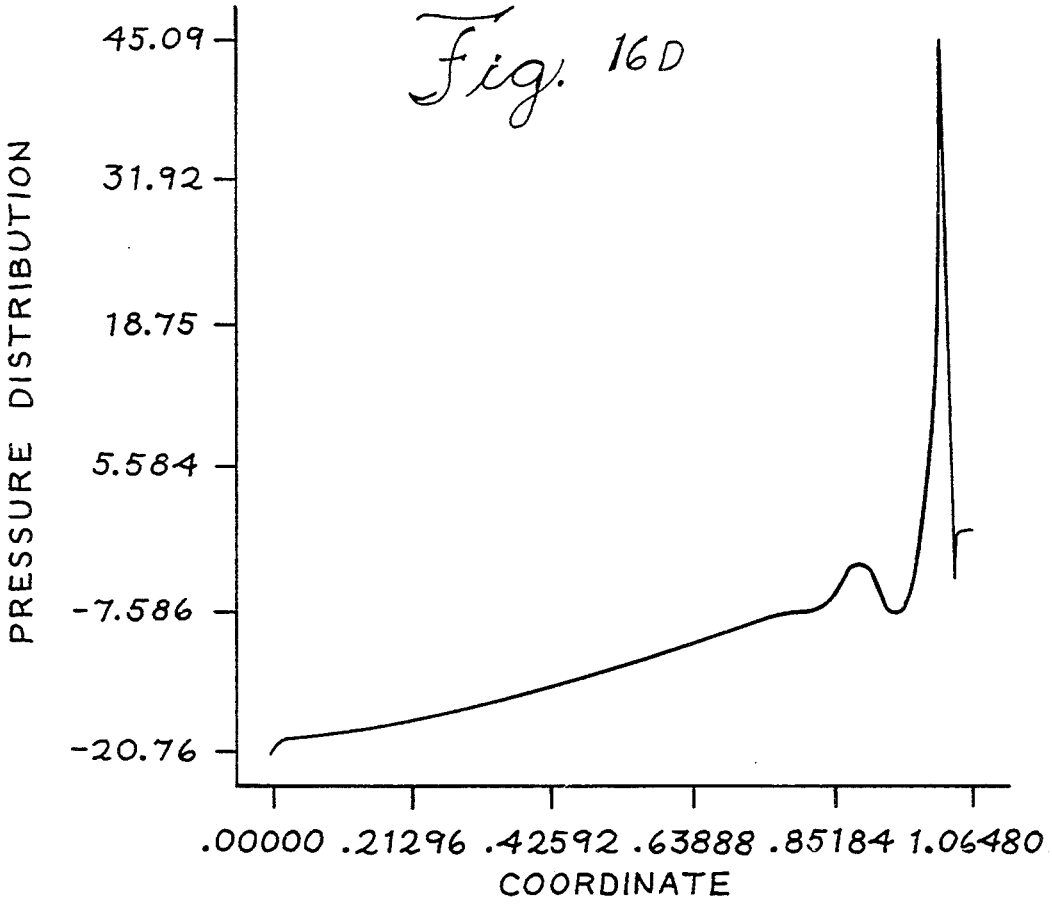
Figure 16E:
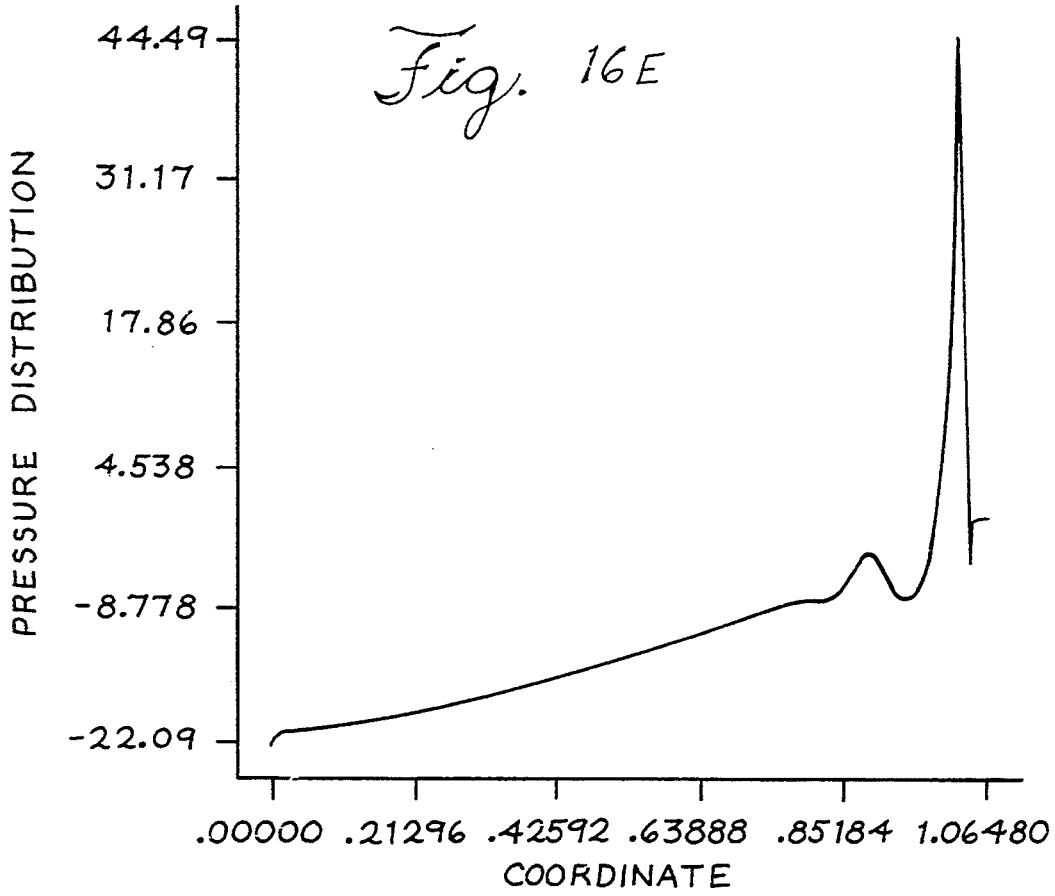
Figure 17A:
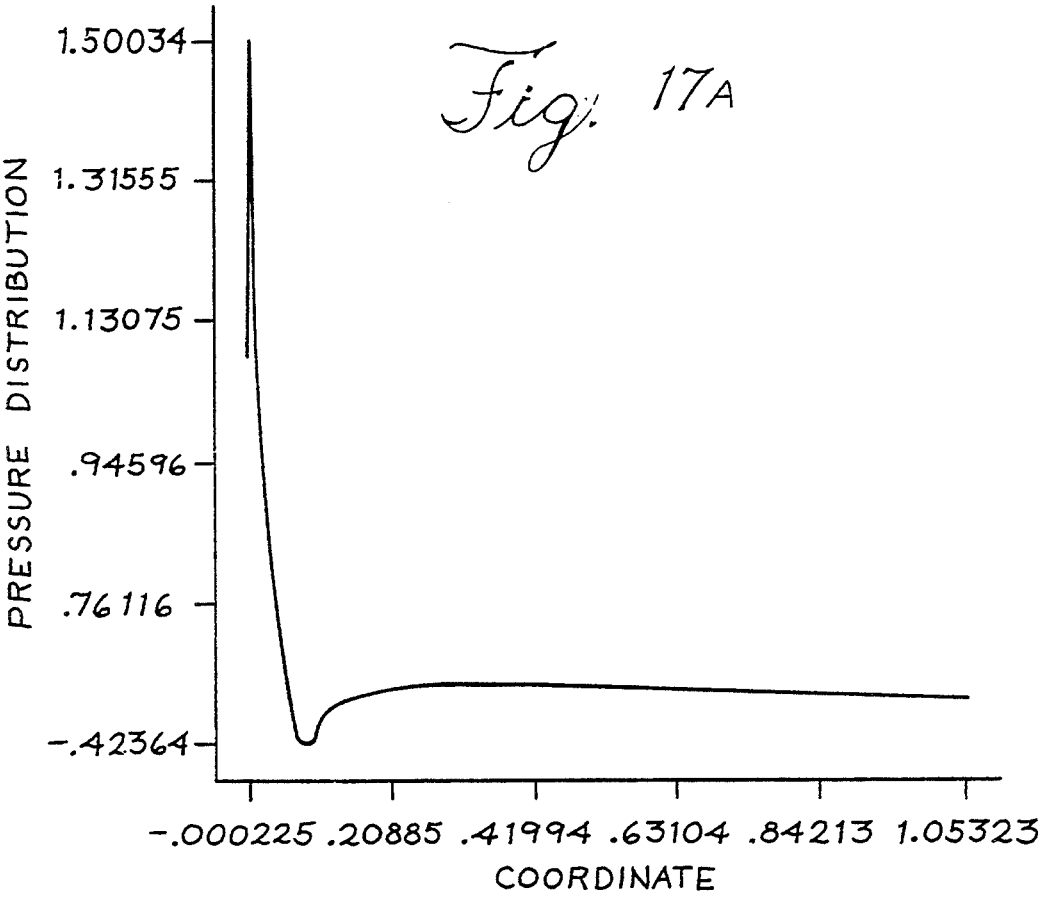
FIGS. 17A–17E illustrate pressure distribution along the blade for cases NB31 to NB35 of Table 5.
Figure 17B:
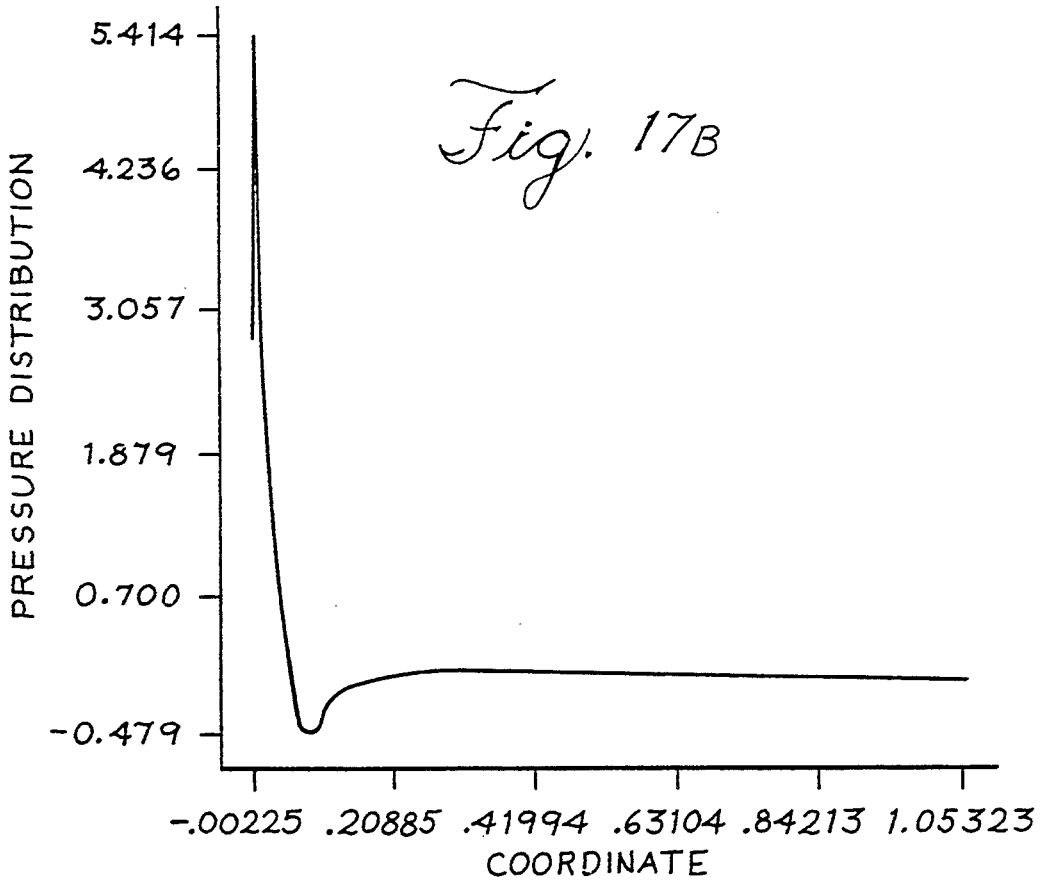
Figure 17C:
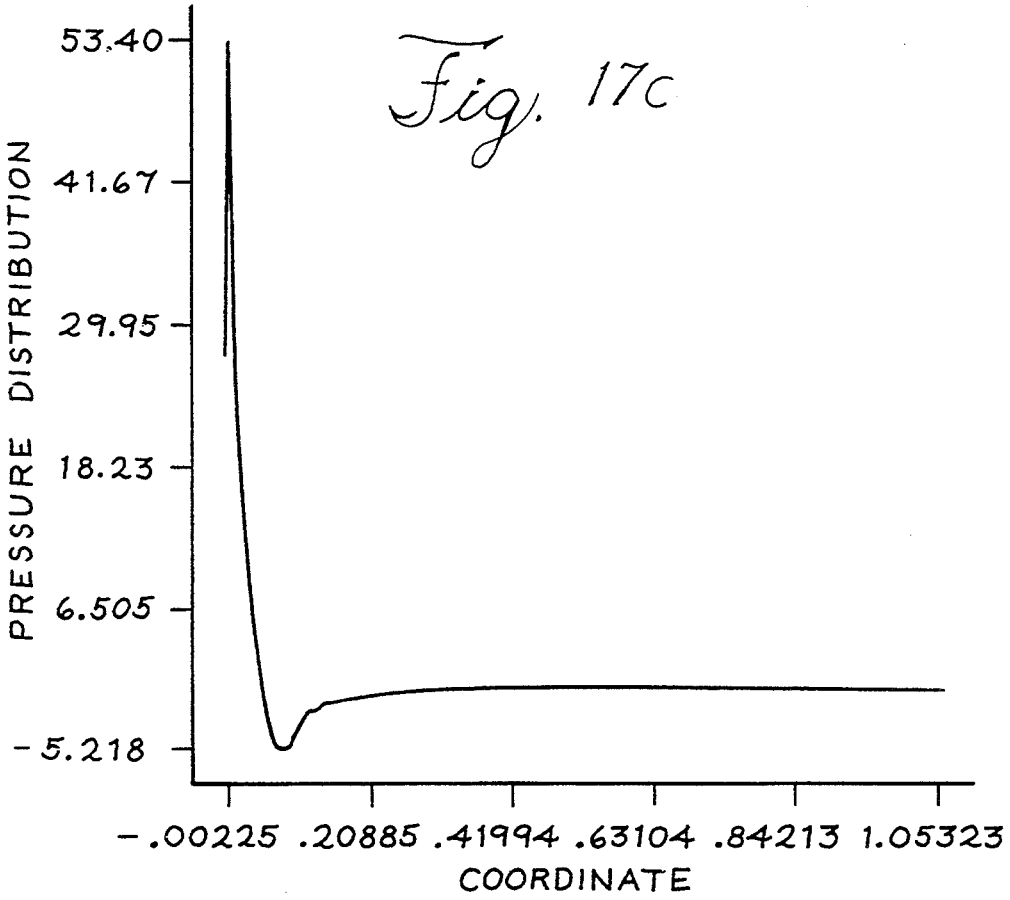
Figure 17D:
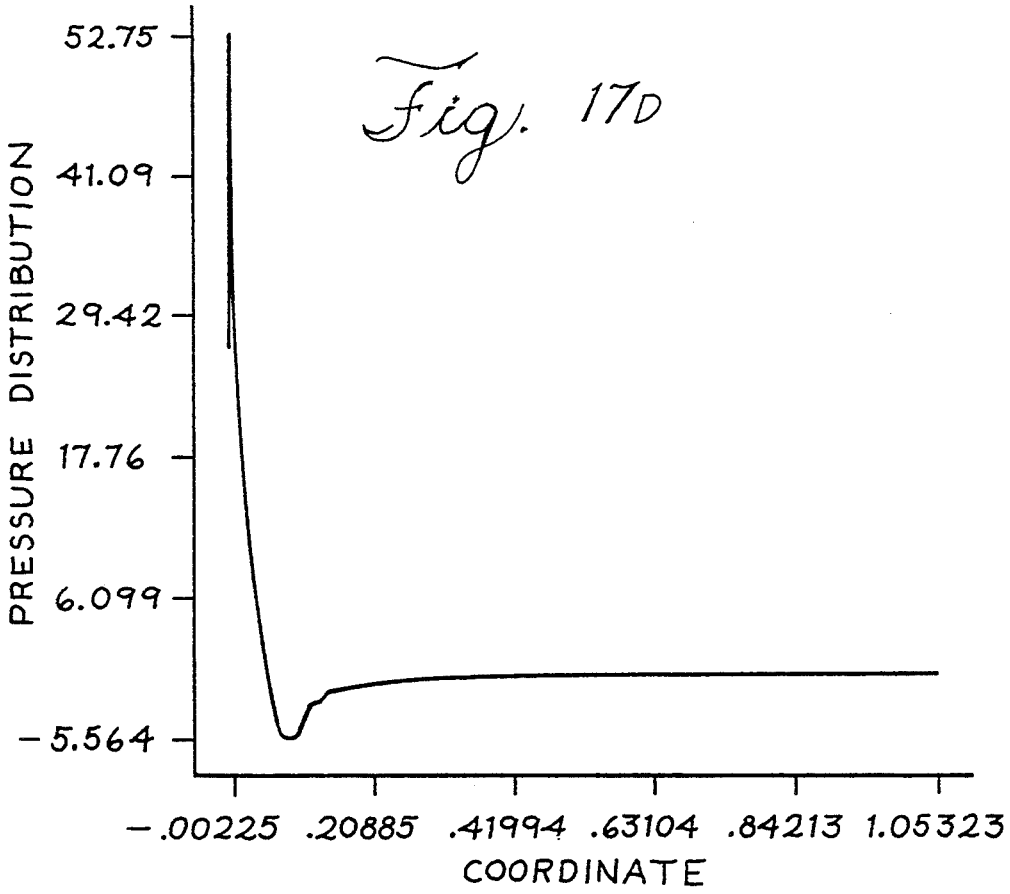
Figure 17E:
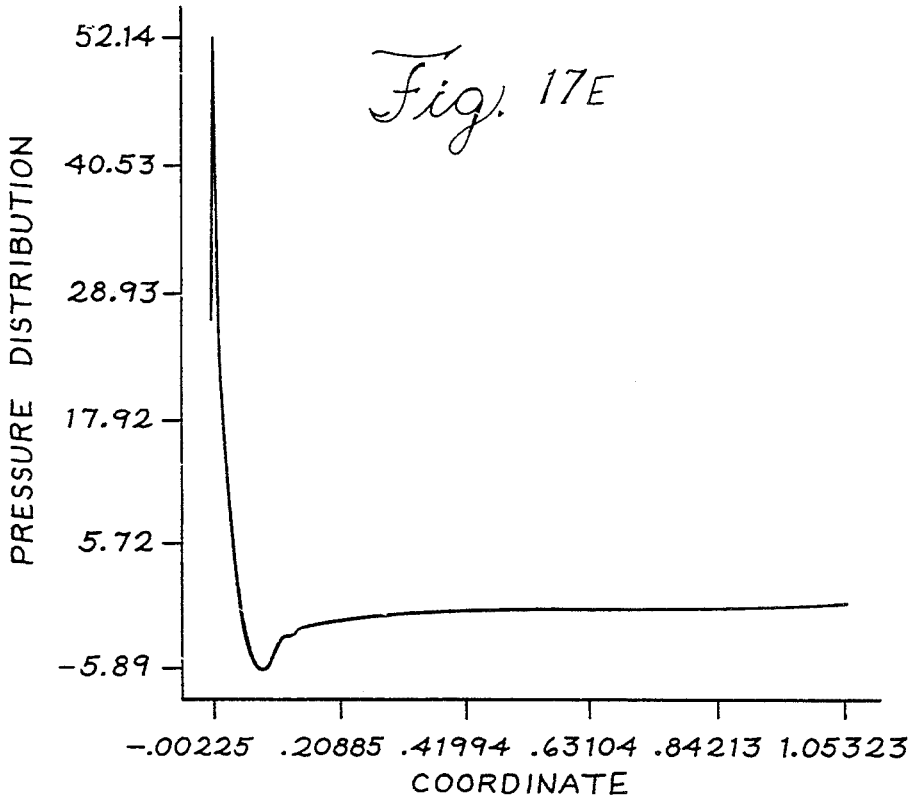
Figure 18A:
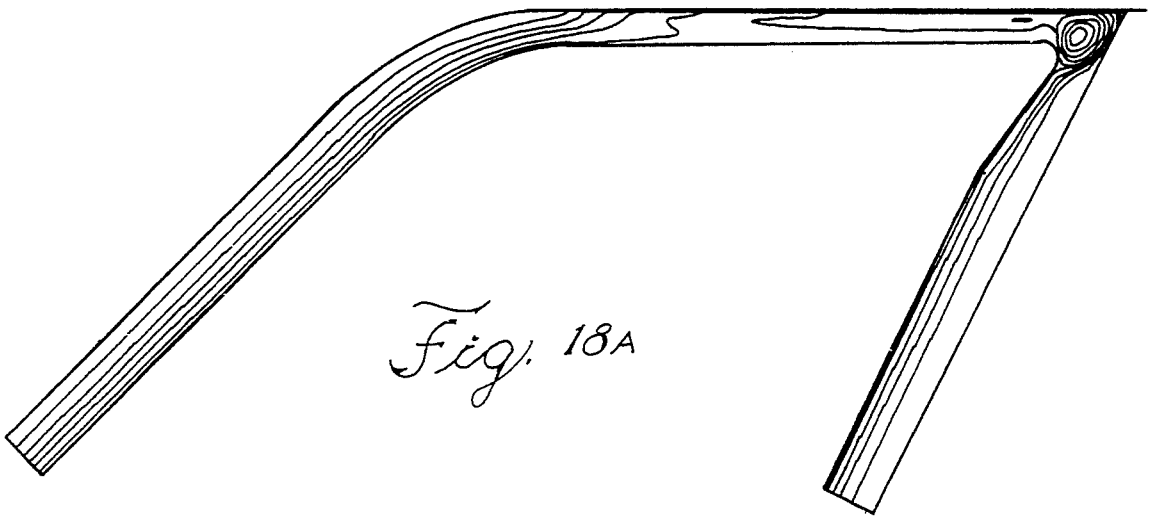
Figure 18B:
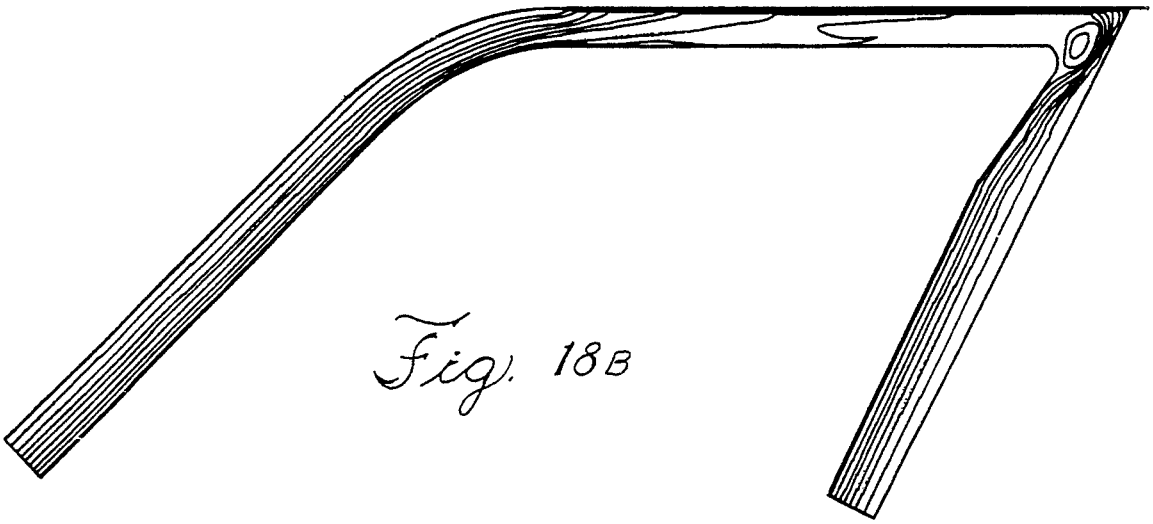
Figure 18C:
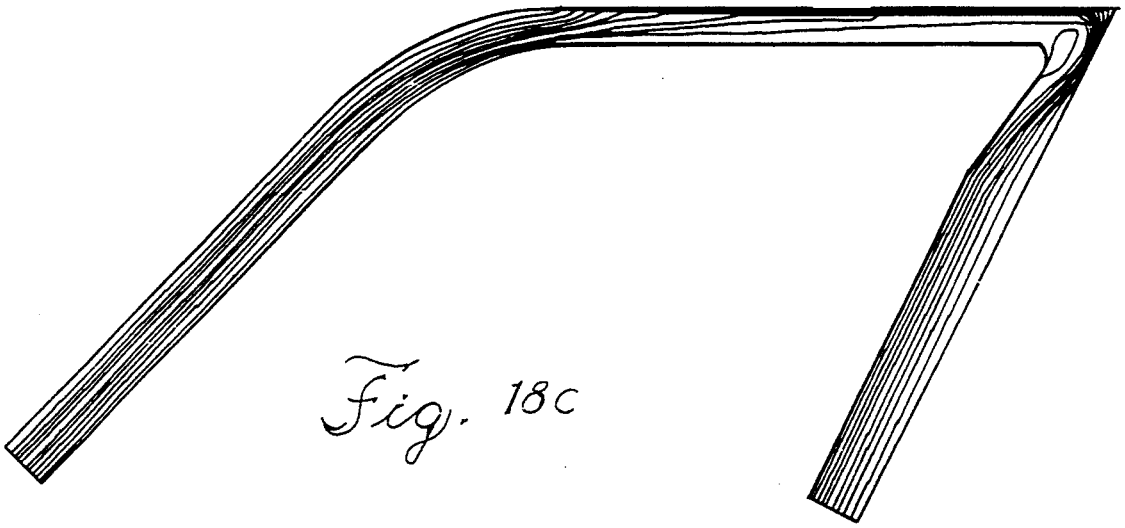
Figure 18D:
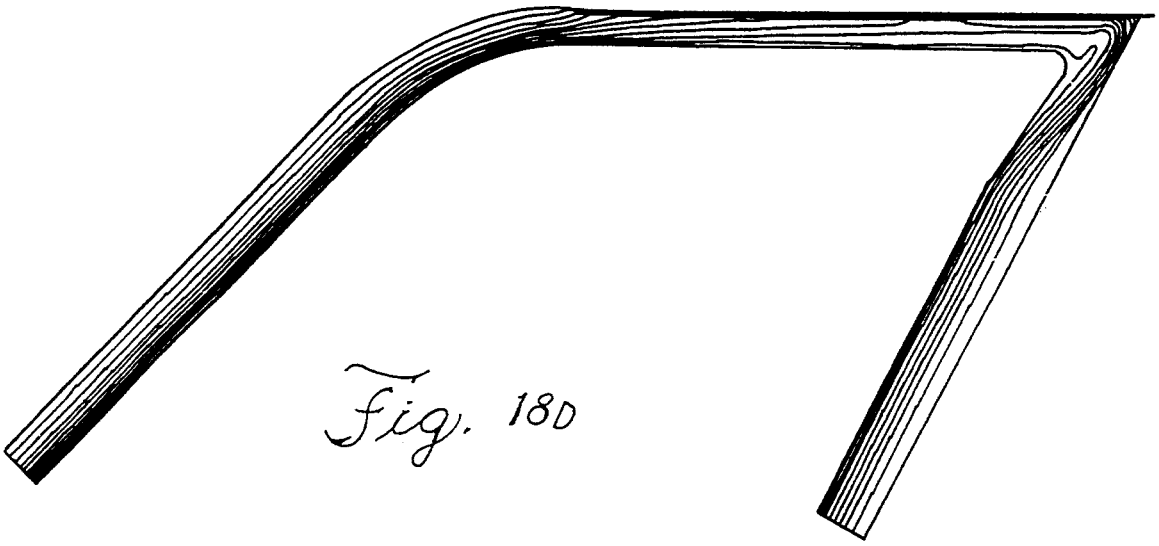
Figure 19B:
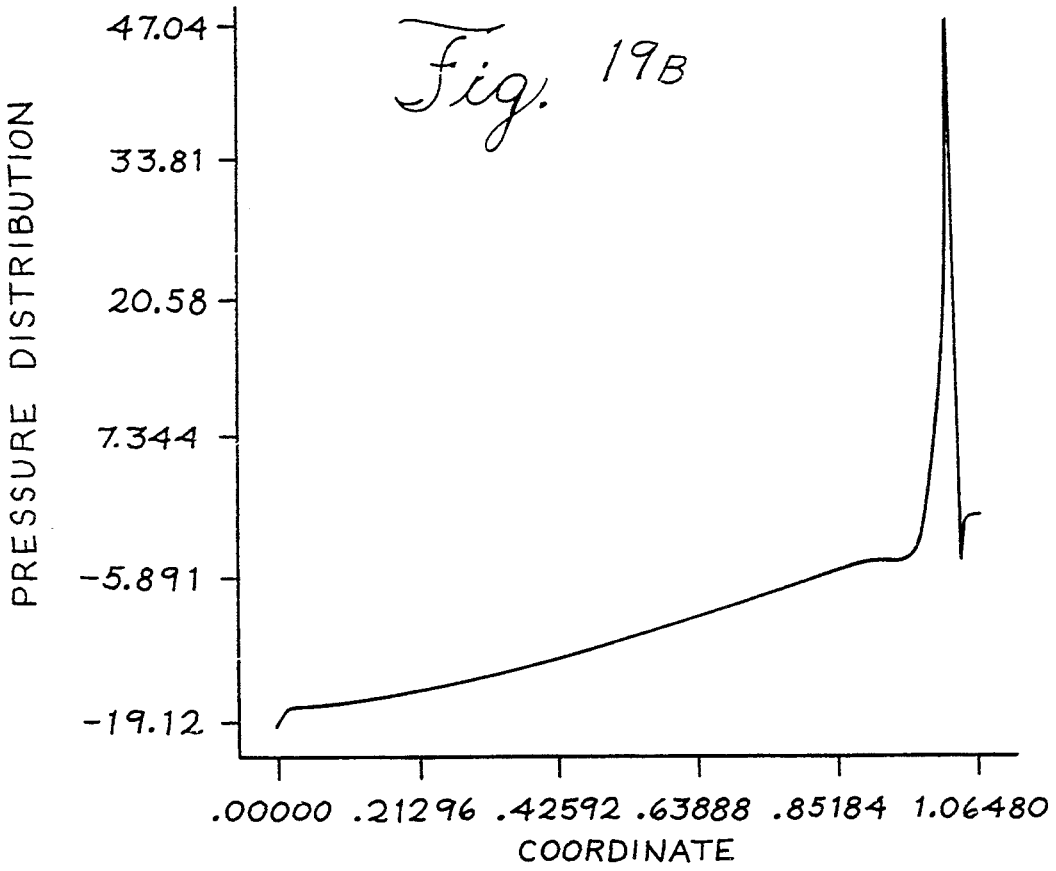
Figure 19C:
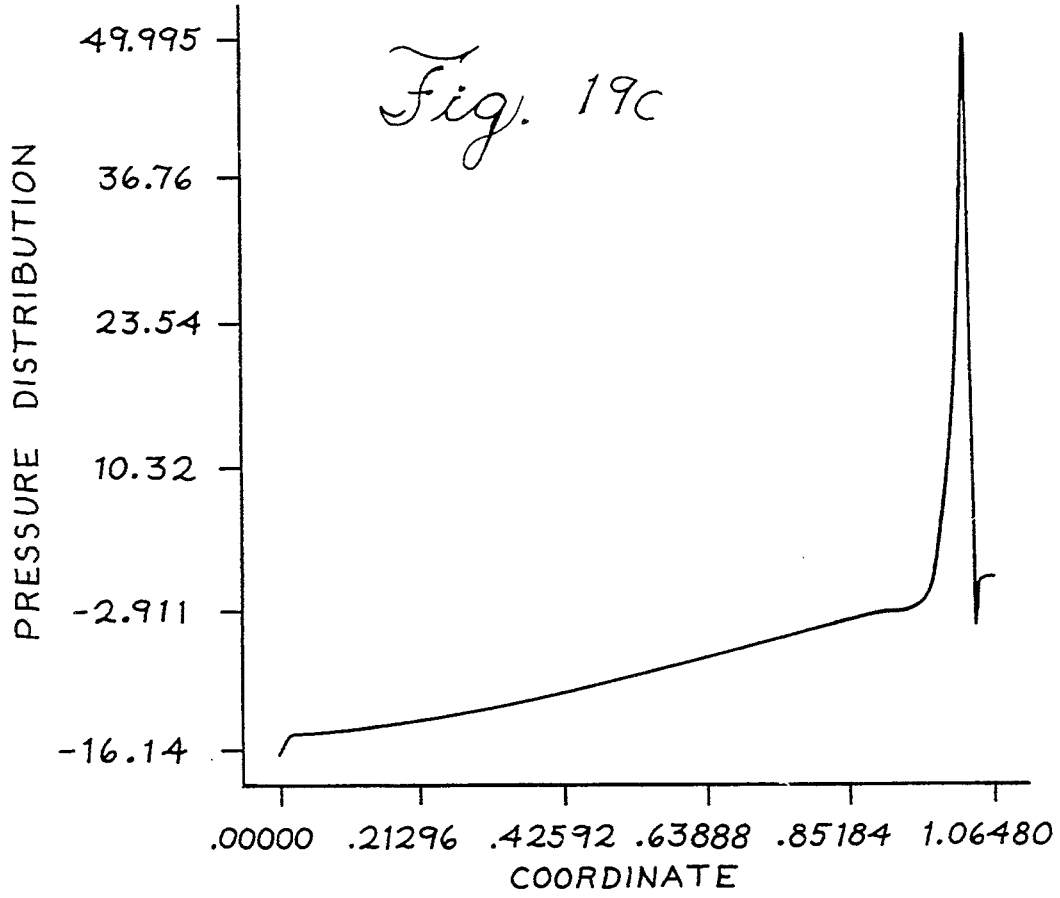
Figure 19D:
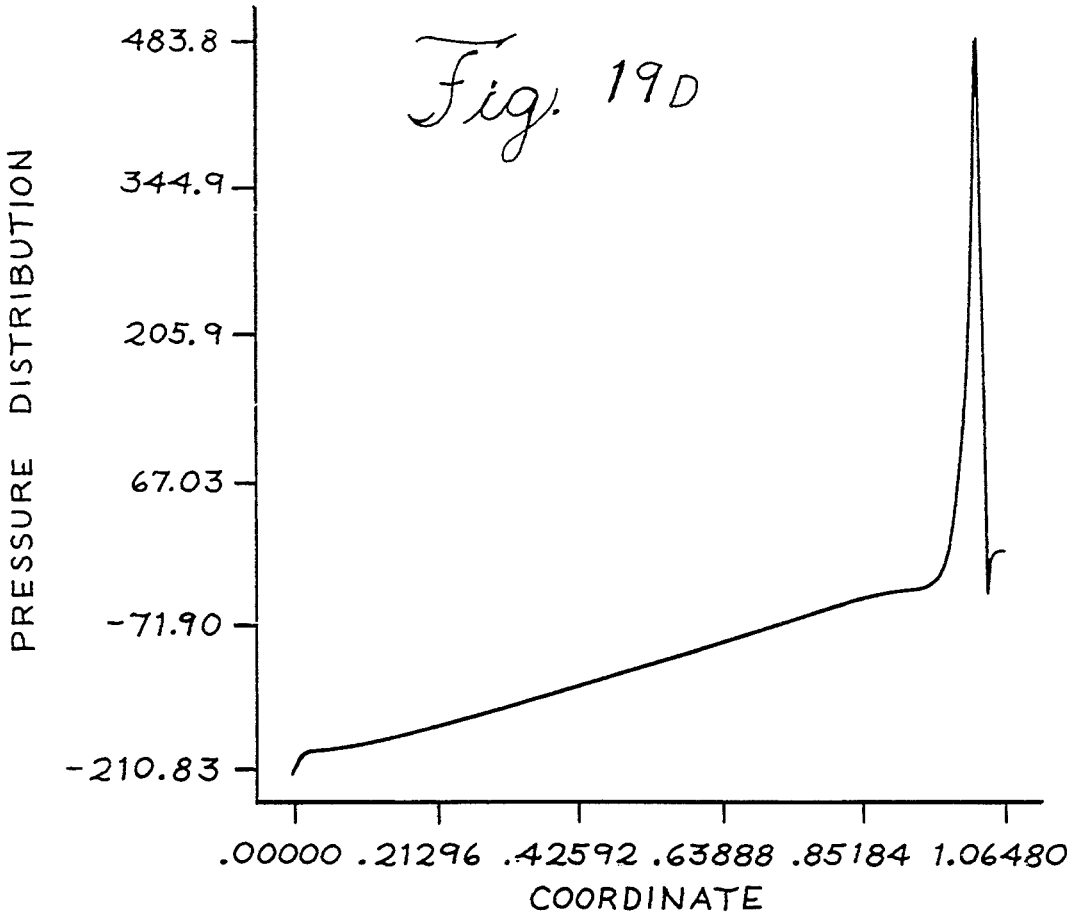
Figure 19E:
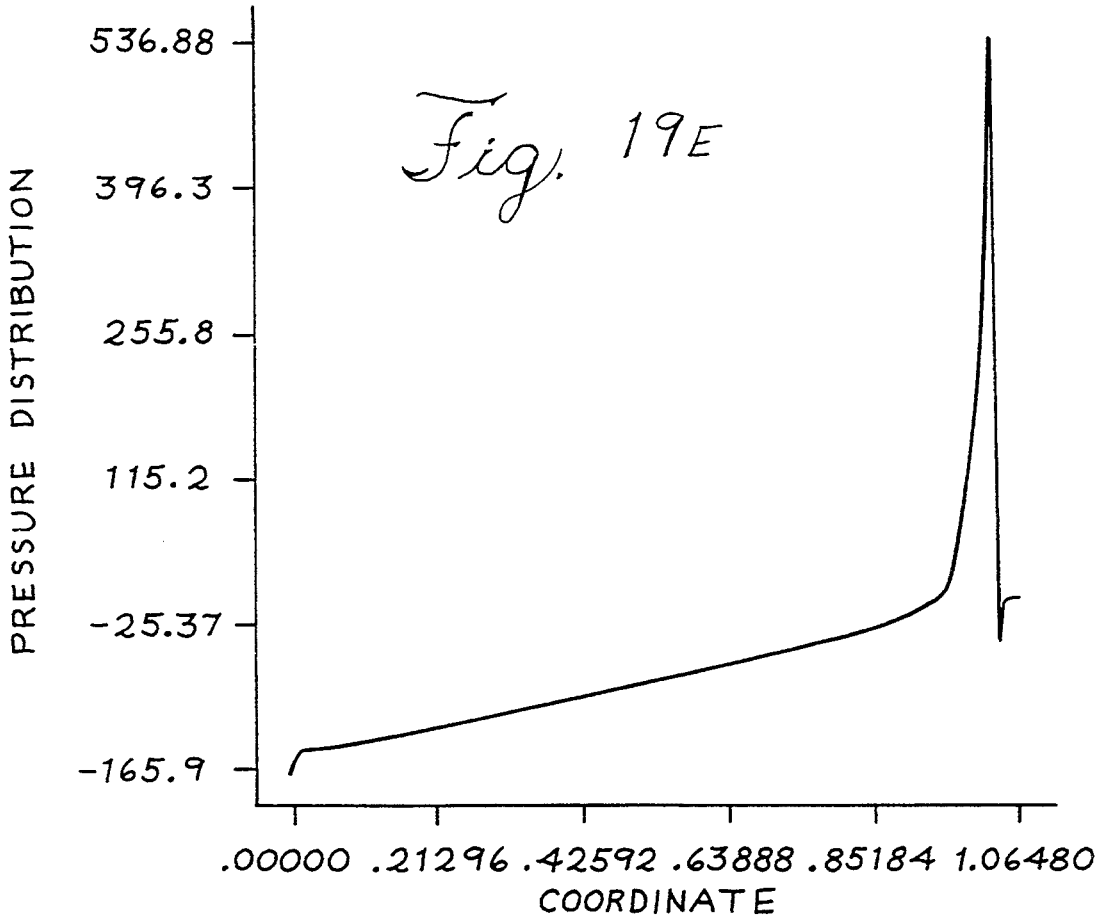
Figure 20A:
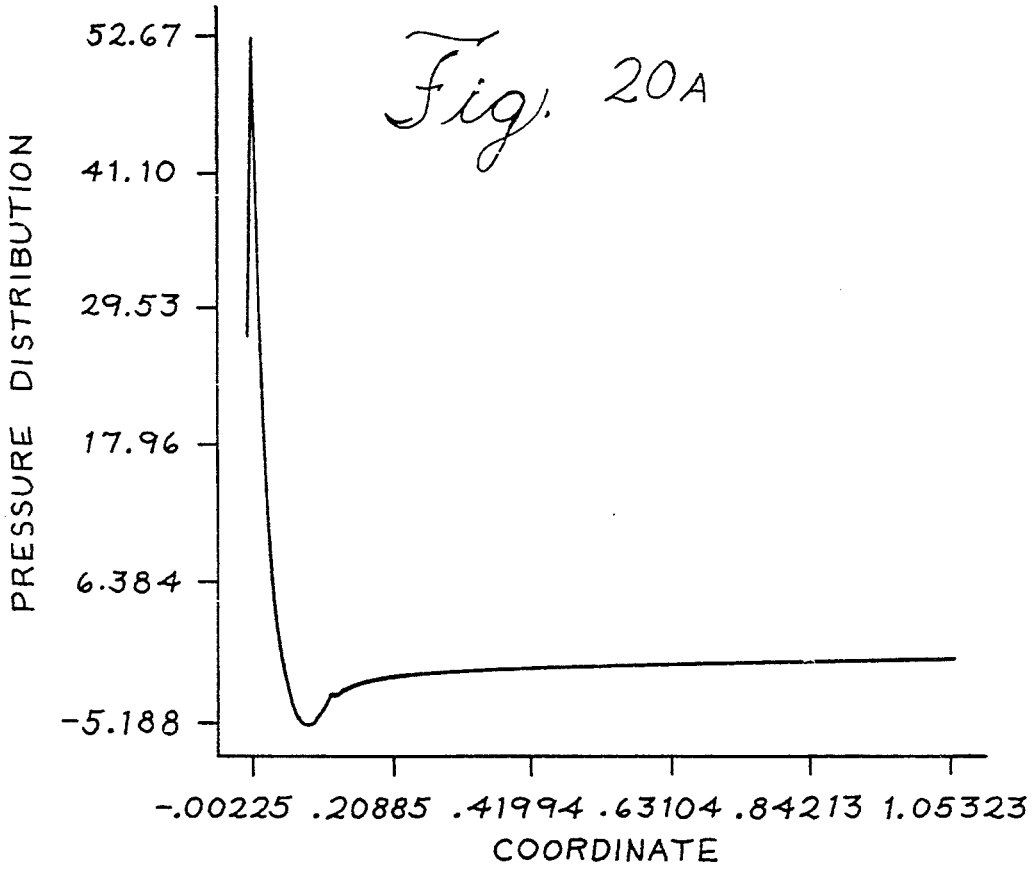
FIGS. 20A–20E illustrate pressure distribution along the blade for cases NB51 to NB55 of Table 6.
Figure 20B:
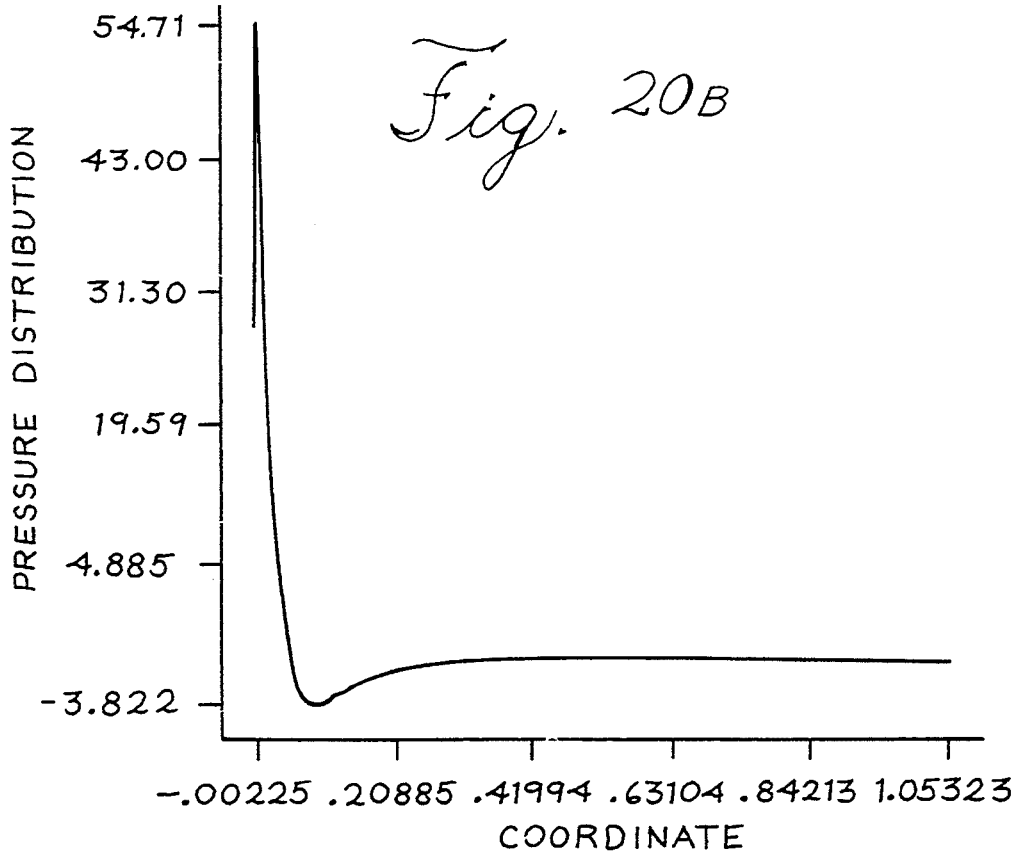
Figure 20C:
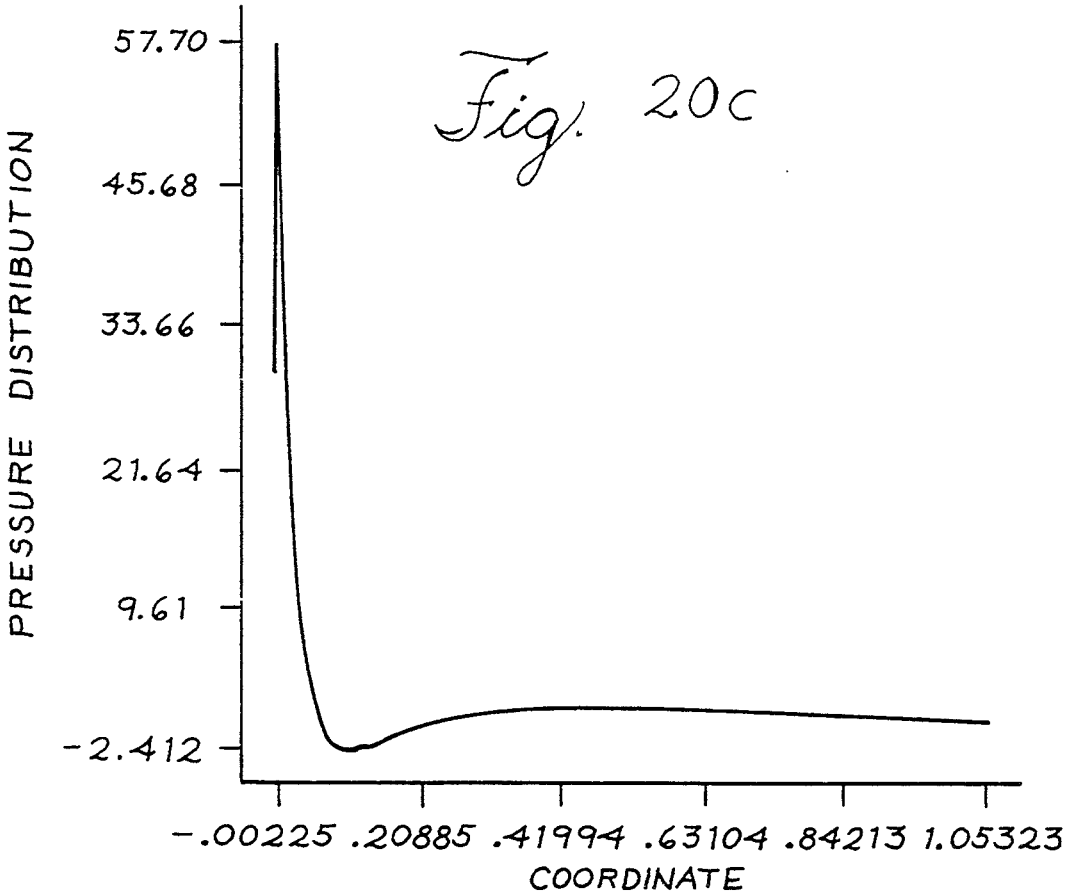
Figure 20D:
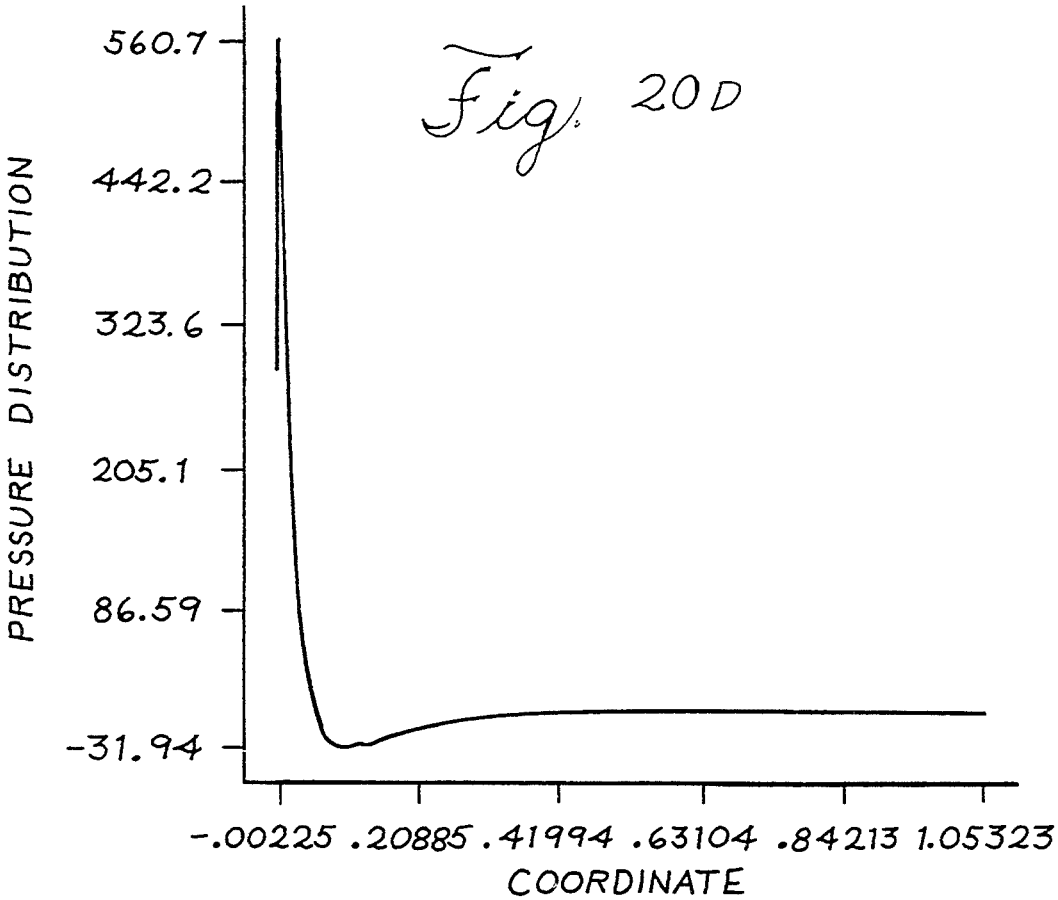
Figure 20E:
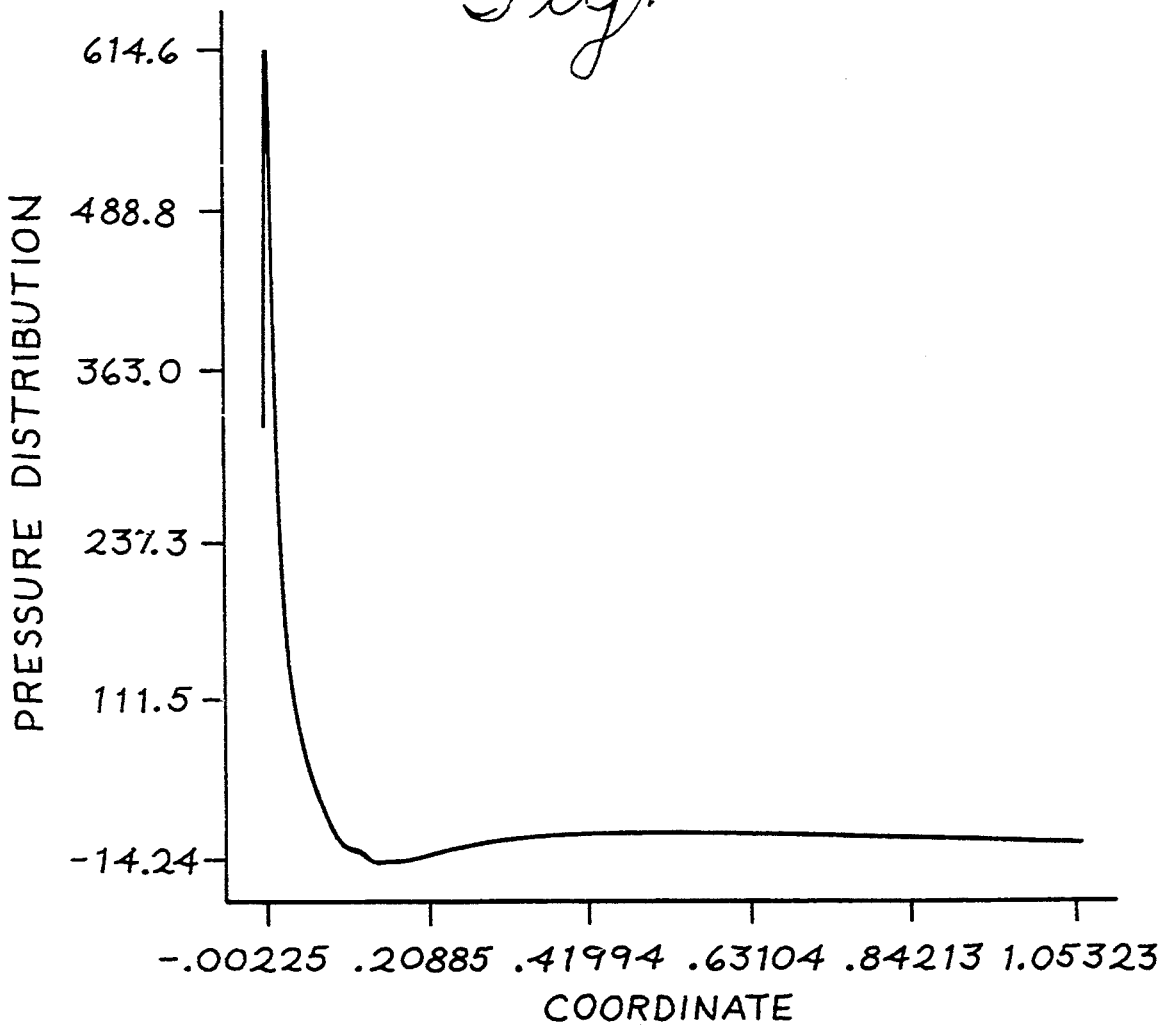

The system illustrated in FIG. 5A and more particularly in FIGS. 5B and 5C, is an extension of the coating apparatus previously discussed. The difference, which is best appreciated in FIG. 5B, is that the applicator's interior wall 80, which comprises a floating belt or plate, represents a moving surface which is in a state of flotation typically either magnetically or via air pressure or lubricating fluid. The moving parts in the device are the web (or substrate) as depicted and the floating flexible belt or interior wall 80 which rotates in the indicated direction over the flotation device 82, i.e., the shoe portion in the interior surface of the interior wall 80. A thin air layer or lubricating fluid layer 84 is created between the floating flexible belt of the interior wall 80 and the flotation device 82. On the other side of the interior wall 80 the coating fluid moves in the same direction as the interior wall 80. Therefore, the interior wall 80 contacts the coating fluid at the outside surface and an air layer or lubricating liquid of any kind at the interior surface. The flotation device for levitation of the interior wall 80 can either be an air bar or thin air layer as already described, or a magnetic device or any other flotation means including lubricating fluids. The floating belt can either move primarily by the shear or drag from the coating fluid itself and/or an external force may be utilized to control the floating device and the floating belt.

FIG. 5C illustrates that the flotation device 82 may be made to comprise an air bar wherein a high pressure air source is provided at 86 and narrow slots 88 are placed on the surface of the flotation device 82 such that air is forced through the slots 88 to keep the interior wall 80 in flotation over the thin air layer 84. In such an air flotation system the flotation device 82 would typically be manufactured to have a porous surface.

Another mechanism for keeping the interior wall 80 in a flotation state is through magnetic force. In this case the belt should be metallic. By placing magnetic cells inside the flotation device 82 which would then comprise a shoe for housing the magnetic cells, the belt is kept in a flotation state as it rotates with the coating fluid. Since the flotation speed of the belt can be very high, the flotation system would prevent wear and tear of the belt and make the system practical for commercial applications.

The advantage of having the interior surface rotate with the liquid is that it prevents flow separation and recirculation inside the coating chamber, even at the low flow rates. As will be illustrated in Tables 2–6 following, attached flow is desired and avoids problems of eddies associated with flow separation. Without the rotating inner surface, the recirculating eddies can be removed if the flow rate through the channel is sufficiently large. It is very important in coating systems, however, to minimize the flow rate and reduce the demand on the pumping facilities. The flow of the coating fluid will be more stable and uniform in the above-described system. The following extensive computational flow provides visual results which verify the advantage of maintaining attached flow of the coating fluid and thus preventing flow separation resulting in eddies.

In sum, the flotation discussed thus far may be achieved in two ways: (1) fluid fixed in a flotation device or shoe in some form as to levitate the belt such that the fluid acts as a lubricant controlling friction and speed which may be altered by changing pressure, viscosity or temperature of the fluid in the fixed shoe of the flotation device 82; alternatively (2) air between the floating service and the shoe may be used to keep the floating belt of the interior wall 80 suspended over the porous surface of the flotation device 82.

In a fluid system, temperature sensitive viscous fluid would work well to control friction in the system. Such fluids might include silicon or glycerine where viscosity is proportional to temperature. Other fluids having molecules loosely oriented might also be advantageous where viscosity is proportional to an electromagnetic field which may be applied to alter viscosity. Electromagnetic fields may also be applied to the approach using air for flotation to that the extent that an electromagnetic field may be used to exert force on the surface of the floating belt 82 to control its flotation and/or rotation.

Materials which work well in the shoe portion of the flotation device 82 include stainless steel and aluminum; however, other metals or even rigid plastics may also work well. The flotation belt of the applicator's interior wall 80 may comprise any flexible material including fabric, plastics or thin metallic sheets such as copper or aluminum.

In operation, the floating belt may be brought up to speed through drag that is exerted upon it by the coating fluid. This will have the effect of pumping additional fluid through the coating system and thus it may be desirable to add friction to maintain a desirable maximum speed for the belt at some fraction of the web rate.

By using friction, the belt rate may be altered to be anything from about 10% to 90% of the web rate.

As the liquid moves toward the applicator's blade, a part of it exits through the narrow gap between the blade and the substrate. The flow entering the gap between the blade and the substrate has a nearly Poiseuille flow distribution. This velocity distribution influences the coating thickness and is determined by the operating parameters. In the wedge-like region formed by the blade and the substrate the pressure sharply increases and has a maximum value near the stagnation point located right under the tip of the blade. The rest of the flow, which could not exit at the gap, is forced to change direction and accelerated by a favorable pressure gradient it leaves the system via another channel along the blade face. Far downstream from the blade the free surface coating fluid moves with uniform velocity together with the substrate. Near the blade tip the shape of the free surface is determined by the ambient pressure and the surface tension effects. The deformation of the blade is considered by e.g. Pranckh (1989).

In the above described coating system the fluid is accelerated by viscous drag near the web and by favorable pressure gradient along the blade face. In other parts of the flow domain the flow decelerates and large recirculation zones, i.e. eddies can form as a result of flow instability. The hydrodynamic characteristics of this coating system have an effect on the quality of the manufactured product. Aidun et al. (1991), and Benson et al. (1992) investigate with the help of flow visualization the behavior of flow in a lid driven cavity and describe a possible mechanism to time periodic flow in such a system. The appearance of a time periodic flow can generate wet film thickness variations across the machine direction and/or longitudinal streaks. The following relates to how flow recirculation can be avoided in the high speed blade coating system through design and process optimization.

GOVERNING EQUATIONS AND BOUNDARY CONDITIONS

With reference to the boundary conditions represented in FIG. 5A, the equations governing the motion of a viscous incompressible fluid are the fluid momentum and the continuity equations. These are, $$\rho\left(\frac{\partial u_i}{\partial t} + u_j\frac{\partial u_i}{\partial x_j}\right) = \frac{\partial \sigma_{ij}}{\partial x_j} + \rho f_i \tag{1}$$

and $$\frac{\partial u_j}{\partial x_j} = 0 \tag{2}$$

respectively where i,j=1,2 for two-dimensional flow. $u_i$ or u is the velocity, $\rho$ is the fluid density, $\sigma_{ij}$ is the stress tensor. t denotes time and for steady flow calculations $\partial u_i/\partial t$ is equal to zero. $\rho f_i$ is the force due to gravity. In the present two-dimensional study $u_1=u$ and $u_2=v$ are the horizontal and vertical components of velocity, respectively.

The stress tensor can be written as $$\sigma_{ij} = -p\delta_{ij} + \tau_{ij} \tag{3}$$

where $\rho$ is the pressure, $\tau_{ij}$ is the deviatoric stress tensor and $\delta_{ij}$ is the Kronecker delta. In the present study the constitutive relation has the following form $$\tau_{ij} = 2\mu\epsilon_{ij} \tag{4}$$

In (4) $\mu$ denotes the dynamic viscosity and $\epsilon_{ij}$ stands for the strain tensor. $\epsilon_{ij}$ is defined by $$\epsilon_{ij} = \frac{1}{2}\left(\frac{\partial u_i}{\partial x_j} \quad \frac{\partial u_j}{\partial x_i}\right) \tag{5}$$

For Newtonian fluid $\mu$ is taken to be a constant. For non-Newtonian fluid $\mu$ is calculated with the help of the Carreau model;

$$\mu = \mu_\infty + (\mu_o - \mu_\infty)(1 + K^2\epsilon_{ij}\epsilon_{ij})^{(n-1)/2} \tag{6}$$

In the above equation $\mu_o$ and $\mu_\infty$ are the zero and infinite shear rate viscosities, respectively, and K is the time constant. In the case of n=1 the Carreau model gives the Newtonian viscosity, i.e. $\mu=\mu_o$.

Equations (1) to (6) are non-dimensionalized with respect to a characteristic velocity U, and length L. U is chosen to be the maximum inflow velocity ($U_\rho$) if the applicator has stationary walls, otherwise it is chosen to be the applicator wall velocity ($U_b$). L is the width of the inlet channel, as illustrated in FIG. 5. The non-dimensional equations to be solved in the present study are $$\frac{\partial u_i^*}{\partial t^*} + u_j^*\frac{\partial u_i^*}{\partial x_j^*} = \frac{\partial \sigma_{ij}^*}{\partial x_j^*} + f_i^* \tag{7}$$

$$\frac{\partial u_j^*}{\partial x_j^*} = 0 \tag{8}$$

$$\sigma_{ij}^* = -p^*\delta_{ij} + {}^*_{ij} \tag{9}$$

$$\tau_{ij}^* = 2\epsilon_{ij}^*\frac{\mu}{\rho UL} = 2\epsilon_{ij}^*\frac{1}{Re} \tag{10}$$

$$\epsilon_{ij}^* = 1/2\left(\frac{\partial u_i^*}{\partial x_j^*} + \frac{\partial u_j^*}{\partial x_i^*}\right) \tag{11}$$

$$\frac{1}{Re} = \frac{\mu_\infty}{\rho UL} + \left[\frac{\mu_o}{\rho UL} - \frac{\mu_\infty}{\rho UL}\right]\left[1 + \left(\frac{KU}{L}\right)^2\epsilon_{ij}^*\epsilon_{ij}^*\right]^{(n-1)/2} = \frac{1}{Re_\infty} + \left[\frac{1}{Re_o} - \frac{1}{Re_\infty}\right][1 + K^2\epsilon_{ij}^*\epsilon_{ij}^*]^{(n-1)/2} \tag{12}$$

corresponding to equations (1) to (6), respectively. In the above equations the non-dimensional unknowns are $$u_i^* = \frac{u_i}{U},\ p^* = \frac{p}{\rho U^2} \tag{13}$$

The non-dimensional independent variables are $$x_i^* = \frac{x_i}{L},\ t^* = t\frac{U}{L} \tag{14}$$

The non-dimensional body force due to gravity is $$f_i^* = f_i \frac{L}{U^2} \tag{15}$$

The important parameters in equations (7)–(12) are the Reynolds number Re ($=\mu UL/\rho$) and the non-dimensional time constant $K^*$ ($=KU/L$).

The boundary conditions for the coating system, illustrated on FIG. 5, are given by prescribing the inflow velocity distribution;

$$u_i = U_{in} \text{ on } \Gamma_1 \tag{16a}$$

the substrate velocity;
and the applicator wall velocity;

$$u_i = U_{wi} \text{ on } \Gamma_2 \tag{16b}$$

$$u_i = U_{bi} \text{ on } \Gamma_3 \tag{16c}$$

and $$u_i = o \text{ on } \Gamma_4 \tag{16d}$$

At the outflow channel of the applicator the normal component of the stress vector is assumed to be vanishing, i.e.

$$\sigma_n = 0 \text{ on } \Gamma_5 \tag{17}$$

On the free surface of the coating liquid the kinematic boundary condition is given as $$\frac{d\eta}{dt} = \frac{\partial \eta}{\partial t} + u_i \frac{\partial \eta}{\partial x_i} \tag{18}$$

$$\text{on } \eta = \eta(x_i, t)$$

where $\eta$ denotes the height of the free surface above a horizontal reference plane and $x_i$ is the horizontal coordinate of a point on the free surface. For two-dimensional steady free surface flow $\partial\eta/\partial x$ is equal to v/u in other words the fluid velocity at the gas-liquid interface is tangential to the free surface. $\eta$ is a priori unknown.

The dynamic boundary condition on the free surface states that the stress is continuous across the gas-liquid interface $$\sigma_n = 2\gamma H - p_a \tag{19a}$$

and $$\text{on } \eta = \eta(x_i, t)$$

$$\sigma_t = 0 \tag{19b}$$

In (19a, 19b) $\sigma_n$, $\sigma_t$ are respectively the normal and tangential components of stress at the interface, $\gamma$ is the surface tension coefficient and H denotes the mean Gaussian curvature of the surface; $p_a$ stands for the ambient pressure.

Far away enough from the blade the liquid film is assumed to move as a plug flow together with the substrate (i.e. $U_{film} = U_w$ and $\partial\eta/\partial x = 0$). The static contact line of the free surface is pinned at the sharp corner of the blade, thus its location is prescribed.

As with the governing equations, the boundary conditions are also non-dimensionalized. The non-dimensionalization of (19a) yields, $$\sigma_n^* = 2H^* \frac{1}{ReCa} - p_a^* \tag{20}$$

$$\text{on } \eta^* = \eta(x_i, t)/L$$

where $H^*$ ($=HL$) is the dimensionless Gaussian mean curvature and Ca ($=\mu U/\gamma$) is the capillary number.

For brevity, the asterisks indicating non-dimensional values will be dropped in the Figures and the text from here on.

SOLUTION PROCEDURE

The governing equations detailed in the previous section together with the prescribed boundary conditions are to be solved. The solution involves two steps. In the first step, the governing equations are solved assuming a fixed shape for the free surface. In the second step, the limitation of fixed free surface is relaxed and the shape of the free surface is calculated. As the governing equations and boundary conditions are highly non-linear the solution is obtained via an iterative method.

The computation in the present study is based on the application of the FIDAP (1991) software package by Fluid Dynamics International, Inc., Evanston, Ill. The discretization of the domain in space is carried out with the finite element method employing nine node isoparametric quadrilaterals. Over these elements the velocity is approximated with a continuous elementwise biquadratic function while the pressure is represented by a discontinuous elementwise linear function. The obtained nonlinear algebraic system of equations is then solved with a strategy based on the application of successive substitutions and then the Newton-Raphson method.

Further description of the numerical solution can be found in the FIDAP (1991) Users Manual.

NUMERICAL EXPERIMENTS

A) Applicator with stationary walls

Tables 2 through 4 show the input parameters for the numerical runs. Table 2 presents the computational experiments carried out assuming Newtonian fluid, while Tables 3 and 4 consider the non-Newtonian behavior of the fluid. In the second column $U_p$, the maximum inflow velocity, is used as the characteristic velocity, i.e. U. It is assumed that the inflow velocity has a parabolic distribution. The characteristic length, $L = L_{in}$ the width of the inlet channel, can be found in the third column. Furthermore $L_{gap}$ denotes the width of the gap between the blade and the substrate and q is the flowrate per unit width entering the applicator.

TABLE 2

INPUT PARAMETERS FOR THE SIMULATION OF NEWTONIAN FLOW
(S = Flow separation, A = Attached flow)

| Run | $U_p$ m/s | $L_{in}$ m | $L_{gap}$ m | q = $2U_pL_{in}/3$ l/s/m | $U_w$ m/s | $\gamma$ surf.tens kg/s$^2$ | $\mu$ viscosity kg/(m s) | $\rho$ density kg/m$^3$ | Re = $U_pL_{in}\rho/\mu$ — | Ca = $\mu U_p/\gamma$ — | COMMENT ON THE RESULT |
|---|---|---|---|---|---|---|---|---|---|---|---|
| B1 | 1.00 | 0.0025 | 50 $10^{-6}$ | 1.667 | 1.0 | 0.05 | 1.00 | 1200 | 3.0 | 20.0 | A |

TABLE 2-continued

INPUT PARAMETERS FOR THE SIMULATION OF NEWTONIAN FLOW (S = Flow separation, A = Attached flow)

| Run | $U_p$ m/s | $L_{in}$ m | $L_{gap}$ m | q = $2U_pL_{in}/3$ l/s/m | $U_w$ m/s | $\gamma$ surf.tens kg/s$^2$ | $\mu$ viscosity kg/(m s) | $\rho$ density kg/m$^3$ | Re = $U_pL_{in}\rho/\mu$ — | Ca = $\mu U_p/\gamma$ — | COMMENT ON THE RESULT |
|---|---|---|---|---|---|---|---|---|---|---|---|
| B2 | 1.50 | " | " | 2.500 | 2.5 | " | " | " | 4.5 | 30.0 | A |
| B3 | 2.00 | " | " | 3.333 | 5.0 | " | " | " | 6.0 | 40.0 | S |
| B4 | 2.50 | " | " | 4.166 | 10.0 | " | " | " | 7.5 | 50.0 | S |
| B5 | 3.00 | " | " | 5.000 | 20.0 | " | " | " | 9.0 | 60.0 | S |
| B6 | 3.00 | " | " | 5.000 | 30.0 | " | " | " | 9.0 | 60.0 | S |
| B7 | 3.00 | " | " | 5.000 | 40.0 | " | " | " | 9.0 | 60.0 | S |

TABLE 3

INPUT PARAMETERS FOR THE SIMULATION OF NON-NEWTONIAN FLOW (Carreau model) (S = Flow separation, A = Attached flow)

| Run | $U_p$ m/s | $L_{in}$ m | $L_{gap}$ m | q = $2U_pL_{in}/3$ l/s/m | $U_{web}$ m/s | $\gamma$ surf.tens kg/s$^2$ | $\mu_\infty$ viscosity kg/(m s) | $\mu_o$ viscosity kg/(m s) | K | $\rho$ density kg/m$^3$ | n | COMMENT ON THE RESULT |
|---|---|---|---|---|---|---|---|---|---|---|---|---|
| C1 | 3.0 | 0.0025 | 50 $10^{-6}$ | 5.00 | 20.0 | 0.05 | 0.05 | 1.00 | 0.01 | 1200 | 0.65 | S |
| C2 | " | " | " | " | 30.0 | " | " | " | " | " | " | S |
| C3 | " | " | " | " | 40.0 | " | " | " | " | " | " | S |
| C11 | 5.0 | 0.0025 | 50 $10^{-6}$ | 8.33 | 20.0 | 0.05 | 0.05 | 1.00 | 0.01 | 1200 | 0.65 | S |
| C12 | 8.0 | " | " | 13.33 | " | " | " | " | " | " | " | S |
| C13 | 12.0 | " | " | 20.0 | " | " | " | " | " | " | " | S |
| C14 | 16.0 | " | " | 26.67 | " | " | " | " | " | " | " | A |
| C15 | 20.0 | " | " | 33.33 | " | " | " | " | " | " | " | A |

TABLE 4

INPUT PARAMETERS FOR THE SIMULATION OF NON-NEWTONIAN FLOW (Carreau model) (S = Flow separation, A = Attached flow)

| Run | $U_p$ m/s | $L_{in}$ m | $L_{gap}$ m | q = $2U_pL_{in}/3$ l/s/m | $U_{web}$ m/s | $\gamma$ surf.tens kg/s$^2$ | $\mu_\infty$ viscosity kg/(m s) | $\mu_o$ viscosity kg/(m s) | K | $\rho$ density kg/m$^3$ | n | COMMENT ON THE RESULT |
|---|---|---|---|---|---|---|---|---|---|---|---|---|
| N1 | 3.0 | 0.0025 | 50 $10^{-6}$ | 5.0 | 10.0 | 0.05 | 0.05 | 1.00 | 0.01 | 1200 | 0.65 | A |
| N2 | " | " | " | " | 20.0 | " | " | " | " | " | " | S |
| N3 | " | " | " | " | 30.0 | " | " | " | " | " | " | S |
| N4 | " | " | " | " | 40.0 | " | " | " | " | " | " | S |

In the first numerical experiments, shown in Table 2, the web velocity ($U_{web}$) is gradually increased from 1 m/s to 40 m/s. At the same time the fluid discharge (q) is also increased. In FIGS. 6A–6G respectively show the flow pattern corresponding to the runs B1 to B7. A weak eddy appears at the second curve of the applicator wall in case of B2. This eddy gets stronger in the rest of the cases; B3 to B7. Parallel to the evolution of this eddy a second elongated eddy becomes distinguishable and the separation point moves closer to the first curve of the applicator wall. In cases of B6 and B7 a third small eddy is also noticeable located close to the blade, right under the first strong eddy. The pressure distribution along the substrate is illustrated in FIGS. 7A–7G for these cases. In the case of B5, for example, near the strong eddy the pressure exerted by the fluid on the substrate experiences a slight drop.

Under the blade the pressure distribution reaches its maximum then its minimum before the ambient pressure becomes dominant for the free surface flow. FIGS. 8A–8G illustrate the pressure distribution along the blade. Right under the sharp edge of the blade the pressure reaches its maximum then it sharply drops and from there on slowly decreases. The pressure increases approximately forty times from case B1 to B7.

Note that the Figures show $p^*U^2p^*U^2$ values for the pressure distributions. These pressure values are the differences between the local pressure and the ambient pressure.

The numerical experiments denoted by C1, C2, C3 in Table 3 are investigating the same geometry as experiments B1 to B7 for the case of a non-Newtonian fluid. It is observed that the three eddies described earlier again appear and in fact they are stronger for the non-Newtonian case. This is the result of the reduction in viscosity due to large velocity gradients (see eq. (6) of the Carreau model). To see when the eddies disappear for the case of $U_{web}$=20 m/s the discharge q is gradually increased in the runs C11 to C15. FIGS. 9A–9E illustrates the change in the streamline pattern for these cases.

In the case of run C13 there is only one weak eddy attached to the second curve of the applicator wall, in other words the discharge has to be increased from 5 l/s/m to approximately 20 l/s/m in order to suppress the eddies. It is also interesting to see how the pressure distribution along the substrate and the blade are modified with the increasing discharge as it is shown in FIGS. 10A–10E and 11A–11E, respectively. In case of C11 the pressure gradually increases downstream along the substrate and reaches a local maximum. This local maximum is followed by a local minimum from where the pressure rises to its maximum right under the sharp edge of the blade. Near the static contact line of the free surface the pressure has its minimum then its value adjusts to the ambient pressure. With increasing fluid discharge in the cases of C11 to C15 the local minimum and maximum in the pressure in front of the blade disappear. The pressure maximum increases approximately 60% from C11 to C13.

In order to suppress the eddies in the present coating system the experiments denoted by N1 to N4 in Table 4 employ a new geometry. In this new configuration the width of the channel under the substrate is reduced to the $\frac{2}{3}$ of the width in the previously described experiments. The streamlines of the flow field for these cases are shown in FIGS. 12A–12D. It is seen that at $U_w=10$ m/s there is only one weak eddy near the second curve of the applicator wall. At $U_{web}=20$ m/s the second elongated weak eddy appears and at $U_{web}=30$ m/s all the above mentioned three eddies are observable in the system. The new geometry has an effect on the pressure distribution along the substrate as well, as presented in FIGS. 13A–13D. For example, in case of N4 there are two local minimums with a local maximum in between in front of the blade. On the blade, as shown in FIGS. 14A–14D, there is also a local minimum in pressure which is the effect of the formation of the third eddy located close to that point. It is important to see that the new geometry alone does not succeed at removing the eddies from the system.

B) Applicator with a moving wall

For cases N3 and N4 a further change in the coating system is investigated. One of the applicator walls is designed to be a moving belt. Table 5 shows the cases as the belt speed $U_b$ is gradually increased from 1 m/s to 5 m/s, while the discharge is kept constant, q=5 l/s/m. In the following cases $U_b$ is chosen to be the characteristic velocity, U. The effect of the moving belt is that the second elongated eddy gets shorter and the separation point on the applicator wall moves downstream. FIGS. 15A–15E illustrates the flow pattern for these cases. In case of NB34 and NB35 a fourth eddy becomes more distinguishable, as shown in FIGS. 15A–15E. FIGS. 16A–16E and 17A–17E present the pressure distribution for theses cases along the substrate and the blade, respectively.

Figure 21A:
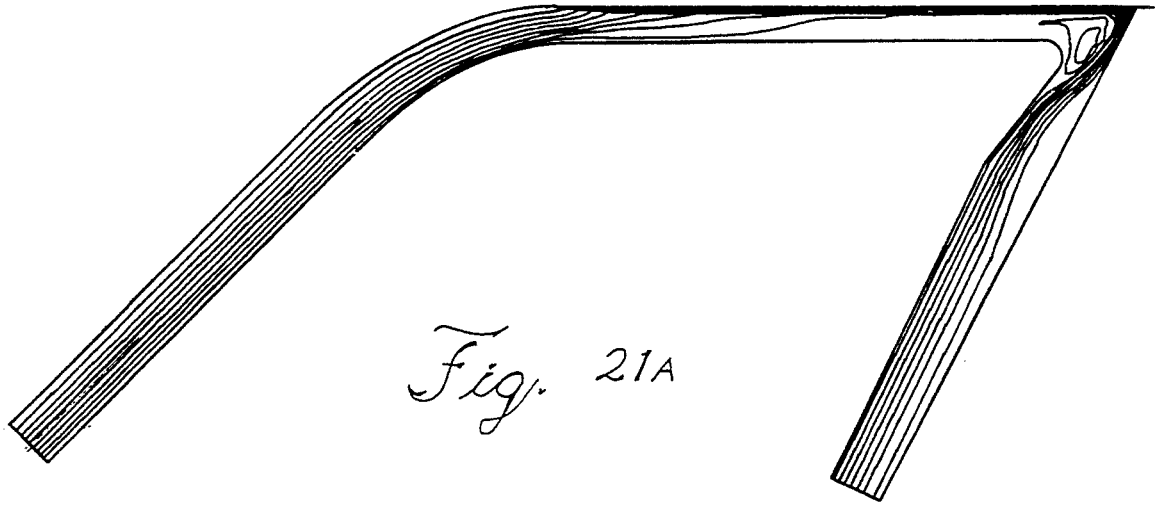
FIGS. 21A–21C illustrate flow characteristics for cases NB61 to NB63 of Table 6.
Figure 21B:
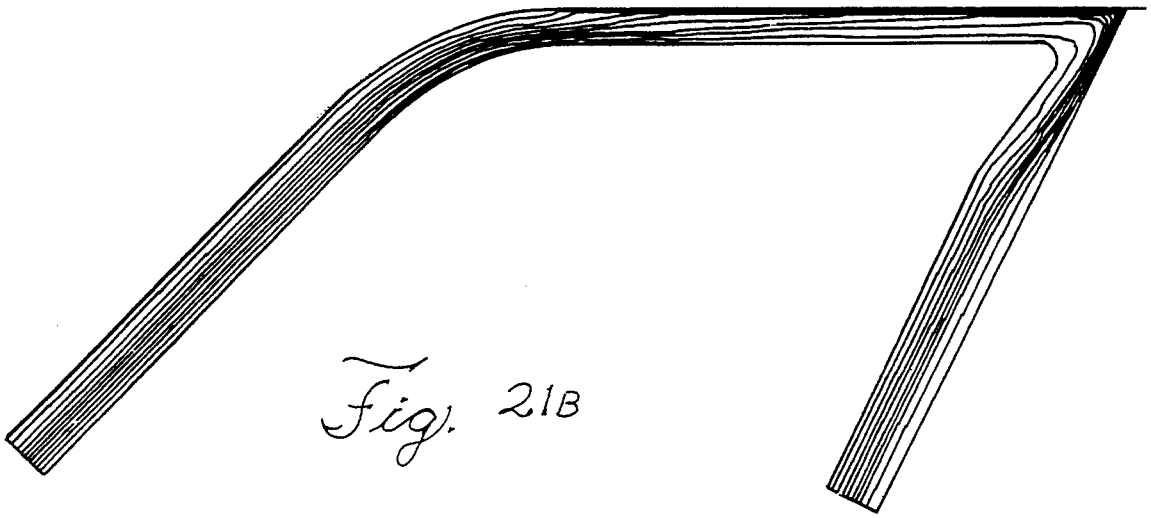
Figure 21C:
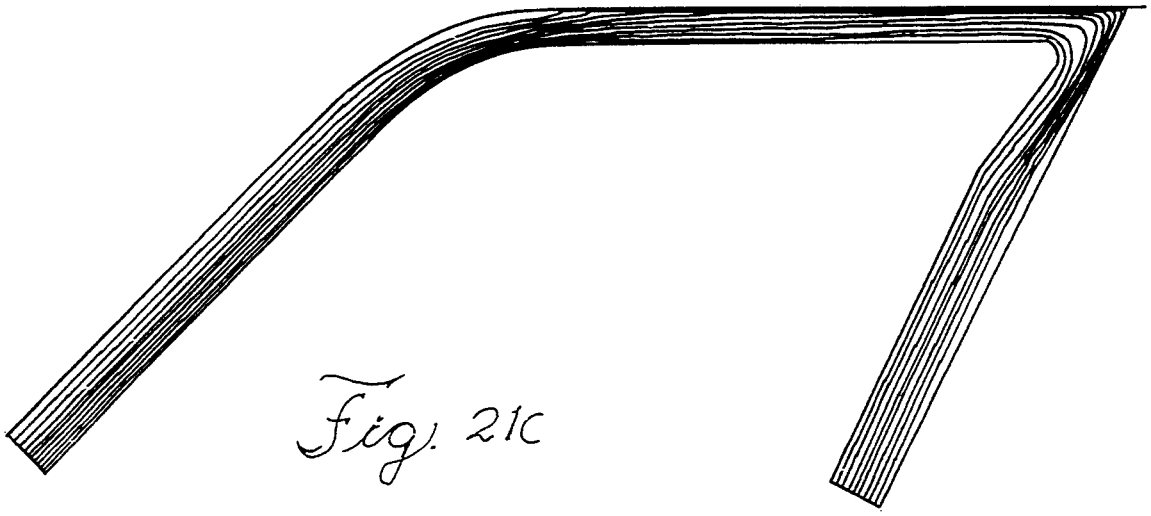
Figure 22A:
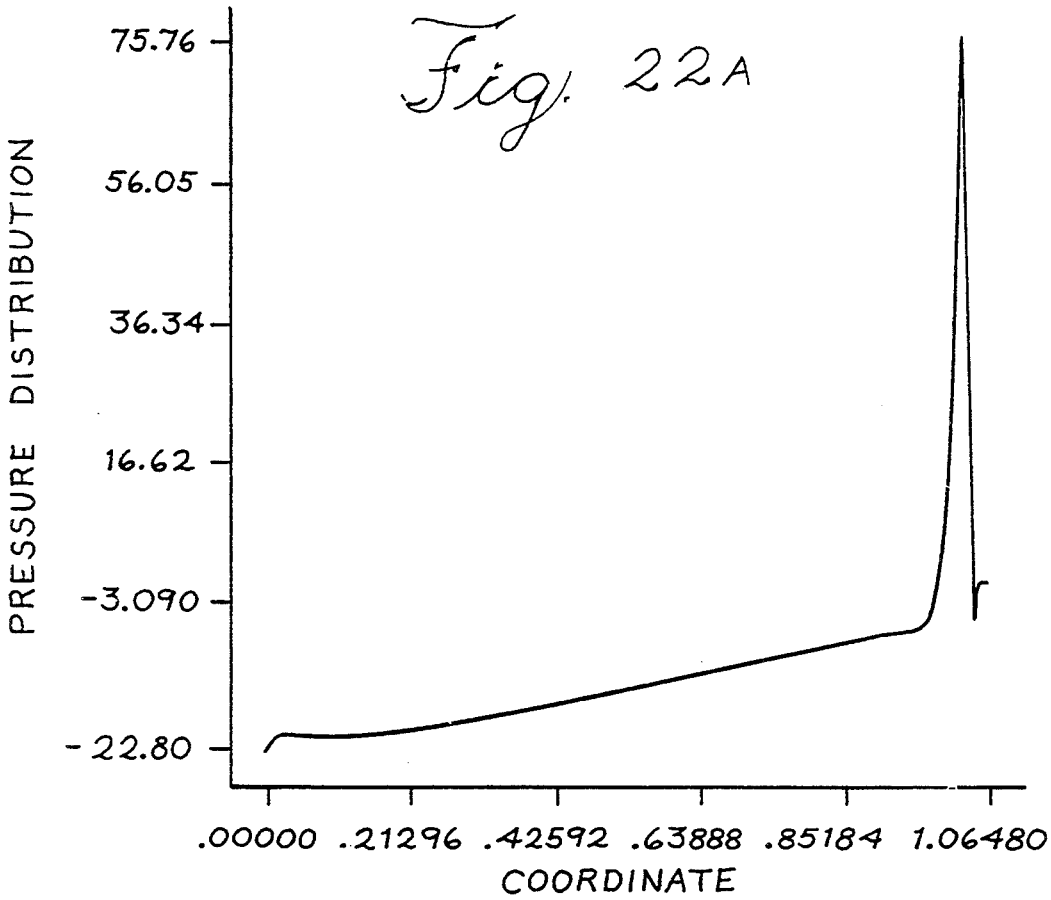
FIGS. 22A–22C illustrate pressure distribution along the substrate for cases NB61 to NB63 of Table 6.
Figure 22B:
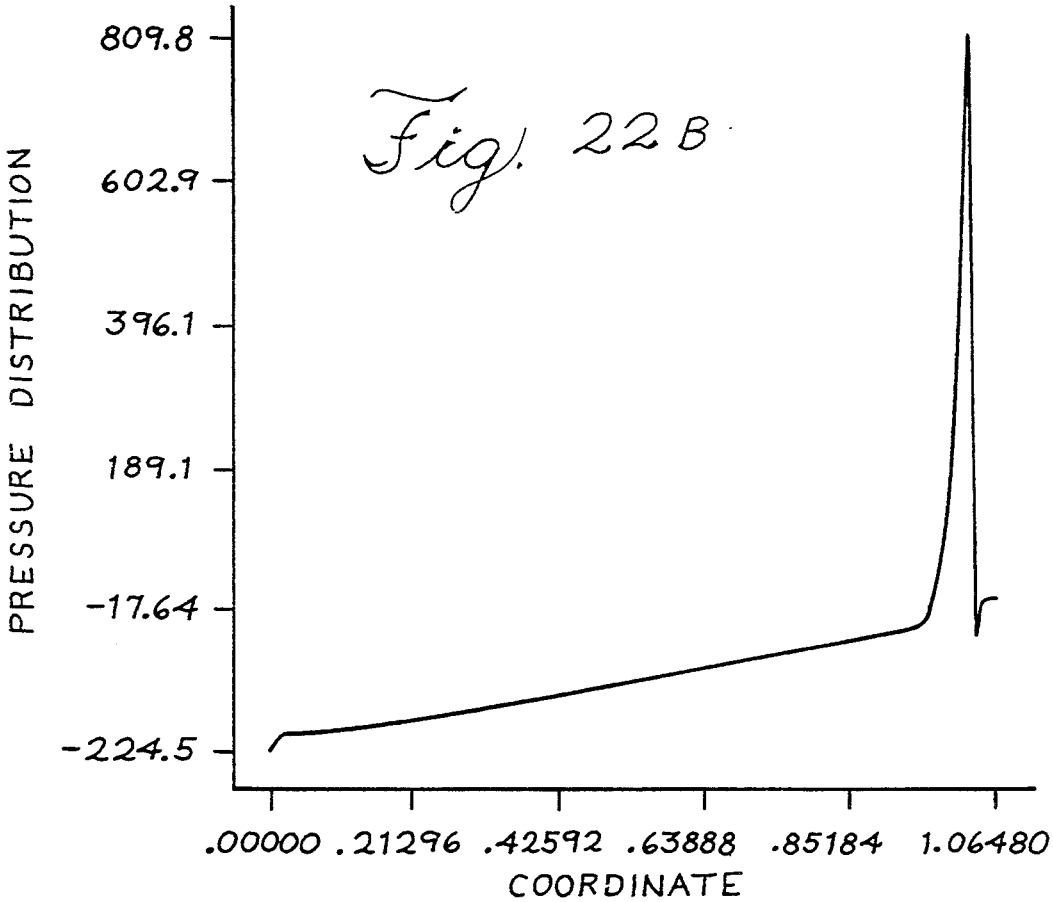
Figure 22C:
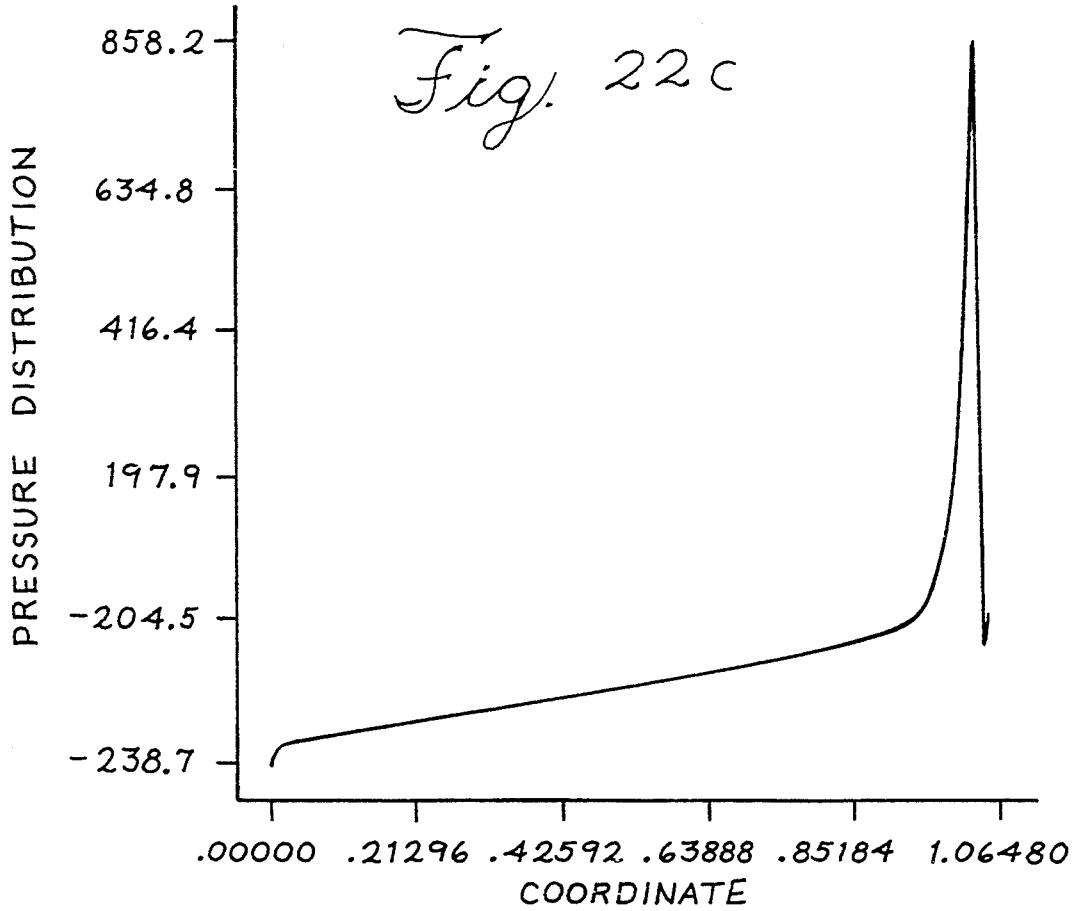
Figure 23A:
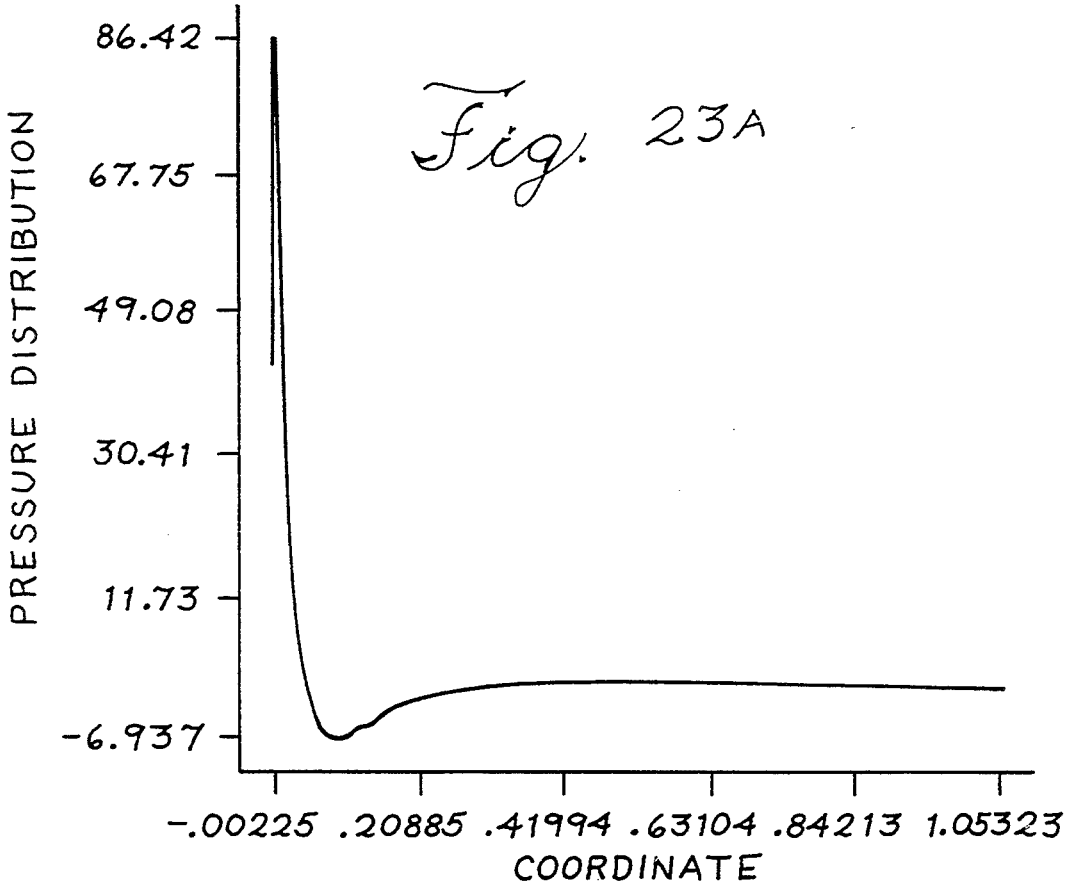
FIGS. 23A–23C illustrate pressure distribution along the blade for cases NB61 to NB63 of Table 6.
Figure 23B:
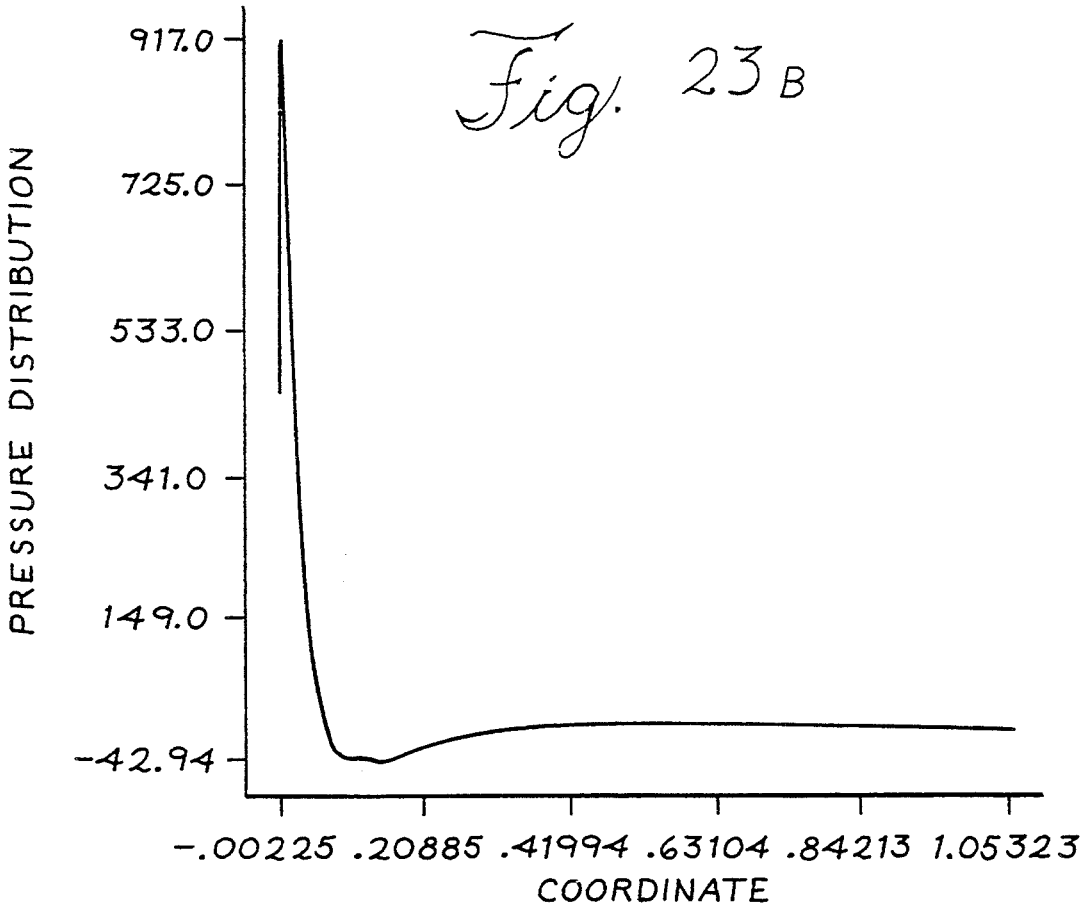
Figure 23C:
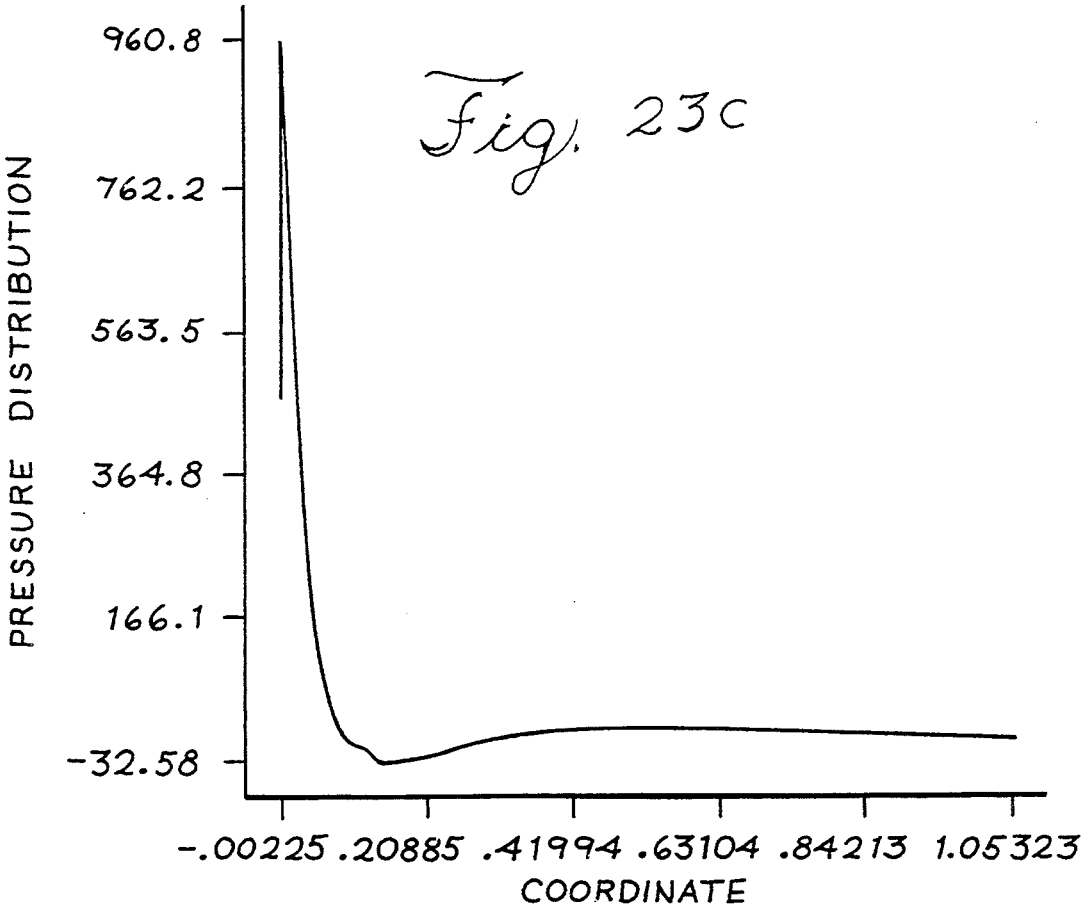

Two cases are investigated with respect to the web velocity. Column 5 in Table 6 shows how much liquid is pumped into the system while column 6 gives the total flowrate entering the applicator. As a result of the combined effects from pumping and the motion of the applicator wall the eddies vanish as shown in FIGS. 18A–18E for $U_{web}=30$ m/s and in FIGS. 21A–21C for $U_{web}=40$ m/s. FIGS. 19A–19E and 20A–20E illustrate the pressure distribution along the substrate and the blade, respectfully, for $U_{web}=30$ m/s. FIGS. 22A–22C and 23A–23C present these pressure distributions for $U_{web}=40$ m/s. In both cases the pressure increases approximately 10–20% while the eddies disappear from the system.

In the present blade coating system with increasing web/substrate speed the eddies in general become stronger. Three ways to suppress these eddies have been investigated. The first one corresponds to the gradual increase of fluid discharge per unit width entering the applicator. The second way employs a modified geometry which results in the downstream motion of the separation point. The last procedure is based on designing a moving applicator wall. In this case the combined effects from pumping, converging geometry and moving belt act to remove the eddies from the coating system.

While various aspects of the invention have been described with particularity, various modifications and alterations to the flotation coating device can be made without departing from the scope of the invention as defined in the appended claims.

APPENDIX

List of Symbols u and $u_i$ fluid velocity
u,v,w fluid velocity components
t time

TABLE 5

INPUT PARAMETERS FOR THE SIMULATION OF NON-NEWTONIAN FLOW (Carreau model)
(S = Flow separation)

| Run | $U_b$ m/s | $L_{in}$ m | $L_{gap}$ m | q l/s/m | $U_{web}$ m/s | $\gamma$ surf.tens kg/s$^2$ | $\mu_\infty$ viscosity kg/(m s) | $\mu_o$ viscosity kg/(m s) | K | $\rho$ density kg/m$^3$ | n | COMMENT ON THE RESULT |
|---|---|---|---|---|---|---|---|---|---|---|---|---|
| NB31 | 1.0 | 0.0025 | 50 $10^{-6}$ | 5.00 | 30.0 | 0.05 | 0.05 | 1.00 | 0.01 | 1200 | 0.65 | S |
| NB32 | 2.0 | " | " | " | " | " | " | " | " | " | " | S |
| NB33 | 3.0 | " | " | " | " | " | " | " | " | " | " | S |
| NB34 | 4.0 | " | " | " | " | " | " | " | " | " | " | S |
| NB35 | 5.0 | " | " | " | " | " | " | " | " | " | " | S |
| NB41 | 1.0 | 0.0025 | 50 $10^{-6}$ | 5.00 | 40.0 | 0.05 | 0.05 | 1.00 | 0.01 | 1200 | 0.65 | S |
| NB42 | 3.0 | " | " | " | " | " | " | " | " | " | " | S |
| NB43 | 5.0 | " | " | " | " | " | " | " | " | " | " | S |

TABLE 6

INPUT PARAMETERS FOR THE SIMULATION OF NON-NEWTONIAN FLOW (Carreau model)
(S = Flow separation, A = Attached flow)

| Run | $U_b$ m/s | $L_{in}$ m | $L_{gap}$ m | q pumped l/s/m | $\Sigma q$ l/s/m | $U_{web}$ m/s | $\gamma$ surf.tens kg/s$^2$ | $\mu_\infty$ viscosity kg/m s) | $\mu_o$ viscosity kg/(m s) | K | $\rho$ density kg/m$^3$ | n | COMMENT ON THE RESULT |
|---|---|---|---|---|---|---|---|---|---|---|---|---|---|
| NB51 | 5.0 | 0.0025 | 50 $10^{-6}$ | 0.0 | 6.25 | 30.0 | 0.05 | 0.05 | 1.00 | 0.01 | 1200 | 0.65 | S |
| NB52 | 5.0 | " | " | 2.5 | 8.75 | " | " | " | " | " | " | " | S |
| NB53 | 5.0 | " | " | 5.0 | 11.25 | " | " | " | " | " | " | " | S |
| NB54 | 10.0 | " | " | 5.0 | 17.50 | " | " | " | " | " | " | " | S |
| NB55 | 15.0 | " | " | 5.0 | 17.50 | " | " | " | " | " | " | " | A |
| NB61 | 5.0 | 0.0025 | 50 $10^{-6}$ | 5.0 | 11.25 | 40.0 | 0.05 | 0.05 | 1.00 | 0.01 | 1200 | 0.65 | S |
| NB62 | 10.0 | " | " | 5.0 | 17.50 | " | " | " | " | " | " | " | A |
| NB63 | 15.0 | " | " | 5.0 | 23.75 | " | " | " | " | " | " | " | A |

Table 6 gives the parameters for the numerical runs where the fluid discharge is allowed to increase via pumping and letting the moving belt drag liquid with it.

$X_i$ Cartesian coordinate
$\rho$ fluid density fi component of the Gravitational acceleration
p pressure
$P_a$ ambient pressure
ij stress tensor
n normal component of the stress vector
t tangential component of the stress vector
$\tau_{ij}$ deviatoric stress tensor
$\delta_{ij}$ Kronecker delta
$\epsilon_{ij}$ shear rate tensor
$\mu$ dynamic viscosity
$\mu_\infty$ infinite shear rate viscosity (Carreau model)
$\mu_o$ zero shear rate viscosity (Carreau model)
n power in the Carreau model
K time constant (Carreau model)
* superscript denoting non-dimensional quantity
U characteristic velocity scale
$U_p$ maximum velocity at the inlet if the inflow has a parabolic velocity distribution
L characteristic length
Lin width of the inflow channel
Lgap width of the gap between the blade and the substrate
$Re=\rho UL/\mu$ Reynolds number
$Ca=\mu U/\gamma$ capillary number
$U_{in}$ inflow velocity distribution
$U_w$ substrate velocity
$U_b$ applicator wall velocity boundary of the domain of computation
$\eta$ height of the free surface
$\gamma$ surface tension coefficient
H Gaussian mean curvature of the free surface
q flowrate per unit width entering the applicator

What is claimed is:

1. A flotation coating device for coating a traveling web of material comprising:

a coating composition application chamber having upstream and downstream side walls and an interior bottom wall, said upstream side wall and said interior bottom wall defining an entrance plenum therebetween for receiving a flowing coating composition and said downstream side wall and said interior bottom wall defining an exit plenum therebetween for discharge of said flowing coating composition;

means for guiding a traveling web of material over received flowing composition and said interior bottom wall thereunder; and flotation means for levitating said interior bottom wall allowing said interior bottom wall to move in the same direction as the received flowing composition.

2. A flotation coating device for coating a traveling web of material comprising:

a coating composition application chamber comprising upstream and downstream side-walls and a loop of material having an outer surface positioned therebetween supporting a flowing coating composition, said upstream sidewall and said loop of material defining an entrance plenum for receiving said coating composition and said downstream side wall and said loop of material defining an exit plenum for discharge of said coating composition;

means for guiding a traveling web of material over the surface of said loop positioning received coating composition therebetween; and means for suspending said loop in a flotation state providing substantially free movement of said loop about an axis substantially traverse to the direction of movement of the received coating composition allowing said outer surface of said loop to move in the same direction as the received and this charged coating composition.

3. A flotation coating device in accordance with claim 2 further comprising a shoe about which said loop is suspended.

4. A flotation coating device in accordance with claim 3 wherein the outer surface of said shoe is similar in form as said loop.

5. A flotation coating device in accordance with claim 3 wherein said suspending means comprise a fluid positioned between the inner surface of said loop and the outer surface of said shoe.

6. A flotation coating device in accordance with claim 5 wherein said fluid includes air.

7. A flotation coating device in accordance with claim 5 wherein said fluid includes a liquid.

8. A flotation coating device in accordance with claim 7 wherein said liquid has viscosity associated therewith, said viscosity causing friction between said loop and said liquid.

9. A flotation coating device in accordance with claim 8 wherein the viscosity of said liquid may be manipulated externally.

10. A flotation coating device in accordance with claim 9 wherein the viscosity of said liquid is manipulated by varying the temperature of said liquid.

11. A flotation coating device in accordance with claim 9 wherein the viscosity of said liquid is manipulated by changing the pressure on said liquid.

12. A flotation coating device in accordance with claim 9 wherein the viscosity of said liquid is manipulated by the presence or absence of an electromagnetic field.

13. A flotation coating device in accordance with claim 2 further comprising means for controlling the movement of said loop.

14. A flotation coating device in accordance with claim 2 wherein said free movement of said loop is proportional to and limited to some fraction of the movement of said flowing coating composition from the entrance plenum to the exit plenum.

15. A flotation coating device in accordance with claim 2 wherein said loop comprises a flexible material.

16. A flotation coating device in accordance with claim 15 wherein said flexible material comprises a thin metallic foil.

17. A flotation coating device in accordance with claim 3 wherein said shoe comprises a porous material.

18. A flotation coating device in accordance with claim 3 wherein said shoe comprises a metallic material.

* * * * *

UNITED STATES PATENT AND TRADEMARK OFFICE

CERTIFICATE OF CORRECTION

PATENT NO. : 5,354,376

DATED : October 11, 1994

INVENTOR(S) : Cyrus K. Aidun

It is certified that error appears in the above-indentified patent and that said Letters Patent is hereby corrected as shown below:

Column 16, line 11, change "this charged" to -- discharged --.

Signed and Sealed this

Twenty-fourth Day of January, 1995

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,354,376

DATED : October 11, 1994

INVENTOR(S) : Cyrus K. Aidun

It is certified that error appears in the above-indentified patent and that said Letters Patent is hereby corrected as shown below:

Column 1, line 5, insert the following paragraph:

--This invention was made with Government support under National Science Foundation Grant Number CTS-9258667 awarded by the National Science Foundation. The Government has certain rights in this invention.--

Signed and Sealed this

Tenth Day of August, 1999

*Attest:*

*Attesting Officer*

Q. TODD DICKINSON

*Acting Commissioner of Patents and Trademarks*